US009701105B2

(12) United States Patent
Schäfer

(10) Patent No.: US 9,701,105 B2
(45) Date of Patent: Jul. 11, 2017

(54) METHOD FOR CONVEYING PRINTING FORMS DURING THE CHANGEOVER OF PRINTING FORMS AND PRINTING MACHINE HAVING A PRINTING TOWER AND A VERTICALLY MOVABLE STORAGE DEVICE

(71) Applicant: KOENIG & BAUER AG, Würzburg (DE)

(72) Inventor: Karl Schäfer, Kürnach (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 14/912,936

(22) PCT Filed: Jun. 11, 2014

(86) PCT No.: PCT/EP2014/062064
§ 371 (c)(1),
(2) Date: Feb. 19, 2016

(87) PCT Pub. No.: WO2015/024681
PCT Pub. Date: Feb. 26, 2015

(65) Prior Publication Data

US 2016/0207304 A1 Jul. 21, 2016

(30) Foreign Application Priority Data

Aug. 22, 2013 (DE) ..... 10 2013 216 661
Aug. 22, 2013 (DE) ..... 10 2013 216 665

(51) Int. Cl.
*B41F 27/12* (2006.01)
*B41F 27/00* (2006.01)
(Continued)

(52) U.S. Cl.
CPC ..... *B41F 27/00* (2013.01); *B41F 7/12* (2013.01); *B41F 27/06* (2013.01);
(Continued)

(58) Field of Classification Search
CPC ..... B41F 7/12; B41F 27/00; B41F 27/1206; B41F 27/06; B41P 2227/62; B41P 2227/63
(Continued)

(56) References Cited

U.S. PATENT DOCUMENTS 5,427,028 A 6/1995 Nobuta et al.
5,440,985 A 8/1995 Shimmura et al.
(Continued)

FOREIGN PATENT DOCUMENTS

DE 4003445 A1 8/1991
DE 4442265 A1 5/1996
(Continued)

OTHER PUBLICATIONS

International Search Report of PCT/EP2014/062064, mailed on Jul. 10, 2015.

*Primary Examiner* — Jill Culler
*Assistant Examiner* — Marissa Ferguson Samreth
(74) *Attorney, Agent, or Firm* — Mattingly & Malur, PC

(57) ABSTRACT

A printing machine has a printing tower with a plurality of printing units arranged one above the other and a printing form changeover system having at least one vertically movable storage device for printing forms. A first machine plane, which is associated with one or a plurality of first printing units, is provided. A conveying system, which can move the vertically movable storage device from a loading position located in the region of the first machine plane to an advanced position which is vertically spaced apart, is provided. In addition to the vertically movable storage device, an additional storage device which is associated with the first printing unit of the printing tower is provided.

12 Claims, 19 Drawing Sheets

(51) Int. Cl.
*B41F 27/06* (2006.01)
*B41F 7/12* (2006.01)

(52) U.S. Cl.
CPC ..... *B41F 27/1206* (2013.01); *B41P 2227/62* (2013.01); *B41P 2227/63* (2013.01)

(58) Field of Classification Search
USPC ..... 101/219, 415.1, 477, 480
See application file for complete search history.

(56) References Cited

U.S. PATENT DOCUMENTS 5,564,336 A * 10/1996 Straubinger ..... B41F 9/026 101/152
6,644,191 B2 * 11/2003 Narui ..... B41L 13/04 101/219
8,161,875 B2 * 4/2012 Gsell ..... B41F 27/1206 101/415.1
8,505,452 B2 * 8/2013 Hollings ..... B41F 27/1206 101/477

FOREIGN PATENT DOCUMENTS

| | | | | | |
|---|---|---|---|---|---|
| DE | 19804106 | A1 | | 8/1999 | |
| DE | 102006032204 | B3 | | 10/2007 | |
| DE | 102006032201 | A1 | | 1/2008 | |
| DE | 102007024607 | A1 | | 11/2008 | |
| DE | 102008045679 | A1 | | 11/2009 | |
| DE | 102008036053 | | * | 2/2010 | ..... B41F 27/1206 |
| DE | 102008036053 | A1 | | 2/2010 | |
| DE | 102008044228 | A1 | | 6/2010 | |
| DE | 102009000750 | A1 | | 10/2010 | |
| DE | 102009039050 | A1 | | 3/2011 | |
| EP | 1193061 | A1 | | 4/2002 | |
| EP | 2186638 | A2 | | 5/2010 | |
| GB | 2413530 | A | | 11/2005 | |
| WO | 2012/045494 | A1 | | 4/2012 | |

* cited by examiner

II
23
18
B2
I
76 (71)
51
17.2 (L17A)
53.2
46
67
66
59
53.1
89
58
53
38
56
04
04
B1
48

METHOD FOR CONVEYING PRINTING FORMS DURING THE CHANGEOVER OF PRINTING FORMS AND PRINTING MACHINE HAVING A PRINTING TOWER AND A VERTICALLY MOVABLE STORAGE DEVICE

CROSS-REFERENCE TO RELATED APPLICATIONS

This application is the U.S. National Phase, under 35 U.S.C. §371 of PCT/EP2014/062064, filed Jun. 11, 2014; published as WO/2015/024681 A2 and A3 on Feb. 26, 2015 and claiming priority to DE 10 2013 216 665.6, filed Aug. 22, 2013 and to DE 10 2013 216 661.3, also filed Aug. 23, 2013, the disclosures of which are expressly incorporated herein by reference.

FIELD OF THE INVENTION

The present invention relates to a method for conveying printing formes during the changeover of printing formes and to printing machines having a printing tower and a vertically movable storage device. The printing tower has a plurality of printing couples arranged one above the other, the tower having one or more first printing couples in an associated machine plane with respect to access, and one or more second printing couples spaced vertically from the first printing couples. In a process for loading new printing formes, a vertically movable storage device, which is located in a loading position, is loaded with a plurality of printing formes side by side or with a plurality of preloaded carrier elements side by side, as viewed in the longitudinal direction of a forme cylinder of the printing couple or couples assigned to the storage device in question, and the storage device and/or the carrier element is loaded with a plurality of printing formes, one in front of the other and/or one above the other, for one or more second printing couples.

Once the process for loading new printing formes is completed, the storage device, which is loaded with new printing formes, is moved by a conveyor device from the loading position to an advanced position which is assigned to the second printing couple or couples with respect to the infeed of printing formes.

The storage device and/or a detachable carrier element of the storage device is configured such that a plurality of printing formes can be stored side by side simultaneously on or in the storage device, as viewed in the longitudinal direction of a forme cylinder of the printing couple or couples assigned to the storage device. A machine plane assigned to one or more first printing couples in terms of access is provided. A conveying system is provided, by which the vertically movable storage device can be moved from a loading position, which may be in the machine plane, to a vertically spaced advanced position, which is assigned to one or more second printing couples with respect to the infeed of printing formes. The conveying system and/or the storage device is arranged and/or is configured such that the storage spaces for the printing formes to be transported on or in the storage device lie within the printing couple alignment defined by the usable length of the forme cylinders of the second printing couple or couples, both in the advanced position and over at least a part of the vertical conveying distance and/or in the loading position.

BACKGROUND OF THE INVENTION

From WO 2012/045494 A1, a printing forme changing system having a storage device associated with a printing unit is known, wherein in a further development thereof, carrier elements in the form of changing magazines that can be inserted into the storage device can be conveyed, preloaded, by means of appropriate transport devices through the print shop to the printing unit, where they can be inserted manually or by means of a manipulator. The printing formes to be mounted are removed by a transfer unit from the storage device, which can be shifted to a working state, and are fed to the forme cylinder in question. For returning used plates, a return storage unit is provided, which in the preferred embodiment is arranged spaced horizontally from the printing unit and can be moved to a receiving position close to the printing couple by a combined vertical and pivoting movement.

DE 10 2006 032 204 B3 relates to a method for supplying printing formes at the location where they will be mounted on a forme cylinder, wherein a printing forme to be mounted is transported in a transport module from exposure up to the mounting location, where it is conveyed by a transport device of the transport module from said module to the forme cylinder, and mounting is supported by a roller element integrated into the module. The module can have an additional chute for receiving at least one printing forme to be removed. The printing unit to be supplied with printing formes has two printing couples, one above the other, which define two different planes of the printing unit, designated as the lower and an upper plane, in the vertical direction. In one embodiment of the printing unit, the two printing couples cooperate over a horizontally extending path, and in another embodiment each cooperates with another printing couple over a vertically extending path. In a first embodiment, on the operating side of the printing unit, for each printing couple plane a transport track, extending horizontally parallel to the cylinder axis, and a lifting device, arranged in an alignment that extends laterally adjacent to the printing unit and connecting the two horizontal transport tracks, are provided. The module which has been moved to the horizontal transport track of the upper printing couple plane can be pivotable downward for mounting the printing forme at the end face of said module having the opening, and the module which has been moved to the horizontal transport track of the lower printing couple plane can be pivotable with its opening facing upward. In an alternative embodiment, only one horizontal transport track extends at half the height between the two printing couple planes, with the transport modules for the upper and lower planes being arranged rotated 180° relative to one another on the horizontal transport track.

GB 2 413 530 A discloses a printing forme changing system assigned to a printing tower and having a printing forme module, the cartridge of which is arranged, e.g. detachably on a printing forme loading module. In the printing forme module, printing formes are held one above the other on a plurality of support elements arranged in the manner of trays, the support elements in one embodiment being movable independently of one another by means of a drive mechanism assigned to the printing forme module, and those in another embodiment being movable by means of a mechanism provided on the printing forme loading module in the longitudinal direction of the printing formes between a storage position and an outer position. The printing forme loading module comprises a pivotable printing forme loading head, by which a printing forme arranged in the outer position directly above the channel can be held by means of suction pads and pressed into the channel. The system, which comprises the printing forme loading module and the printing forme module, can be moved vertically within an intermediate space between a frame section that supports the printing couple cylinder and a frame section that supports the inking units and is moved away for the printing forme change, between a parking position and the printing couples located at different heights, on a linear guide via a gear wheel, which interacts with a gear rack that is fixed to the frame, and which is driven by means of a motor, which is carried along. The cartridge is loaded with the printing formes of the printing tower, e.g., on site or in a pre-press area, wherein in the second case, it is transported to the printing tower by means of a belt system, for example.

DE 10 2008 036 053 A1 discloses a printing machine having a printing tower which comprises two printing units arranged one above the other. In this case, printing plate cartridges can be translocated vertically in such a way that, when they are lowered into the region of the lower printing unit, they can be loaded with printing plates, receiving said plates in the proper orientation and/or with precise positioning, and the printing plate cartridges loaded in this manner can be raised with a lifting device from the lower printing unit into the region of the printing unit positioned vertically above the lower printing unit. In a first embodiment, this translocation takes place between positions, with the printing plate cartridge extending in projection between the axial ends of the printing couple cylinders. In another embodiment, the vertical translocation takes place between positions when the printing plate cartridge, as viewed in projection, is located to the side of the printing couple cylinder. Once a printing plate cartridge which has been loaded in this manner with precise positioning has been raised, the printing plates can be accessed by means of a fully automatic or partially automatic printing plate changing device.

EP 1 193 061 A1 discloses a materials lifting apparatus in a printing machine, via which, in one embodiment, new and used printing formes can be transported between a lower and an upper operating plane. The lifting apparatus is located adjacent to a printing section in a frame and comprises racks arranged one above the other on a circulating means embodied as a chain, wherein the chain can be driven by means of a motor fixed to the frame.

U.S. Pat. No. 5,427,028 A also discloses a printing plate lifting apparatus. In this case, individual printing formes can be hung on bars, which are attached, continuously or each at only the end of the printing forme to be hung, to two chains circulating spaced from one another.

EP 2 186 638 A2 discloses a receiving device for printing plates, which has a rail with an angled section, in which angled ends of printing formes can be suspended, one above the other and side by side. In one embodiment, a rail for new plates, and below this a rail for old printing plates can be provided. The old plates and new plates can be transferred by a handling device, embodied as a robot arm, between the forme cylinder and the respective rail.

DE 10 2008 045 679 A1 discloses a printing machine and a method for handling printing plates, which enables a fully automated transport of plate storage devices, which have been pre-loaded by means of a manipulator. The loaded plate storage devices can be conveyed vertically from a first plane to a second plane by means of a cartridge lifting apparatus. In the second conveyor plane, the cartridges can be conveyed horizontally, in order to translocate each of these into the region of the printing couples of the specific printing unit for which the conveyed printing plates are being supplied. The printing plates are removed from the storage device and are fed to the plate cylinders close to the printing couple by means of a manipulator arm. Old plates that are removed during a printing plate change are either disposed of on-site in the area around the printing couples or transferred to the cartridge and fed automatically to a disposal area.

DE 10 2008 044 228 A1 discloses a printing unit having a lower machine plane and having printing couples that lie beyond the range of the lower machine plane. Printing forme magazines which are the width of a plurality of printing formes are assigned to forme cylinders of the printing unit, and are mounted rigidly in the printing couple or pivotably in the printing couple between a working position and an idle position. The printing forme magazines provided in different vertical positions can be loaded by means of a handling device, in which the printing formes to be newly applied are held on vertically movable platforms. The platforms can be loaded in advance by means of a distributing device. The handling device can comprise a vertically movable storage unit for used printing plates beneath the lowest of its platforms.

DE 10 2007 024 607 A1 relates to a method and a device for handling printing plates, in which printing plates to be applied are moved in a continuous circulating conveyor to a position close to the printing tower, where they are transferred by means of a transfer device to a horizontal conveyor and are finally picked up by a handling arm and placed in the plate cylinder position. In a modified embodiment, the horizontal conveyor can be dispensed with, in which case the printing forme is picked up by the handling arm directly from the continuous conveyor. Used printing plates can be transported back in the opposite direction using the same conveyors.

DE 44 42 265 A1 relates to a transport system for transporting printing formes, in which printing formes are transferred by a primary transport means at a transfer station close to the printing tower to a secondary transport system, which in a first embodiment comprises a vertically circulating loop or is embodied overall as such. At the removal station provided in each machine plane, a printing plate to be applied can be removed from the loop in the corresponding state from the provided opening and applied. The printing plate can be removed manually or by means of a plate handling system. The removal station is preferably embodied such that used, removed printing plates can be returned and transported back via the transfer device.

From DE 40 03 445 A1, an automatic plate infeed and cylinder loading system is known, in which a carriage carrying printing plates to be newly applied can be moved along a guide path extending at the end faces of a plurality of printing units. Between two neighboring printing units, a further guide path is provided, along which a handling device for removing printing plates from the carriage can be moved.

DE 198 04 106 A1 discloses a transport system and a method for conveying printing plates, wherein printing plates to be applied in a lower of two printing couples are or will be held in reserve in a lower printing forme storage device and printing plates to be applied in the upper printing couple are or will be held in reserve in an upper printing plate storage device. In order to apply the lower printing plates to the lower forme cylinder, the printing plates are removed from the lower printing plate storage device by conveyor means assigned to the lower printing couple, and are applied to the assigned forme cylinder. The same applies accordingly to the upper printing couple and to corresponding upper conveying means.

DE 10 2009 000 750 A1 discloses a storage device that can be moved vertically by means of a lifting apparatus on the printing tower. To convey printing formes from the storage device to respective magazines assigned to the printing couples arranged vertically, one above the other, a printing forme feeding system is provided, by which a printing forme arranged in the storage device can be lifted and conveyed horizontally to the magazine.

DE 10 2006 032 201 A1 relates to a handling apparatus for handling printing plates in a printing machine comprising a plurality of modules for different development stages. A plate mounting and unclamping system comprises a module for releasing the printing formes from the forme cylinder, a module for receiving the released printing formes and a module for mounting new printing formes. In addition, a module embodied as a handling apparatus may be provided, which comprises a handling apparatus for disposing of used printing formes. Finally, a module embodied as a transport device can be provided, by which the new printing formes can be transported to the printing couple and the used printing formes can be transported away from the printing couple.

DE 10 2009 039 050 A1 discloses a web-fed rotary printing press having a lifting apparatus by which printing plate containers delivered on a transport cart can be transported from a lower operating plane to an upper operating plane. In each of the printing plate containers, printing plates for a forme cylinder are positioned. The transport can be embodied, for example, to receive a number of printing plate containers for new plates required by the printing tower, and also a corresponding number of printing plate containers for used plates.

SUMMARY OF THE INVENTION

The object of the present invention is to provide a method for conveying printing formes during the changeover of printing formes, and a printing machine having a printing tower and a vertically movable storage device.

The object is attained according to the invention in that, during the translational transport of the storage device from the loading position to its advanced position and/or once it reaches the advanced position, the storage device is moved by a change in state relating to the tilt thereof from vertical to a working state, which is different from a loading state occupied in the loading position and/or from a transport state occupied at least temporarily during transport. The loading position is located in the area of the machine plane assigned to the first printing couple or couples, and in that the conveying system and/or the storage device is arranged and configured such that the storage device is in a transport state over at least a part of the conveying distance, which state differs in terms of the tilt in relation to vertical of the longitudinal extension of the transported or transportable printing formes and/or in terms of the tilt in relation to vertical of the extension of the vertically movable storage device in the longitudinal direction of the printing formes transported or to be transported, from the relevant tilt when the storage device is in a working state, in which the storage device is located in an advanced position assigned to the second printing couple or couples. The conveying system and/or the storage device is configured and/or arranged on the printing tower such that at least the loading position of the vertically movable storage device assigned to the printing tower is located close to the printing tower, i.e. as viewed in a horizontal direction, on the same side of an operating space which is accessible to operators, and on which the printing tower in question is also located. In addition to the vertically movable storage device, an additional storage device assigned to the first printing couple or couples of the printing tower with respect to the infeed of printing formes, is provided. The conveying system and/or the vertically movable storage device and the additional storage device are arranged and configured such that the vertically movable storage device located in its loading position, and the additional storage device are arranged offset from one another and can be reached for loading with printing formes or with a carrier element that is preloaded with printing formes from the same machine plane. The conveying system and the two storage devices are configured and/or arranged on the printing tower such that at least the loading positions of the two storage devices are arranged close to the printing tower, i.e. on the side close to the printing tower, as viewed in the horizontal direction, of an operating space that is accessible to operators.

The advantages to be achieved by the invention consist particularly in that the system allows a forme change to be carried out in less time and/or by fewer operators. At the same time, a system which is simple and safe, but is nevertheless flexible in terms of different machine configurations, in particular newspaper printing machines, is provided.

Of particular advantage is an embodiment for the transport of printing formes to be newly applied in which space-saving transport is carried out in a transport which is different from the working state. This embodiment avoids any unnecessary restriction of operating space and/or does not require an unreasonably large passage opening between different machine planes. Individually or also advantageously associated herewith are the advantages that result from the vertical transport near the printing tower, which does not or only marginally restricts operating space. In addition, for the transport step following vertical conveyance, which is critical to precise positioning during the application of new printing formes, it is not necessary to bridge an unnecessarily great distance to the forme cylinder in question.

In a particularly advantageous embodiment, a storage device assigned to the main operating plane and a vertically movable storage device are provided, enabling a printing forme change to be carried out in a relatively short time by a small number of operators.

For executing the transport of printing formes that have been removed, in a particularly advantageous embodiment the storage device or a wall is moved to a position closer to the printing tower for loading, and/or a holding means is moved to the conveying path. In this manner, good accessibility is likewise maintained, without any decrease in reliability. For the vertical transport of old printing formes, a conveying system which is separate from the vertical transport of new printing formes is provided, resulting in a particular advantage in terms of accessibility and the amount of time that is required. In contrast to solutions which have combined storage devices, here there is no conflict between removing from and feeding to the relevant printing couple. The additional spatial separation allows the installation space required for this purpose immediately adjacent to the printing tower to be limited.

By using a storage device having a carrier structure, in which a plurality of printing formes can be suspended side by side and one behind another without separating elements, the particularly slender shape of the loaded storage device ensures a particularly space-saving transport.

Additional advantageous developments are specified in relevant locations in the following description and/or in the claims.

As discussed, a particularly simple, variable and rapid system is thus provided by the components and particularly also by combinations thereof.

In a particularly advantageous method for conveying printing formes during a changeover of printing formes in a printing machine that comprises a printing tower which has a plurality of printing couples arranged one above the other and which comprises—particularly one above the other on the same side of the printing tower—one or more first printing couples in an associated machine plane in terms of access and one or more second printing couples, spaced vertically from the first printing couples, in a process for loading new printing formes a vertically movable storage device located in the loading position is loaded with a plurality of printing formes side by side or with a plurality of preloaded carrier elements side by side, as viewed in the longitudinal direction of a forme cylinder of the printing couple(s) or element(s) assigned to the storage device in question, and the storage device and/or the carrier element is loaded with a plurality of printing formes, one in front of the other and/or one above the other, for one or more second printing couples; once the process of loading new printing formes is completed, the storage device loaded with new printing formes is moved by a conveyor device from the loading position to an advanced position assigned to the second printing couple or couples with respect to the infeed of printing formes; during translational transport, the storage device is moved from the loading position to its advanced position and/or upon reaching the advanced position, is transferred by a change in state—particularly relating to its tilt in relation to vertical—to a working state which is different from a loading state occupied in the loading position and/or from a transport state occupied at least intermittently during transport.

Particularly advantageous in connection with the above is a printing machine having a printing tower which comprises a plurality of printing couples arranged one above the other, and having a printing forme changing system which comprises at least one vertically movable storage device for printing formes, wherein the storage device and/or a detachable carrier element—e.g. for carrying the printing formes—of the storage device is configured such that a plurality of printing formes can be stored simultaneously side by side on or in the storage device, as viewed in the longitudinal direction of a forme cylinder of the printing couple or couples assigned to the storage device in question, wherein a machine plane assigned to one or more first printing couples with respect to access is provided, wherein a conveying system is provided, by which the vertically movable storage device can be transferred from a loading position to a vertically spaced advanced position which is assigned to one or more second printing couples with respect to the infeed of printing formes, and wherein the conveying system and/or the storage device is disposed and configured such that the storage spaces for the printing formes to be transported on or in the storage device lie within the printing couple alignment defined by the usable length of forme cylinders of the second printing couple or couples both in the advanced position and also over at least part of the vertical conveying path and/or in the loading position, wherein the loading position is located in the area of the machine plane which is assigned to the first printing couple or couples, and in that the conveying system and/or the storage device is disposed and configured such that the storage device, over at least a portion of the conveying path, occupies a transport state which is different in terms of the tilt in relation to vertical of the longitudinal extension of the transported or transportable printing formes and/or in terms of the tilt in relation to vertical of the extension of the vertically movable storage device in the longitudinal direction of the transported or transportable printing formes from the relevant tilt of the storage device in a working state, which the storage device occupies in an advanced position assigned to one of the printing couples or to the second printing couple.

In addition to or in place of the abovementioned particularly advantageous method, in an enhanced or additional advantageous method for conveying printing formes during the changeover of printing formes in a printing machine having a printing tower that comprises a plurality of printing couples arranged one above the other, which comprises a plurality of first printing couples arranged one above the other in a machine plane which is assigned with respect to access and a plurality of second printing couples (02), spaced vertically from the first printing couples (02), a storage device assigned to the second printing couples with respect to the infeed of printing formes is transferred by vertical displacement by means of a conveyor device to a loading position (P17.2A), which can be reached from the machine plane assigned to the first printing couple or couples, the vertically movable storage device located in the loading position and assigned to the second printing couples is loaded with a plurality of printing formes (06) from an operating space of the printing tower, which is located to the side of the printing tower (01) as viewed in the radial direction of printing couple cylinders of the printing tower; before, after or overlapping with the loading of the storage device assigned to the second printing couples, another storage device assigned to the first printing couples of the same printing tower with respect to the infeed of printing formes is loaded with a plurality of printing formes from the operating space of the printing tower; and the storage device loaded with new printing formes and assigned to the second printing couples, at a time when the loading of the vertically movable storage device with a plurality of printing formes for the pending production run has been completed, is moved by a conveyor device from the loading position to an advanced position which is assigned to the second printing couples with respect to the infeed of printing formes.

In addition to or in place of the abovementioned particularly advantageous printing machine, in an enhanced or additional particularly advantageous printing machine, which is embodied as having a printing tower comprising a plurality of printing couples, one above another, and a printing forme changing system comprising at least one vertically movable storage device, and which comprises a machine plane assigned to one or more first printing couples, a conveying system is provided, by which the vertically movable storage device can be moved from a loading position located in the area of the machine plane to a vertically spaced advanced position, assigned to one or more second printing couples, wherein the conveying system and/or the storage device is disposed and configured such that the storage spaces for the printing formes to be transported on or in the storage device lie within the printing couple alignment defined by the usable length of forme cylinders of the second printing couple or couples, both in the advanced position and over at least a portion of the vertical conveying path and/or in the loading position, and the conveying system and/or the storage device is embodied and/or disposed on the printing tower such that at least the loading position of the vertically movable storage device assigned to the printing tower is situated near the printing tower, i.e. as viewed in the horizontal direction, on the same side of an operating space, which is accessible to operators, on which the relevant printing tower is located, and/or wherein, in addition to the vertically movable storage device, an additional storage device assigned to the first printing couple or couples of the printing tower with respect to the infeed of printing formes, and the conveying system and/or the vertically movable storage device, along with the additional storage device, are disposed and configured such that the vertically movable storage device located in its loading position and the additional storage device are arranged offset in relation to one another and can be reached from the same machine plane for loading with printing formes or with a carrier element that is preloaded with printing formes, and the conveying system and the two storage devices are embodied and/or arranged on the printing tower such that at least the loading positions of the two storage devices are located near the printing tower, i.e. as viewed in the horizontal direction, on the printing-tower side of an operating space that is accessible to operators.

In one of optionally a plurality of particularly advantageous enhancements of an aforementioned method or an aforementioned printing machine, a vertically movable storage unit, different from the storage device for printing formes to be newly applied, for returning printing formes which have been removed from one or more second printing couples is provided, wherein a conveying system is preferably provided, by means of which the vertically movable storage unit can be moved, independently of the vertically movable storage device, between a loading position, which is vertically spaced from the first machine plane and is assigned to one or more second printing couples, and a removal position, which is assigned to the first machine plane.

The aforementioned particularly advantageous variants and/or enhancements of the method of conveyance and/or enhancing features for the printing machine, as described below in reference to the exemplary embodiments, may be added individually or multiply to form advantageous developments.

For example, in all the embodiments for one or preferably for a plurality of second printing couples, a transfer unit, e.g. a transport carriage or a multi-arm manipulator, which is guided along a transport path, can be provided, by which the printing formes to be removed can be transported from a position close to the forme cylinder to the storage unit or to a holding means disposed upstream thereof and/or by which printing formes to be mounted can be transported from the storage device to a position close to the forme cylinder.

BRIEF DESCRIPTION OF THE DRAWINGS

Exemplary embodiments and embodiment details of the invention to be optionally added individually or in multiples to the aforementioned embodiments are shown in the set of drawings and will be specified in greater detail in the following.

The drawings show.

DESCRIPTION OF THE PREFERRED EMBODIMENTS

Figure 1:
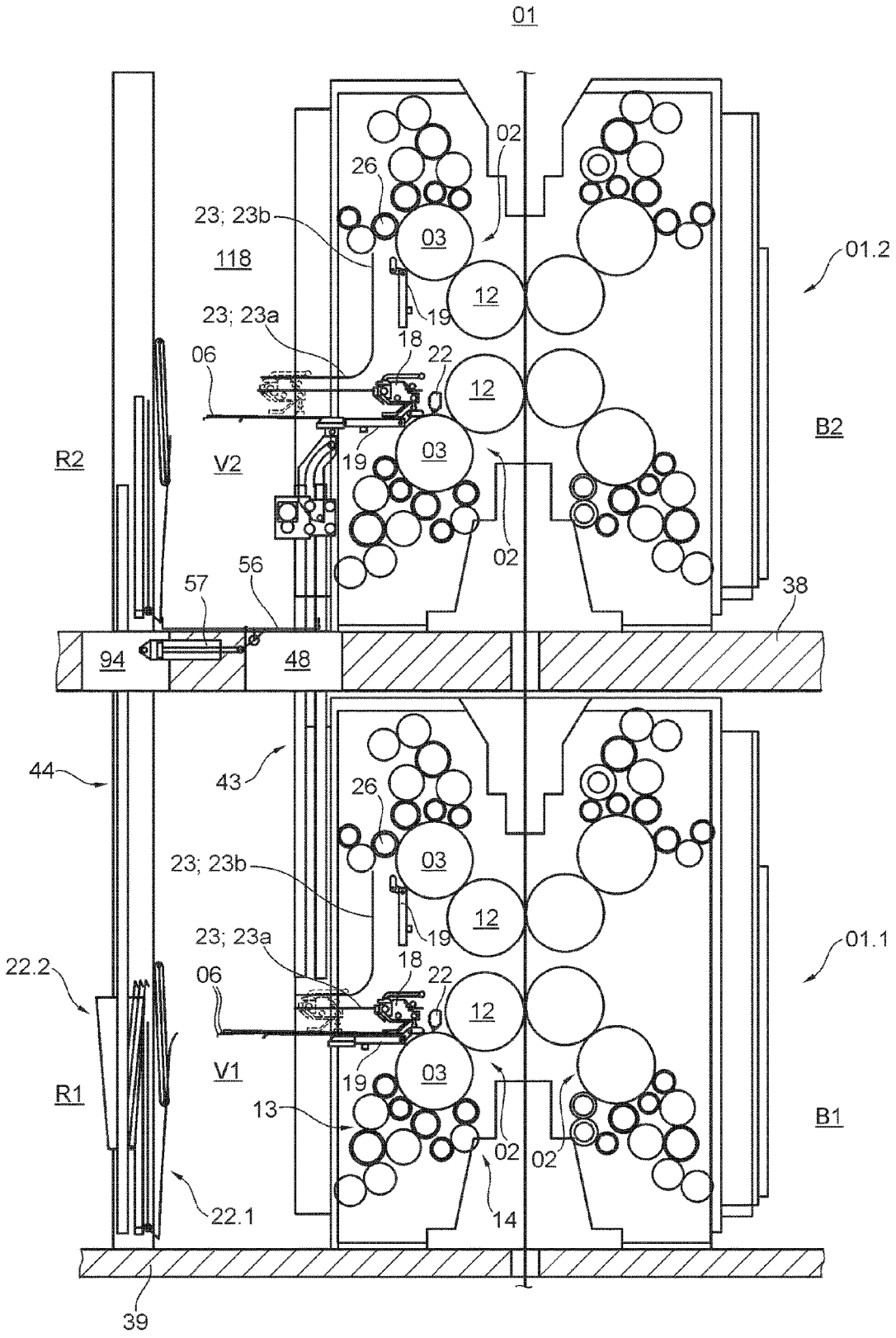
FIG. 1 a schematic representation of a printing tower having a printing forme changing system.

A printing machine, in particular a web-fed printing machine, preferably a newspaper printing machine, comprises at least one printing tower 01, which has at least two, preferably at least four printing couples 02 arranged vertically, one above the other, on the same side of a web 16 passing through printing tower 01, each having a printing couple cylinder 03 embodied as a forme cylinder 03, which are rotatably mounted at their end faces in a manner not illustrated in greater detail in a frame 123, e.g. in side frames 04 of a first machine side I and a second machine side II (FIG. 1). Printing tower 01 is preferably embodied as a printing tower 01 for operating with substantially vertical web travel, i.e. a web 16 passing through printing tower 01 during production—in contrast to printing couples of illustration printing machines, e.g. upward from the bottom, or vice-versa in exceptional cases. The preferred printing tower 01 in this case has, e.g. in the same frame or in frames of a plurality of, e.g. two stacked printing units 01.1; 01.2, at least four printing couples 02, in particular vertically one above the other, which interact with the same side of the web. In the advantageous embodiment shown, two groups, each containing e.g. two printing couples 02 arranged one above the other on the same side of the web, are arranged in frames of two stacked printing units 01.1; 01.2, in particular H-printing units 01.1; 01.2, the two printing couples 02 arranged one above the other each forming, e.g. a blanket-to-blanket print position with another printing couple. However, these should also be contained in stacked printing units 01.1; 01.2, for example, in which the two printing couples 02 arranged one above the other on the same side and two additional printing couples 02 arranged on the other side interact with a satellite cylinder and form a so-called satellite printing unit.

Figure 2:
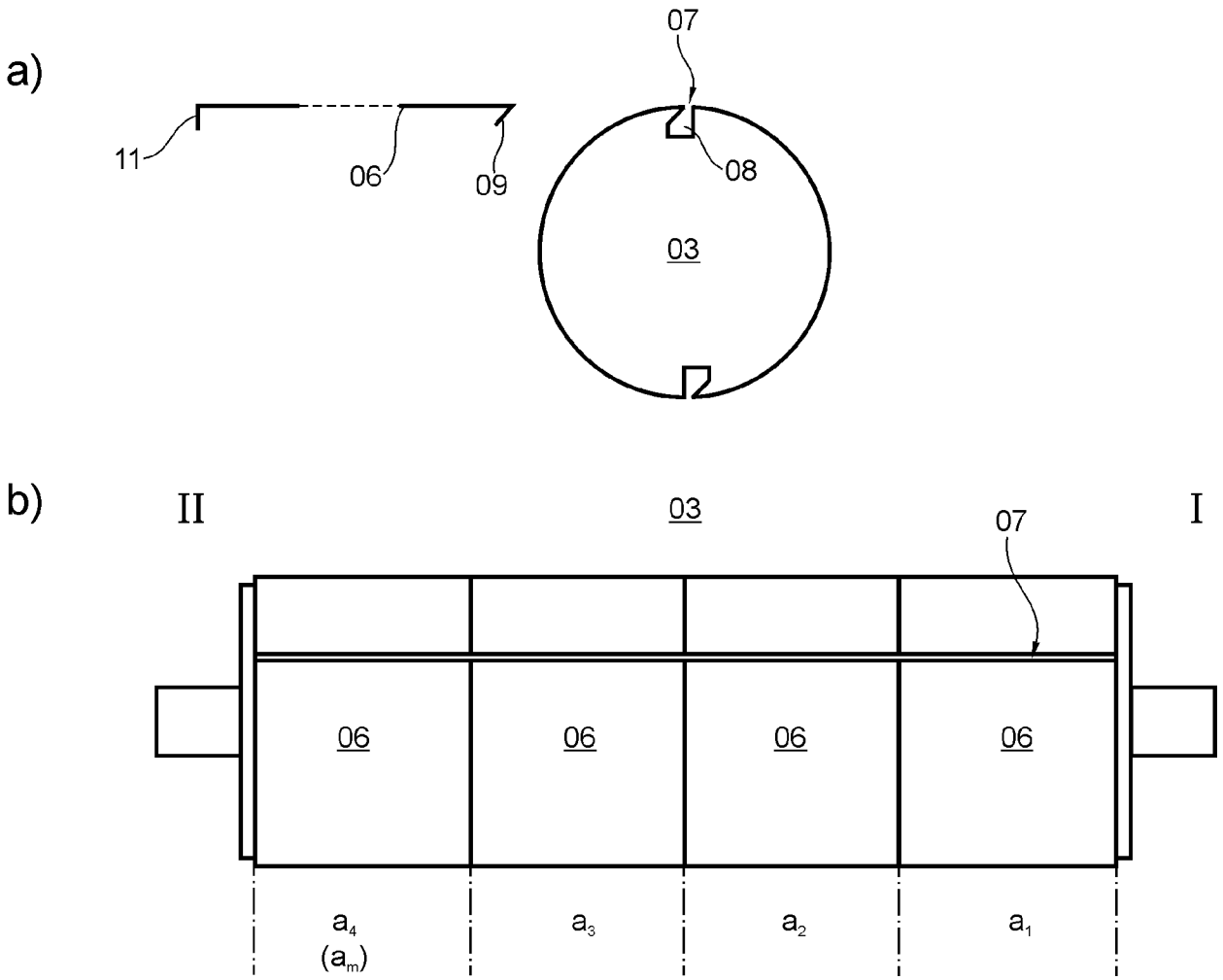
FIG. 2 a schematic sectional representation of a printing forme and a forme cylinder having channels a) and a side view of a forme cylinder loaded with printing formes b)

Each forme cylinder 03 is embodied to receive one, and particularly a plurality of printing formes 06, e.g. printing plates 06, which can be detachably affixed to forme cylinder 03. For this purpose, said cylinder has on its circumference, one or more axially extending openings 07 of channels 08, into which ends 09; 11 of printing formes 06, e.g. printing forme ends 09; 11 can be inserted and can be held in a positive and/or frictional connection (FIG. 2*a*)). At least one leading end 09 of printing forme 06 can preferably be bent at an acute angle such that it can be suspended at an edge, which is embodied as nose-shaped in cross-section, in the region of opening 07, and can thereby be affixed with a positive connection in relation to a circumferential direction on the edge. Trailing end 11 is advantageously bent at an angle of 80°-100°, preferably 85°-95°, particularly 90°. Printing forme 06 is embodied as flat, and has a transversely extending leading end 09, preferably as a leading, particularly bent end 09, a transversely extending trailing end 11, advantageously as a trailing, likewise bent end 11, and two side edges that extend in the longitudinal direction of printing forme 06. The transverse direction and/or transverse extension of printing forme 06 is therefore understood as the direction along the leading, preferably bent end 09, with the direction of a side edge that extends perpendicular thereto defining the longitudinal direction and/or longitudinal extension of printing forme 06. In addition, printing forme 06, which is embodied as flat, has a front side which faces outward when clamped in forme cylinder 03 and/or which bears the information of the print image to be transferred. The side that faces forme cylinder 03 in the mounted state can then be designated as the back side.

A retaining device, not illustrated in greater detail, is preferably provided in channel 08, and holds at least trailing end 11 in a frictional and/or positive connection in channel 08. Forme cylinder 03 is preferably embodied as having a "double" circumference, i.e. as having a circumference which in this case corresponds substantially to a number of k=2 (k $\in \mathbb{N}$, e.g. k=1 or 2) printing pages and/or printing section lengths arranged in sequence, preferably k newspaper pages or optionally 2 k tabloid pages. For example, it has a number of l channels 08 (l $\in \mathbb{N}$, e.g. l=1 or 2, preferably l=k), one in front of the other in the circumferential direction, each having a corresponding opening 07 to the circumferential surface, in which l printing formes 06 can be affixed to forme cylinder 03, one in front of the other in the circumferential direction. In the double-circumference embodiment presented here, l=2. In the axial direction of forme cylinder 03, said cylinder is preferably configured as having an effective and/or usable length that corresponds to a plurality of printing pages or printing image widths, preferably newspaper pages of a nominal format, side by side, e.g. up to n (n $\in \mathbb{N}$, e.g. n≥2). For this purpose, said cylinder is preferably embodied as loadable with a plurality of printing formes 06, e.g. up to at least m (m $\in \mathbb{N}$, e.g. m≥2), side by side. In an advantageous embodiment, forme cylinder 03 is embodied as having a width that corresponds to at least four (n=4) printing pages arranged side by side. For this purpose, it can be loaded side by side with at least two printing formes 06 side by side, preferably with up to four (m=4) printing formes 06 embodied as single printing formes (FIG. 2*b*)). It may also optionally be embodied as loadable with at least two printing formes 06 embodied as panoramic printing formes, each bearing two printing pages, or with four printing formes 06 embodied as single printing formes 06, each bearing one printing page, or also in combination with two printing formes 06 of single-page width and one printing forme of two-page width. Printing forme ends 09; 11 of all adjacent printing formes 06 are preferably arranged in axial alignment relative to one another on forme cylinder 03 (or as an alternative, offset no more than 15 mm in the circumferential direction). To receive the aligned printing formes 06, in one advantageous embodiment, channels 08 and/or openings 07 thereof are embodied as continuous over the usable length, i.e. over the length that can be occupied by printing formes 06. In a further alternative, the printing forme ends of all adjacent printing formes 06 are not arranged aligned with one another, and are instead each offset from one another in pairs in the circumferential direction by one-half printing forme length.

In printing couple 02, which is preferably embodied as offset printing couple 02, forme cylinder 03 interacts with a printing couple cylinder 12 embodied as transfer cylinder 12, and with at least with one inking unit 13 and optionally with one dampening unit 14. The lengths of transfer cylinder 12, inking unit 13 and optionally provided dampening unit 14 are embodied as matching the active length of forme cylinder 03. Here—as discussed above—printing unit 01 has two printing couples 02, arranged one above the other, which interact with the same web side of a web 16, e.g. embodied as a paper web, which passes through printing unit 01. In all, it has four printing couples 02, which in pairs form blanket-to-blanket print positions on their transfer cylinders 12 in the thrown-on position. However, printing unit 01 as a modular unit could also have more than four printing couples 02. In principle—at least the two transfer cylinders 12 arranged one above the other—could interact with a common impression cylinder, in which case printing unit 01 is embodied as a so-called 9-cylinder or 39-cylinder satellite printing unit, and the printing couples 02 arranged one above the other interact with the same side of the web. Preferably, however, it is embodied with two blanket-to-blanket printing couples arranged one above the other, in particular as an H-printing unit 01, as shown.

In the present example, forme cylinder 03 is embodied as "double width", which corresponds to an operational and/or usable length (nominal width $L_N$) of n=4 printing pages arranged side by side in the nominal format indicated for printing unit 01. The above also applies accordingly to the embodiment of a single-width printing unit 01 (n=2) or a triple-width printing unit 01 (n=6), with the maximum number m of printing formes 06 to be applied, e.g. single printing formes 06, preferably corresponding to the number n. Printing unit 01 and/or forme cylinder 03 is preferably embodied as multiple-width (e.g. n=4 or 6), shown here as double-width (n=4), and can be loaded with up to m=4 or m=6 printing formes 06, in this case with up to m=4, side by side.

At least one of printing couples 02 arranged one above the other, for example one of the groups of printing couples 02 of printing tower 01 arranged one above the other, in particular printing couples 02 of one of the stacked printing units 01.1; 01.2, is or are arranged at a height that differs from a first machine plane B1, e.g. first operating plane B1, for example main operating plane B1, such that said printing couple 02 or printing couples 02 cannot be reached directly from the first machine plane B1, e.g. operating plane B1, by operators for servicing or maintenance purposes, in particular for a changeover of printing formes.

In particular, two of the printing couples 02 arranged one above the other, advantageously two groups of printing couples 02 of printing tower 01, arranged one above the other, in particular printing couples 02 of two stacked printing units 01.1; 01.2, are assigned to different operating planes B1; B2 of the printing machine, i.e. they are arranged at different heights such that they can be reached directly by operators for servicing or maintenance purposes only from two different machine planes b1; b2, e.g. operating planes B1; B2, i.e. would be or are in the access area thereof. In particular, two different machine planes B1; B2, e.g. operating planes B1; B2, are assigned to printing couples 02 of the two printing units 01 in the stated manner. In this case, for example, an upper operating plane B2 in the manner of a catwalk plane B2 is assigned to the at least one upper printing couple 02, in particular, for example, to the printing couples 02 of the upper printing unit 01.2, on which the operators can be moved and/or can move for the purpose of servicing and/or maintaining upper printing couple 02 or upper printing couples 02. A lower operating plane B1, e.g. a main operating plane B1 located in a base plane B1 of the printing machine, is assigned to the at least one lower of printing couples 02, in particular to printing couples 02 of a or the lower printing unit 01.1, in which operating plane the operators move and/or can move for the purpose of servicing and/or maintaining lower printing couple 02 or lower printing couples 02.

The second machine plane B2, embodied, e.g. as catwalk plane B2, can comprise regions of a catwalk 38 that can be traversed at least for maintenance purposes, and are preferably secured by handrails, not shown, and by other safety measures to prevent operators from falling. Catwalk 38 is thus an intermediate platform 38 between two machine planes (B0); B1, having at least partially traversable areas—regardless of whether this "intermediate platform" is a continuous surface or one that is interrupted by openings and/or whether it is a flat floor surface or base sections of the same machine or operating plane B1; B2 which are offset in terms of height by landings.

Base plane B1 is formed, for example, by a base 39 of a ground level plane or a so-called machine table, which supports the at least one printing tower 01. Below this, a machine plane (B0), not shown, can be provided, on which one or more roll changers 146 for supplying the at least one printing tower 01 with at least one web 16 may be provided. In that case, base 39 likewise represents an intermediate platform 39 between two machine planes (B0); B1, as described above and in the following.

Figure 11:
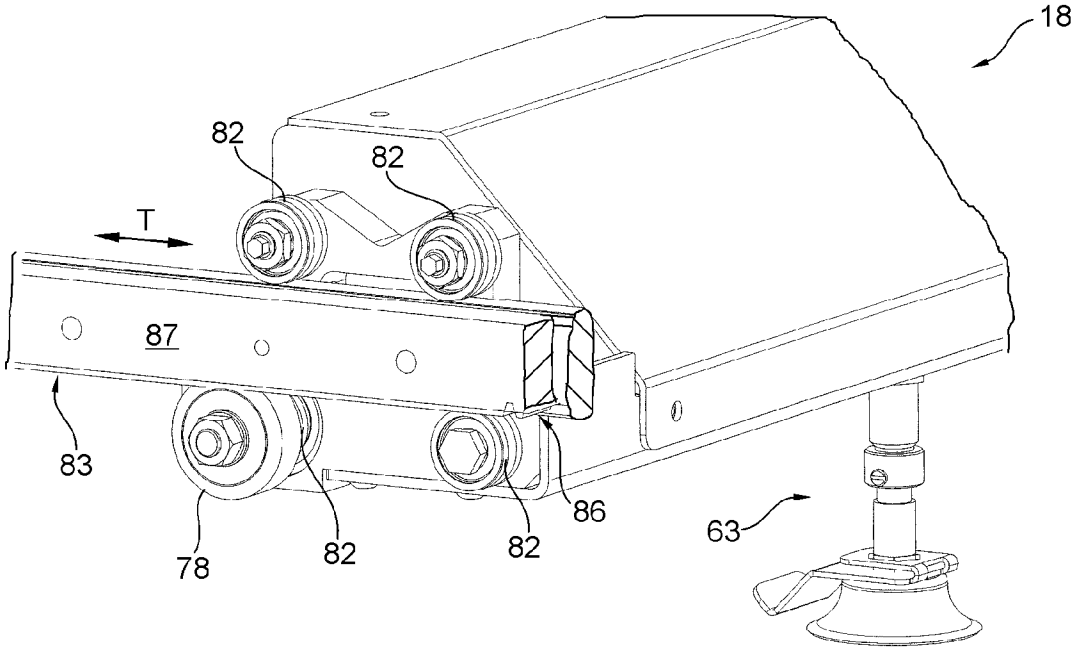
FIG. 11 a side view from side I of the transfer unit of FIG. 10.
Figure 12:
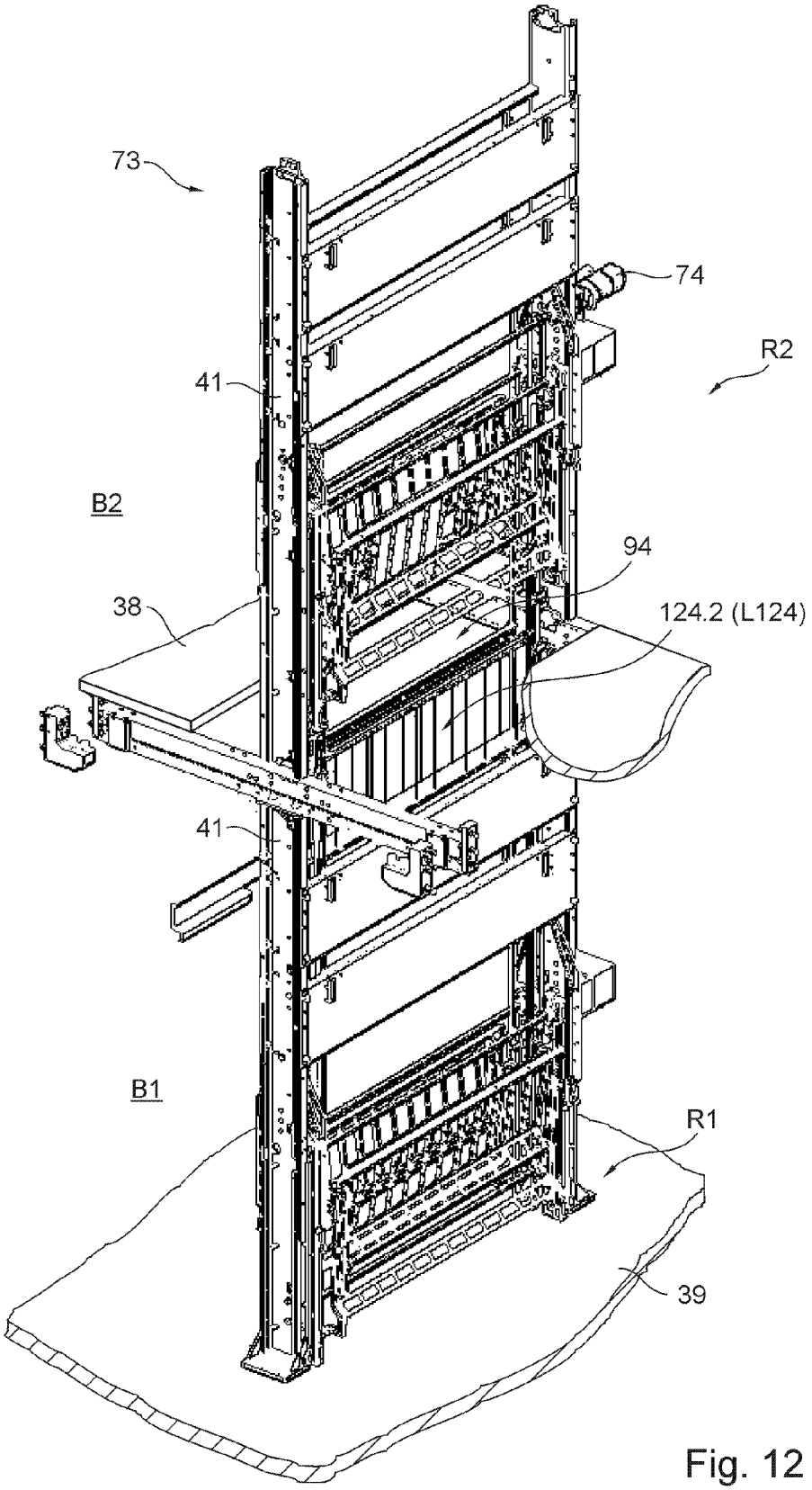
FIG. 12 a perspective representation of a vertically movable storage device for used printing formes, having a vertical conveying system and a storage unit conveyed between the machine planes in the transport state.
Figure 13:
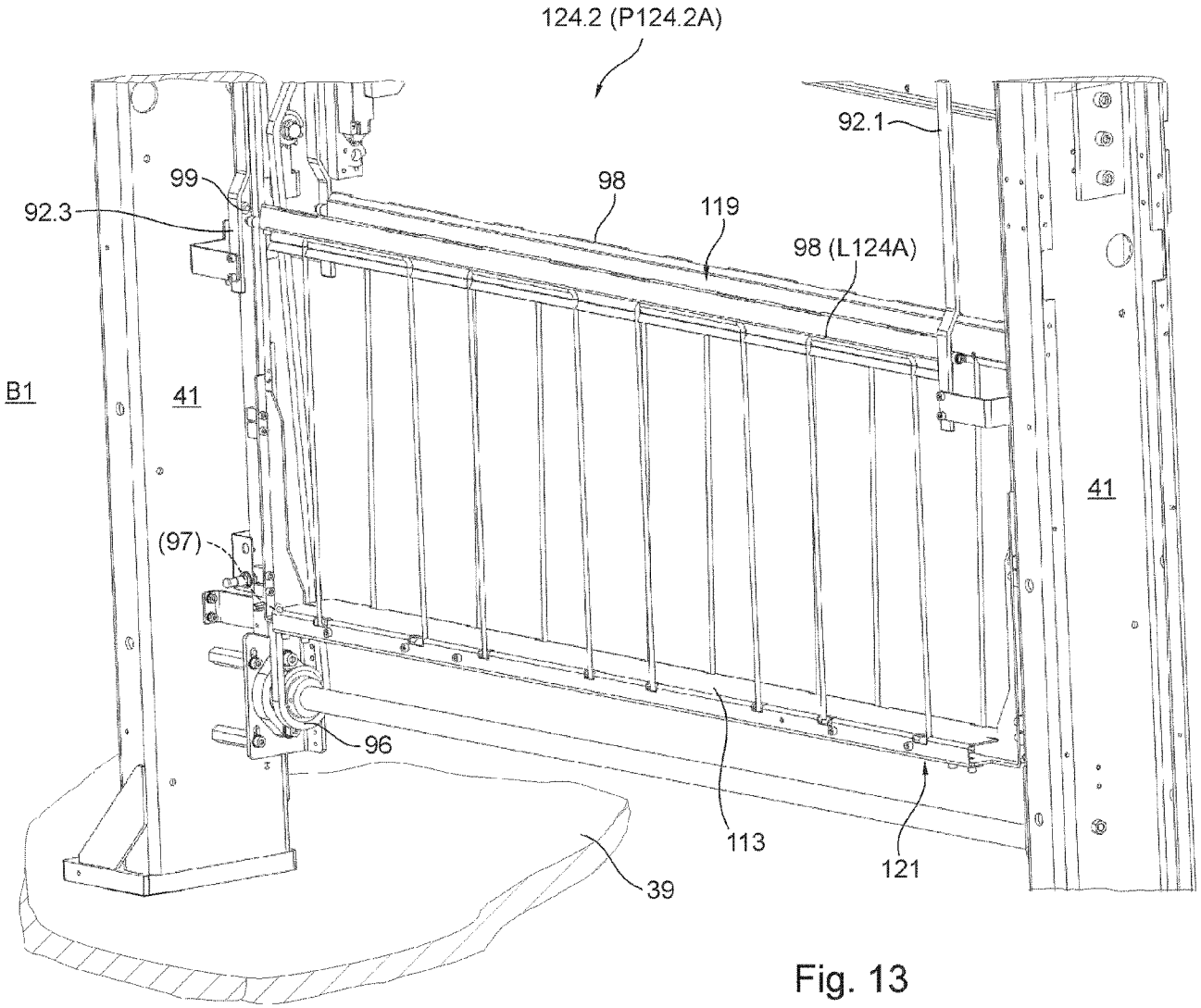
FIG. 13 a perspective view of the storage device for used printing formes in the area of a first operating plane, with a storage unit located in the removal position and a wall in the removal state.
Figure 14:
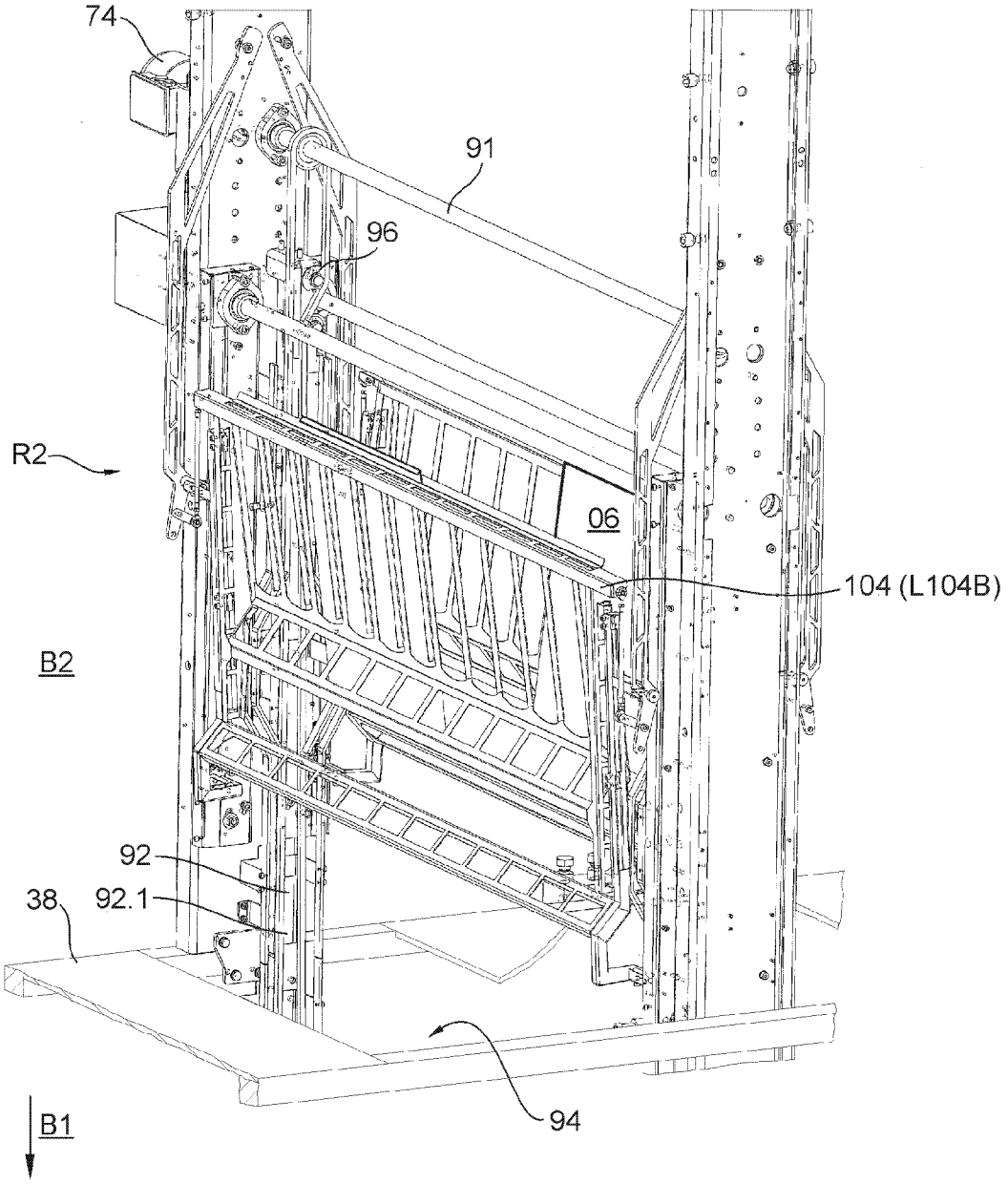
FIG. 14 a perspective view of the storage device for used printing formes in the area of a second operating plane, in which a feed table is shown in the idle or the delivery state.

A printing forme changing system is assigned to and/or associated with printing tower 01, and has as system components 17.1; 17.2; 22.1; 22.2 at least one first storage device 17.1, e.g. a printing forme storage unit 17.1, for holding in reserve close to the printing couple a plurality of printing formes 06 to be newly applied in at least one lower of the printing couples 02, in the region of a first advanced location V1 provided at a first level near the printing couple, and at least one second storage device 17.2, e.g. a printing forme storage unit 17.2, for holding in reserve near the printing couple a plurality of printing formes 06 to be newly applied in at least one upper of the printing couples 02, in the region of a second advanced location V2 provided at a second level, spaced vertically from the first level, close to the printing couple, and/or at least one first storage device 22.1 for receiving, close to the printing couple, a plurality of used printing formes 06 which have been removed from at least one lower of the printing couples 02, in the area of a first return location R1 provided at a first level, and at least one second storage device 22.2 for receiving, close to the printing couple, a plurality of used printing formes 06 which have been removed from at least one lower of the printing couples 02 in the area of a second return location R2 provided at a second level, spaced from the first level (see, e.g. FIG. 1 and FIG. 11).

Second advanced location V2 and/or second return location R2 is provided outside the area of access of main operating plane B1, but, for example, in the area of access of catwalk plane B2, and first advanced location V1 and/or return location R1 is provided in the area of access of main operating plane or base plane B1.

To save operators the trouble of having to change operating planes as part of a regular printing forme change operation, or if applicable to avoid even having to provide a catwalk 38 for the second or upper machine plane B2 which can be traversed during operation, as an additional system component 43, a particularly vertical transport system 43, assigned to printing tower 01, is provided, by which a storage device 17.2 can be moved between a first position P17.2A, e.g. a loading position P17.2A, which as described above is assigned e.g. to a first operating plane B1, in particular main operating plane B1, to a second position P17.2B, spaced vertically from the first position, e.g. an advanced position P17.2B, in the area of a vertically offset second advanced location V2. This second position P17.2B is not assigned to the former operating plane B1; B2 as described above, in that it is not located within reach of said operating plane B1; B2—under normal circumstances, i.e. for an operator of average height (e.g. for a female operator 165 cm in height or for a male operator 178 cm in height) without supplemental means. Movement between the two positions P17.2A; P17.2B preferably takes place primarily (e.g. over >70% of the conveying distance) or particularly substantially (e.g. with a maximum deviation of ±5°) vertically and/or linearly, at least over the majority (e.g. >70%) of the conveying distance. In principle, loading position P17.2A of storage device 17.2, which can be moved to a vertically spaced advanced position P17.2B, can be provided in base plane B1 or in a catwalk plane B2, wherein in the first case, the transport is from base plane B1 up to a higher-level advanced location V2, for example a higher operating plane B2, and in the second case, the transport is from a higher operating plane B2, e.g. a catwalk plane B2, to an advanced location V1 at a lower level, for example a lower operating plane B1, e.g. base plane B1.

Loading position P17.2A of storage device 17.2, which can be moved to a vertically spaced advanced position P17.2B, is preferably provided in the operating plane B1; B2 in which, for example, the printing formes 06 to be newly applied are transported from a functional area 141 relating to printing forme production to printing tower 01, which—as discussed below—which transport can be carried out manually, with motorized support, or fully automatically. This operating plane B1; B2 can then be viewed as main operating plane B1; B2. Starting from the operating plane B1; B2 which comprises loading position P17.2A for storage device 17.2, which can be moved to a vertically spaced advanced position P17.2B, the printing couples 02 of printing tower 01 that are assigned to said operating plane B1; B2, or the printing couples 02 of printing unit 01.1; 01.2 in question, in particular the storage device 17.1 thereof located in the loading position (P17.1A), can be reached, along with storage device 17.2, which is located in loading position P17.2A and can be moved vertically to the vertically offset advanced location V2. Base plane B1, from which lower printing couples 02 of printing tower 01 or printing couples 02 of lower printing unit 01.1 can be reached, is preferably main operating plane B1, having the advanced location V1 which is assigned to the lower printing couples 02 of one web side and loading position P17.2A of storage device 17.2, which can be moved vertically to a vertically offset advanced location V2. For the case presented here, storage device 17.1, which is assigned to printing couples 02 of main operating plane B1; B2, is not moved vertically, so that the loading position (P17.1A) coincides with an advanced position (P17.1B) and is therefore denoted only within parentheses and cannot be distinguished in the figures, where it also is not identified. In principle, however, two positions of this type, spaced from one another, could be provided for storage device 17.1 assigned to main operating plane B1.

Transport system 46, 47, 54, 52, which transports the vertically movable storage device 17.2 between loading position P17.2A and advanced location V2 or advanced position P17.2B, comprises a carriage 46, which is and/or can be fixedly or detachably connected to storage device 17.2, a drive 47, 54, 52, which conveys carriage 46 vertically, and e.g. a guide. Carriage 46 can also be configured as part of a multipart storage device 17.2 embodied accordingly with means required for actuation, or conversely, storage device 17.2 can also be embodied as part of a multipart carriage 46, embodied accordingly with means required for storing printing formes 06 (e.g. a structure 34, which will be described in greater detail below), which part interacts with the printing formes 06 to be conveyed and/or held in reserve. Operationally, storage device 17.2 and carriage 46 advantageously form a unit which can optionally be disassembled for maintenance purposes, and which can be loaded in loading position P17.2A with printing formes 06 to be applied.

In principle, the drive can have any configuration. For instance, in a first embodiment, not shown, a carriage which comprises storage device 17.2 or is connected thereto can be connected to a circulating traction means, e.g. a chain, a belt or a cable, which is and/or will be driven, via a drive gear, by a motor which is stationary relative to side frame 04 of printing tower 01 and/or printing units 01.1; 01.2. The loop of the circulating traction means extends substantially in a vertical direction. To ensure a defined movement, the carriage or carriage part can be articulated to a guide which extends vertically over at least the majority of the conveying distance. As a stationary drive, a hydraulically or pneumatically actuated push or pull rod may alternatively be provided, by which the carriage or carriage part can be moved back and forth on the at least predominantly vertically extending guide between the position to be occupied for loading position P17.2A and the position to be occupied for advanced position P17.2B. In a preferred embodiment, however, actuation is effected via a drive means 47, which is fixed to the carriage or carried along with storage device 17.2, and which interacts with a spatially fixed gear part 52 in a frictional or positive connection via a corresponding gear mechanism by means of a gear part 54 which is fixed to the carriage.

Vertical conveyance is carried out, or the vertical conveying system 43 with vertically movable storage device 17.2 is embodied and arranged in such a way that at least some, in particular all printing formes 06 to be conveyed, or some, in particular all storage spaces for printing formes 06 to be conveyed lie within the printing couple alignment, at least in advanced position P17.2B of storage device 17.2, which is located at the end of the conveying distance, and preferably over the entire conveying distance and advantageously also in loading position P17.2A of storage device 17.2. This also includes the abbreviated wording of this subject matter, that storage device 17.2 can be moved vertically by conveying system 43 in the manner described above within the printing couple alignment—in contrast to an alignment that is shifted to the side of the machine. The printing couple alignment in this case is the, e.g. corridor-like space between the two planes that intersect perpendicularly with the end faces of the forme cylinder axes of forme cylinders 03 of printing tower 01, in particular at both sides of the usable and/or operational length thereof. Preferably, vertical conveyance is carried out, or the vertical transport system 46, 47, 54, 52 with vertically movable storage device 17.2 is configured and arranged in such a way that each of the printing formes 06 to be conveyed is already in alignment true to lateral register, as viewed in the axial direction of the forme cylinder 03 in question, and/or in position for the intended location on forme cylinder 03, at least in advanced position P17.2B of storage device 17.2, which lies at the end of its conveying distance, and preferably over the entire conveying distance, and advantageously also in loading position P17.2A of storage device 17.2.

Vertical conveyance is carried out such that, or vertical conveying system 43 with vertically movable storage device 17.2 is configured and arranged such that loading position P17.2A of vertically movable storage device 17.2, which is assigned to an operating plane B1, in particular to main operating plane B1 as described above as relates to access, is disposed on an operating side of the printing couple 02 or printing couple group assigned to said operating plane B1. The operating side of printing couple 02 or of printing unit 01.1; 01.2 or of printing tower 01 is understood as a longitudinal side of printing couple 02 or of printing unit 01.1; 01.2 or of printing tower 01 from which operators can access printing couple 02 or printing couples 02 for maintenance purposes, and/or which extends parallel to and alongside printing couple cylinders 03; 12. In operating plane B1, which comprises loading position P17.2A, a traversable space 118, e.g. operating space 118, is located adjoining printing unit 01.1; 01.2 or printing tower 01 on the operating side.

Loading position P17.2A of the vertically movable storage device 17.2 assigned to printing tower 01 and preferably also at least a portion of the conveying path adjoining loading position P17.2A, in particular the entire conveying path up to advanced position P17.2B, is or are disposed close to the printing tower, i.e. on the side of operating space 118 close to the printing tower. In other words, storage device 17.2, located in loading position P17.2A, and optionally the stated conveying paths, are located in a vertical alignment between the printing couple cylinders of printing tower 01 and operating space 118 of the relevant operating plane B1. A guide for conveying system 43 is preferably arranged on side frame 04 of printing tower 01 or printing units 01.1;

01.2, or is attached thereto. In loading position P17.2A (P17.1A), the two storage devices 17.1; 17.2 are spaced or offset from one another, in particular vertically offset, so that they can both be loaded with printing formes 06, e.g. without mutual interference. Loading position P17.2A of vertically movable storage device 17.2 assigned to printing tower 01 is preferably above storage device 17.1 located in loading position L17A and assigned to the first printing couple or couples 02, i.e. the two storage devices are located in respective loading positions P17.2A (P17.1A), e.g. each in its loading state L17A, one above the other on the same side of operating space 118, such that they can be reached by operators from the same operating plane B1; B2 for loading with printing formes 06, without supplemental means, and preferably without mutual interference (see, e.g. FIG. 4). Although in principle the loading can also be carried out by a handling device embodied for this purpose, in the present example it is carried out by operators.

The vertically movable storage device and preferably also the other storage device 17.2; 17.1, assigned to the same side of printing tower 01, can in principle be configured in any way for receiving a plurality of printing formes 06, in particular a number m that corresponds with the nominal width $W_N$, side by side, in the same frame or frame rack, and particularly for accepting, in a radial direction relative to the forme cylinder axis, a plurality of printing formes 06, in particular up to four printing formes 06, one above the other or one in front of the other, in a radial direction relative to the forme cylinder axis. In this case, the printing formes 06 arranged one above the other and/or one in front of the other—particularly viewed in the direction perpendicular to the longitudinal direction of storage device 17.2; 17.1—are facing one another in pairs on the front and back sides, i.e. with the back side of one printing forme 06 facing the front side of another printing forme 06.

This can be a box-like storage device 17.1; 17.2 having individual compartments for printing formes 06, for example, which comprises, for example, a drive mechanism for the individual removal or removal in layers of printing formes 06, for example. Storage device 17.1; 17.2 with the drive mechanism for removal can be configured in a first embodiment, which is advantageous e.g. in terms of the installation space required in printing tower 01, such that with it—optionally according to an additional method and/or pivoting of storage device 17.1; 17.2—printing formes 06 can be fed directly to the forme cylinder 03 in question or to a mounting device situated upstream.

In another embodiment, which is advantageous e.g. in terms of a standardization of storage device 17.1; 17.2, printing formes 06 which have been at least partly removed by a drive mechanism can be grasped e.g. by gripping or holding mechanisms of an additional system component 18.1; 18.2, allocated to printing tower 01 and embodied as transfer unit 18.1; 18.2, and can be fed to the forme cylinder 03 in question or to a mounting device 19 situated upstream.

In a further embodiment, which is advantageous, e.g. in terms of freedom of movement, and which has no additional drive mechanism for relative movement, storage device 17.1; 17.2 can be embodied as a storage unit which is at least partially open, e.g. toward the top, on a longitudinal side that faces toward or away from printing tower 01, in which storage unit the printing formes 06 are advantageously held in reserve substantially vertically, and are grasped e.g. in groups by gripping or holding mechanisms of a transfer unit 18.1; 18.2 embodied, e.g. as a manipulator having at least two arms that are articulated to one another, and can be fed to the forme cylinder 03 in question or to a mounting device 19 situated upstream.

In one advantageous embodiment, storage device 17.1; 17.2 can be embodied without its own drive mechanism for relative conveyance between storage device 17.1; 17.2 and printing formes 06, in which case—optionally after an additional translational movement and/or a pivoting of storage device 17.1; 17.2 as a whole—printing formes 06 to be applied are grasped, e.g. by gripping or holding mechanisms of a transfer unit 18.1; 18.2 allocated to printing tower 01, out of or from storage device 17.1; 17.2 and fed to the forme cylinder 03 in question or to a mounting device 19 situated upstream. A particularly advantageous example of such an embodiment of storage device 17.1; 17.2 is described below.

Figure 8:
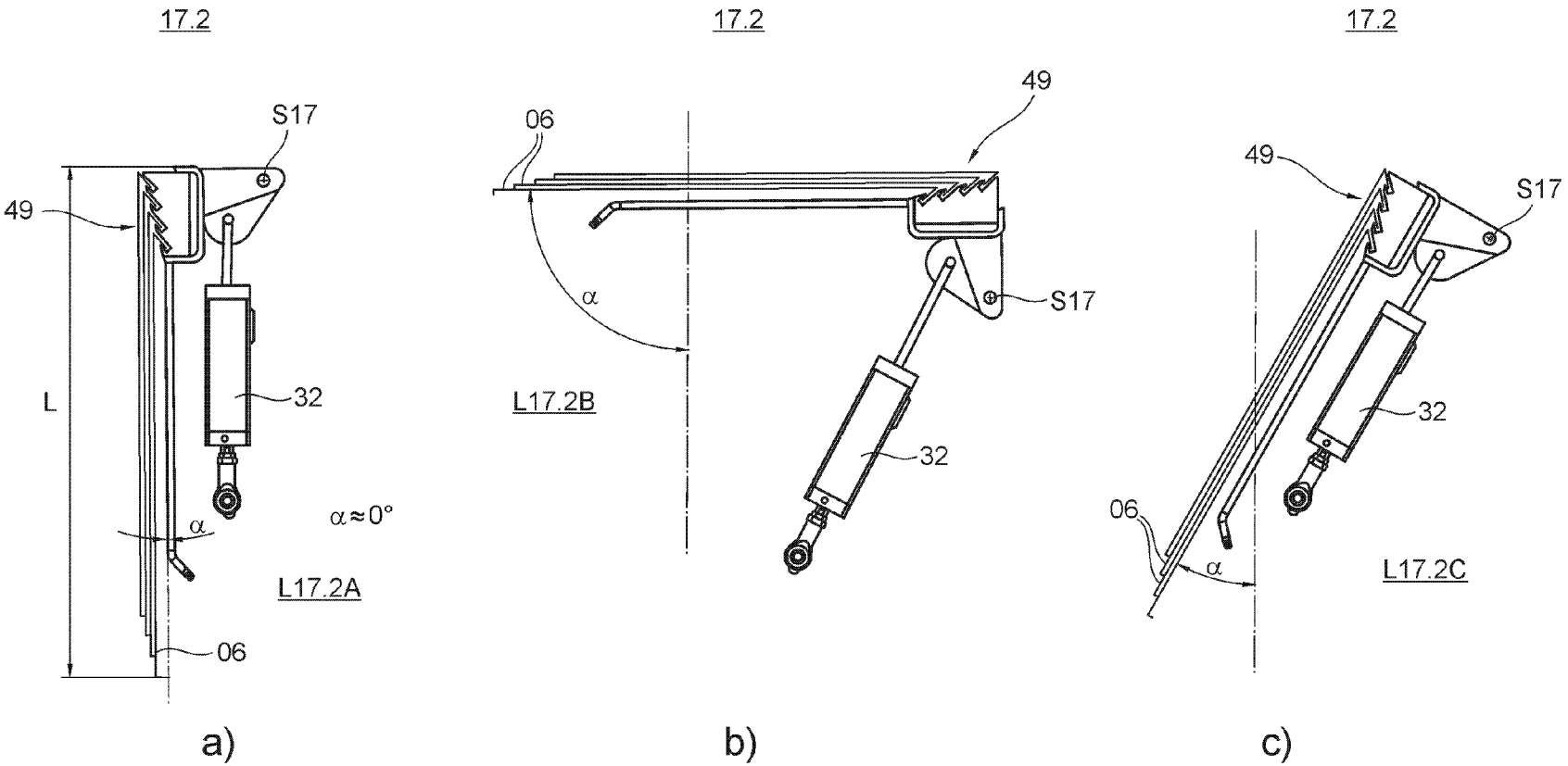
FIG. 8 a representation of the storage device a) in the transport state, b) in the working state and c) in an intermediate state.

Independently of its specific embodiment, storage device 17.1; 17.2, all the storage spaces of which are occupied one in front of the other and/or one above the other, has an outer contour and/or a casing end having a (effective) storage depth T extending perpendicular to the surface of printing forme 06 that bears the subject, said depth being significantly narrower than, e.g. a maximum of one-half, preferably a maximum of one-quarter the size of storage length L thereof in the longitudinal direction of the printing formes 06 held in reserve, wherein in this case, (effective) storage length L is understood as the extension, viewed in the longitudinal direction of printing formes 06, from the leading edge of an optionally foremost printing forme 06 to the rear edge of an optionally rearmost printing forme (see, e.g. FIG. 8*a*). If printing formes 06 are not stored offset from one another in the longitudinal direction, this corresponds to the printing forme length. An (effective) width b17 of the outer contour of storage device 17.1; 17.2, in which all the storage spaces are occupied by printing formes 06, in the same alignment corresponds to at least the width of n, e.g. n=4, but preferably fewer than n+1 printing pages of the nominal format. It has a plurality of storage spaces, e.g. at least l=2, preferably l=4 storage spaces, one above the other and/or one in front of the other, and a plurality of storage spaces, e.g. at least n=2, preferably n=4 storage spaces, side by side, for holding printing formes 06 to be newly applied.

If storage device 17.1; 17.2 as printing forme storage unit 17.1; 15.2 is not embodied in the form of a drawer or box, and is instead embodied, as shown in the example, in the form of a strip which holds printing formes 06 only in the region of one printing forme end, then it can additionally comprise support elements 24 or a corresponding configuration which acts as support elements 24, to support any printing forme 06 which is loaded on storage device 17.1; 17.2 against sagging and to avoid any torque that may result therefrom in a holding region. Storage device 17.1; 17.2 can also have a corresponding length and/or extension, as viewed in the longitudinal direction of the loaded printing formes 06, which then likewise acts as support element 24.

A lateral register device, not shown, can also be assigned to each forme cylinder 03 on the transport path of printing forme 06 from storage device 17.1; 17.2 to forme cylinder 03, for guiding and/or positioning printing forme 06 to be applied, e.g. by means of lateral stops. The stops in this case can be embodied as positionable and/or adjustable in the axial direction.

More detailed embodiment examples of the embodiment of vertically movable storage device 17.2, and the actuation and guidance thereof are provided below.

In a preferred embodiment, for each storage device 17.1; 17.2 and/or for each advanced position V1; V2 which is spaced vertically on the same operating side of printing tower 01, the printing forme changing system comprises at least one transfer unit 18.1; 18.2 for transporting printing forme 06 to be applied from a first position of transfer unit 18.1; 18.2, e.g. the receiving position, which is located distant from the forme cylinder or close to the printing forme storage unit, to a second position of transfer unit 18.1; 18.2, e.g. the transfer position, which is close to the forme cylinder. Said transfer unit is preferably embodied to receive simultaneously a plurality of printing formes 06 which are held in reserve side by side by storage device 17.1; 17.2, and to deliver these to the forme cylinder 03 in question or to a mounting device 19 optionally situated upstream. The at least one transfer unit 18 preferably is not a component of storage device 17.1; 15.2 or integrated therein. It is structurally separate from storage device 17.1; 15.2 and/or is provided as movable independently of storage device 17.1; 15.2 in and/or on printing tower 01, preferably in and/or on each of the two printing units 01.1; 01.2, although under certain circumstances it is capable of protruding at least partially through an optionally correspondingly configured storage device 17.1; 15.2 on its movement path.

In principle, the transfer unit which interacts with storage device 17.1; 17.2 can have any configuration. For example, in the case of a storage device 17.1; 17.2—e.g. in a bin-like, box-like or chute-like configuration—a transfer unit 18.1; 18.2 configured in the manner of a manipulator as described above can remove printing formes 06 to be applied from storage device 17.1; 17.2—e.g. in a bin-like, box-like or chute-like configuration—in the receiving position of said transfer unit and deliver them in the transfer position thereof to forme cylinder 03 or to a mounting device 19.

In an advantageous embodiment of transfer unit 18 shown here, said unit does not move freely in the manner of a transfer carriage in printing tower 01 or in the relevant printing unit 01.1; 01.2, and instead moves along a transport path 23; 23*a*; 23*b* provided and mechanically predefined in printing unit 01, e.g. formed by a guiding system 23, preferably fixed to the frame, and has one or more guide branches 23*a*; 23*b*, in particular a track system 23, preferably fixed to the frame, having one or more track branches 23*a*; 23*b*. Transport path 23; 23*a*; 23*b* is therefore preferably formed by a track system 23 which is arranged fixed to the frame in printing unit 01, on which system transfer unit 18 is moved in a guided fashion. Transport path 23; 23*a*; 23*b* extends between storage device 17.1; 15.2 and the transfer position close to the forme cylinder, within a plane which is perpendicular to the forme cylinder axis. A transport system assigned to printing unit 01 thus comprises one or more transfer units 18 and a guiding system 23 as additional system component 23—e.g. comprising guides that are fixed to the frame—which define the possible transport path or movement path of transfer unit(s) 18. Transfer unit(s) 18 and guiding system 23 can also be viewed together as a single system component, the "transport system" (18, 23).

In principle, a dedicated transfer unit 18 and a dedicated, separate transport path 23; 23*a*; 23*b* and optionally a dedicated printing forme storage unit 17.1; 15.2 having a dedicated advanced location V1; V2 can be assigned as system components 17; 18; 23; 23*a*; 23*b* of a printing forme changing system to each forme cylinder 03 and/or each printing couple 02 of printing tower 01. In one advantageous embodiment, however, in which a plurality of printing couples 02 are arranged one above the other on the same side of the web in a printing tower 01, for two printing couples 02 which are arranged adjacent to one another, one above the other, and particularly assigned to the same operating plane B1; B2, rather than providing printing forme changing systems that are completely separate from one another for each printing couple 02, a common transfer unit 18 assigned to two printing couples 02, e.g. a manipulator or particularly a transfer unit guided on a common guidance system 23, can access a printing forme storage unit 17.1; 15.2 assigned to two printing couples 02, particularly in the same operating plane B1, B2, and/or to printing unit 01.1; 01.2. In principle, two separate transport systems (18, 23), each comprising a transport path 23; 23*a*; 23*b* and a transfer unit 18, could also access a common printing forme storage unit 17.1; 15.2 for the two printing couples 02. In addition, two transfer units 18 can be provided on a connected transport path 23; 23*a*; 23*b*, and can access a common printing forme storage unit 17.1; 15.2 assigned to the two printing couples 02, or optionally two printing forme storage units, each assigned to one printing couple 02. In an embodiment which is advantageous in terms of cost and installation space requirements, however, a common, connected or connectable guidance system 23 and a common printing forme storage unit 17.1; 15.2 are assigned to the two adjacent printing couples 02, wherein in the common guidance system 23 one transfer unit 18 assigned to two adjacent printing couples 02, and in a time-saving alternative, two transfer units 18, access a common printing forme storage unit 17.1; 15.2.

If first a forme cylinder 03 of one and then a forme cylinder 03 of the other of the assigned printing couples 02 will be loaded with a new printing forme 06, it is not necessary for printing forme storage unit 17.1; 17.2, which is located in or has been moved to advanced position P17.1B, to be moved translationally, i.e. the relative height or the distance of said unit relative to printing couple 02 does not need to be adjusted, for example, and it can instead remain stationary or pivotable in printing unit 01, with a pivot axis that is fixed to the frame. In both cases, it is then in the same working state, for example (see below L17B). In the present example, transfer unit 18 is not assigned to storage device 17.1; 15.2—as may be the case, for example, with printing forme changing magazines—and is instead assigned to the respective printing unit 01.1; 01.2, in particular to the guiding system 23 assigned to printing unit 01.1; 01.2 and fixed to the frame thereof.

For each printing unit 01.1; 01.2, FIG. 1 shows a transfer unit 18 configured in a guided embodiment, in a transfer position for one of the two printing couples 02 arranged on the same web side of printing unit 01.1; 01.2.

In an embodiment considered alone, but particularly also in combination and coordination with embodiments for one or more of the stated system components 15; 17.1; 17.2; 18; 23, to save operators the cumbersome step of changing operating planes in order to dispose of used printing formes 06 as part of the regularly occurring handling of a printing forme change, or if applicable to avoid even having to provide a catwalk 38 for the second or upper machine plane B2 that can be traversed during operation, a conveyor or transport system 44 which is assigned to printing tower 01 and is particularly vertical is provided as system component 44, with which a storage unit 124.2 of a storage device 22.2 can be moved between a first position P124.2A, e.g. a removal position P124.2A, which is assigned as described above e.g. to a first operating plane B1, in particular main operating plane B1, and a second position P124.2B, e.g. a loading position P124.2B, which is spaced vertically from the first position, in the region of a vertically offset second return location R2. This second position P124.2B is not assigned to the former operating plane B1; B2 as described above in that it is not located within reach of said operating plane B1; B2—under normal circumstances, i.e. by an operator of average height and without supplemental means. The movement of storage unit 124.2 between the two positions P124.2A; P124.2B is preferably carried out predominantly (e.g. over >70% of the conveying distance) substantially (e.g. with a maximum deviation of ±5°) vertically and/or linearly at least over the majority (e.g. >70%) of the conveying distance. In principle, removal position P124.2A of storage unit 124.2, which can be moved to a vertically spaced loading position P124.2B, can be provided in base plane B1 or in a catwalk plane B2, wherein in the first case, used printing formes 06 are transported from a higher return location R2, for example a higher operating plane B2, to a removal location in the area of base plane B1, or in the second case, the used printing formes are transported from a lower return location R1, for example a lower machine plane B1; (B0), to a higher removal location, e.g. a catwalk plane B2.

Removal position P124.2A of storage unit 124.2 of the storage device 22.2 in question, which unit can be moved to a vertically spaced return position P124.2B, is preferably provided in the operating plane B1; B2 in which, for example, the removed printing formes 06 are transported—manually, with motorized support or fully automatically—from printing tower 01 to the operational area 141 relating to printing forme production 141 for disposal, for recycling or for reuse. This can be the machine plane B1; B2 in which printing formes 06 to be newly applied are also conveyed to printing tower 01, which can be regarded as main operating plane B1; B2. From operating plane B1; B2, which comprises removal position P124.2A of storage unit 124.2, which can be moved to a vertically spaced loading position P124.2B, the printing couples 02 of printing tower 01 which are assigned to this operating plane B1; B2, or the printing couples 02 of printing unit 01.1; 01.2 in question, can be reached, along with removal position P124.2A of storage unit 124.2 of storage device 22.2 in question, which unit can be moved vertically to the vertically offset return location R2. Base plane B1, from which lower printing couples 02 of printing tower 01 or printing couples 02 of lower printing unit 01.1 can be reached, preferably represents main operating plane B1, which has return location R1 assigned to the lower printing couples 02 on one side of the web and removal position P124.2A of storage unit 124.2, which can be moved vertically to a vertically offset return location R2.

The transport system which conveys vertically movable storage unit 124.2 between loading position P124.2B and removal location R1 or removal position P124.2A comprises a drive 68, 74, 86 for conveying storage unit 124.2 vertically and, e.g. a guide.

In principle, drive 68, 74, 86 can have any configuration. For instance, in a first embodiment, not shown—e.g., as in the preferred embodiment of the drive for a vertically movable storage device 17.2—driving can be carried out via a drive means which is fixed to the storage unit and is carried along by said storage unit 124.2, and which interacts in a frictional or positive connection via a corresponding gear mechanism with a spatially fixed gear part, by way of a gear part which is fixed to the storage unit.

In an advantageous embodiment, storage unit 124.2 is articulated or fastened to a traction means 68, e.g. a chain 75, in particular a roller chain, a belt 68, in particular a toothed belt, optionally a band or a cable. Traction means 68 may be finite and may be wound and unwound, for example, in the manner of a coil.

In a preferred embodiment, storage unit 124.2 is articulated or fastened on a continuous traction means 68 which preferably engages in a positive connection, e.g. a chain 68, in particular a roller chain, a belt 68, optionally a band or cable, which is or will be driven in a circulating manner via a drive gear 86 by way of a drive means 74, e.g. electric motor 74, which is stationary relative to side frame 04 or preferably relative to a frame 73 which is different therefrom. The loop of the circulating traction means 68 extends predominantly in the vertical direction. To ensure a defined movement, storage unit 124.2 is preferably articulated to a guide, e.g. a single-part or multi-part guide structure 92, which extends vertically over at least the majority of the conveying distance.

Alternatively, as a drive which is fixed to the frame or is spatially fixed, a hydraulically or pneumatically actuated push or pull rod could be provided, by which the vertically movable storage unit 124.2 can be moved back and forth on the at least predominantly vertically extending guide between return position P124.2B and removal position P17.2B.

Vertical conveyance is carried out in such a way, or the vertical conveying system 44 having the vertically movable storage unit 124.2 is configured and arranged in such a way that the used printing formes 06 to be conveyed are located within the printing couple alignment in the manner described above at least in receiving position P124.2B of storage unit 124.2 and preferably over the entire conveying distance, and advantageously also at removal position P124.2A of storage unit 124.2.

Removal position P124.2A of vertically movable storage unit 124.2, which is assigned to at least one printing tower 01, and preferably also at least a portion of the conveying distance situated upstream of removal position P124.2A, more particularly the entire conveying distance from receiving position P124.2B to removal position P124.2A, is or are disposed distant from the printing tower, i.e. on a side of an operating space 118 assigned to this printing tower 01 in operating plane B1 which is distant from the printing tower. In other words, the storage unit 124.2 located in removal position P124.2A and optionally the stated (partial) conveying distance are located in a vertical alignment which is spaced from the assigned printing tower 01 by at least operating space 118. A guide of conveying system 44 is preferably disposed on or attached to a frame 73 which is different from a side frame 04 of a printing tower 01 or a printing unit 01.1; 01.2.

In principle, the vertically movable or transportable storage devices 22.2; 22.1, and preferably also the spatially fixed storage units 124.1; 124.2 thereof which are assigned to the same side of printing tower 01, can have any configuration that will enable them to hold a plurality of printing formes 06, in particular a number m that corresponds to the nominal width $W_N$, side by side in or on the same frame or frame rack, and to hold a plurality of printing formes 06, in particular up to four printing formes 06, one above the other or one in front of the other in a radial direction relative to the forme cylinder axis.

In principle, said storage devices can be box-like or frame-like storage devices 22.1; 22.2 having individual compartments for printing formes 06, however they are preferably bin-like return storage units 124.1, 124.2, in which printing formes 06, which have been removed in the same alignment radially in relation to forme cylinder 03, adjoin one another without a partition or intermediate frame, e.g. "front to back".

Printing formes 06 are loaded, for example, by transfer unit 18 alone and/or with the assistance of a supplemental device functionally arranged between transfer unit 18 and storage unit 124.1, 124.2, e.g. an optionally movable delivery table [[ . . . ]], and/or are loaded with the removed printing formes 06 with assistance provided by pivoting storage device 22.1, 22.2 or a part thereof. In a simple and/or compact embodiment, the configuration and arrangement of storage device 22.1; 22.2 can be embodied, for example by the arrangement thereof directly on printing tower 01 and/or with a correspondingly sized conveying range, such that the removed printing formes 06 can be inserted directly into storage device 22.1; 22.2 or into a movable part thereof. In a configuration and arrangement that increases accessibility, storage device 22.1; 22.2 for receiving used printing formes 06 is embodied as spatially separate from storage device 17.1; 15.2 for receiving and holding in reserve printing formes 06 to be newly applied, wherein, e.g., a movement of storage unit 124.1; 124.2 or a part of storage unit 124.1; 124.2 and/or a supplemental means 104, e.g. a holding means 105 that overcomes the distance between transfer system 18 and storage unit 124.1; 124.2, helps to bridge the distance between a transfer unit 18 which is assigned to at least one printing couple 02 and storage unit 124.2.

Independently of the specific embodiment thereof, storage unit 124.1; 124.2 can be loaded with n, e.g. n=4, printing formes 06 side by side and with a plurality of, in particular up to at least 4 printing formes 06, one in front of the other.

More detailed exemplary embodiments for the configuration of storage device 22.2 having a vertically movable return storage unit 124.2, the drive thereof and the guidance thereof will be described below.

In an advantageous further enhancement, the printing forme changing system comprises as additional system component(s) 19; 21; 22.1; 22.2 a mounting device 19 which guides printing forme 06 to be applied, e.g. after it has been delivered by transfer unit 18, and/or a contact pressure device 21 which supports suspension and/or winding, and/or in a preferred embodiment, a storage device 22.1; 22.2 that receives removed printing formes 06 and/or a conveying system 44 that conveys a storage device 22.1; 22.2 which is vertically movable between two machine planes B1; B2 between a receiving position P124.2A and a removal position P124.2B, as a further system component 20.

Although the stated system components 15; 17.1; 17.2; 18; 19; 20; 21; 22.2; 23, which will be specified in greater detail in the following in the context of embodiment examples, represent advantageous and independently applicable individual solutions in and of themselves and should be viewed as such, they offer particular advantages in specific combinations of two or more of these system components 15; 17.1; 17.2; 18; 19; 20; 21; 22.2; 23 by virtue of their coordinated interaction. Finally, one or more of these system components 15; 17.1; 17.2; 18; 19; 20; 21; 22.2; 23 in a printing forme logistics system as a whole offer particular advantages that involve not only the handling associated with the printing unit 01 (storage, transport, plating up/plate removal), but also the handling involved in printing forme production and/or transport, e.g. automatic printing forme delivery to the printing tower or printing towers 01, within the printing machine, in particular within a print shop.

FIG. 1 shows a schematic side elevation of printing unit 01 having system components 17.1; 17.2; 18; 19; 22.1; 22.2; 23 of the printing forme changing system, together with the storage device 22.1; 22.2 for old plates, which is provided and/or included in the preferred embodiment, and if applicable having an optionally provided contact pressure device 21.

Figure 3:
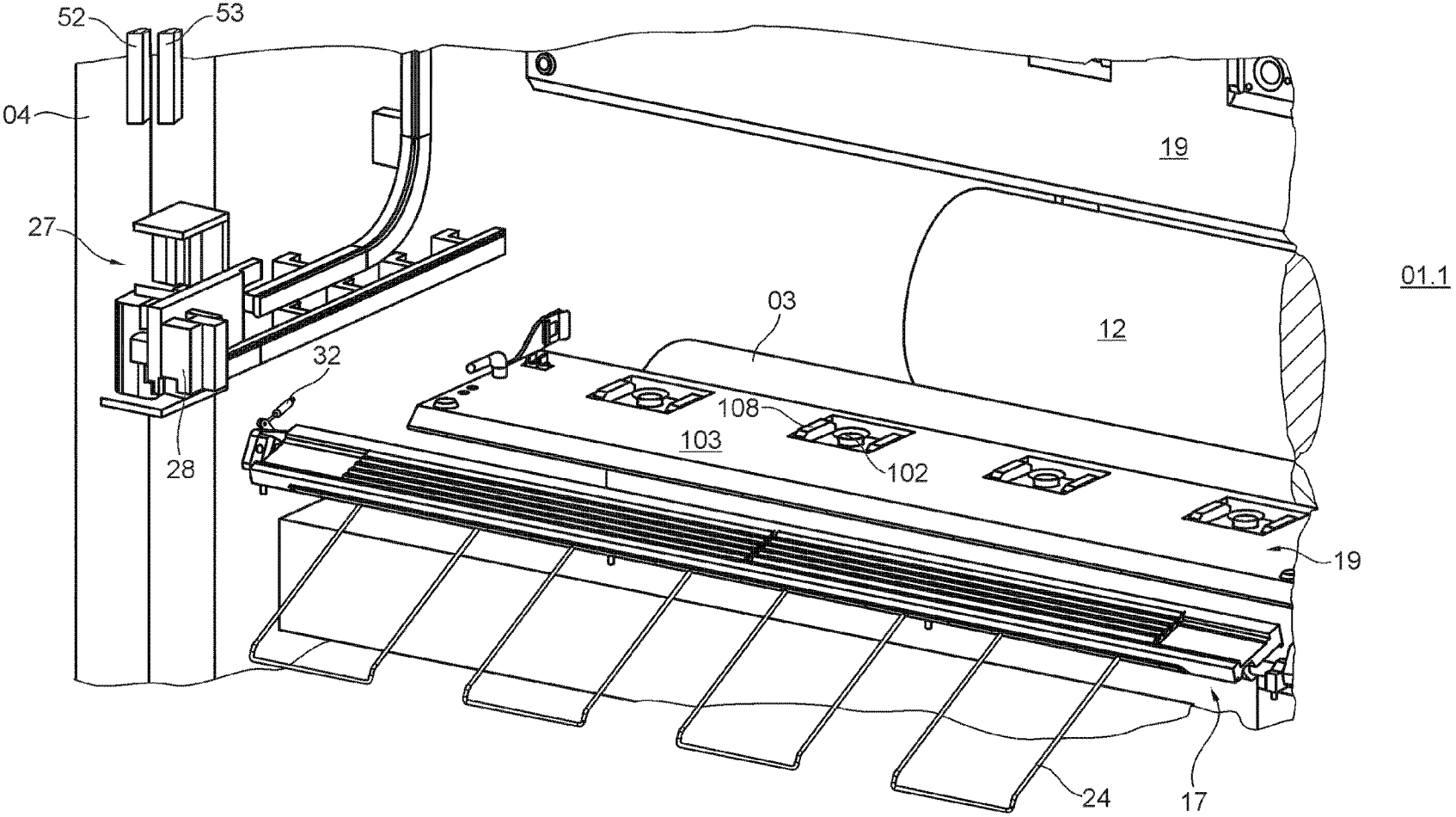
FIG. 3 a perspective view into a printing couple of a lower printing unit, by way of example.

FIG. 3 shows, by way of example, the transport system assigned to the lower printing couples 02, with transfer unit 18 being located, for example, in a position which is not visible, close to upper forme cylinder 03, so that printing forme storage unit 17.1 is not hidden. The transport system assigned to the upper printing couples 02 has the same configuration.

Figure 4:
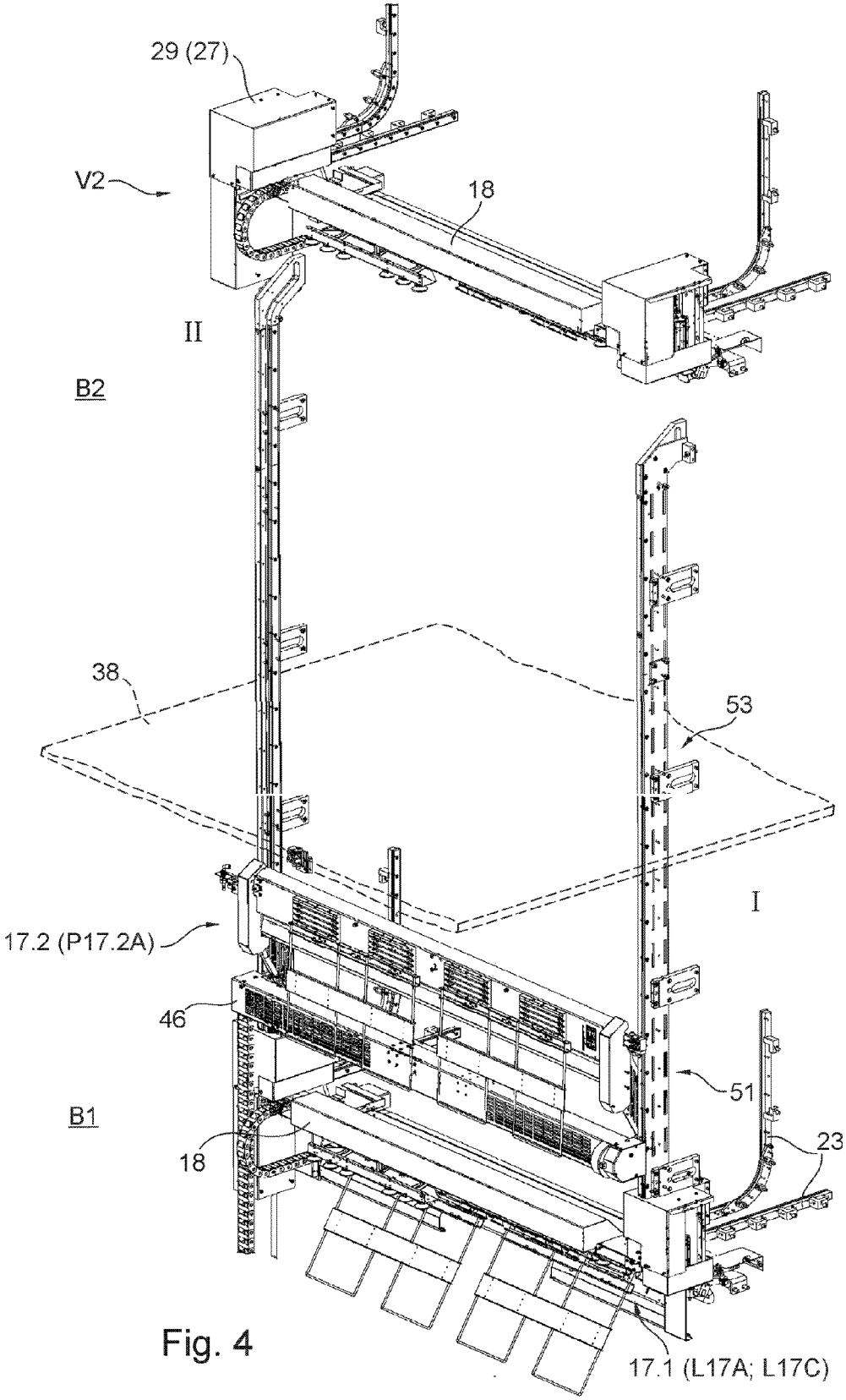
FIG. 4 a perspective representation of a vertically movable storage device for new printing formes, here in the loading position, with a vertical conveying system.

FIG. 4 shows the transport system assigned to the upper printing couples, along with the vertical transport system, leaving out the side frames, but indicating the printing couple cylinders for purposes of orientation.

A connecting element 27 that links the two guide branches 23*a*; 23*b*, in particular transport path branches 23*a*; 23*b*, to forme cylinder 03 of the lower and the upper printing couple 02, e.g. a switch 27 assigned to the transport system or guidance system 23 and connecting the guide branches 23*a*; 23*b* (see FIG. 3), and an optionally provided positioning device 28, e.g. a device for variable travel limitation 28, for example a stop device 28 and/or sensor arrangement 28 to be assigned to the transport system or guidance system 23, is hidden in FIG. 4, for example, under a protective cover 29, e.g. within a housing 29. An end face of printing unit 01, which in FIG. 4 lies closer in the foreground, is denoted as side I and the more distant end face is denoted as side II.

The parts that are embodied or can be embodied in the same manner for upper machine plane B2 and lower machine plane B1 are hereinafter denoted by the same reference signs. Conversely, however, comparable parts or assemblies that have been denoted by different reference signs need not necessarily be different in embodiment.

Vertical conveying system 43 is embodied for conveying vertically movable storage device 17.2, which is at least partially loaded with printing formes 06, in the manner described above between two machine planes B1; B2. Conveying system 43 is preferably embodied such that storage device 17.2 is conveyed over at least a portion of conveying distance in a first vertical state L17A, in which the longitudinal extension of transported printing formes 06 and/or the (effective) storage length L of loaded vertically movable storage device 17.2 extends predominantly vertically, i.e. forming an angle $\alpha$ with vertical, e.g. with $\alpha<45°$, preferably a 30°. The concept of the first "vertical state" L17A, of storage device 17.2—in case it is not explicitly emphasized in a literal sense—is understood as all states as described above in which printing formes 06 or storage length L extend predominantly vertically, i.e. with a greater component than the horizontal component.

Conveying system 43 is preferably embodied such that, at least over a distance not equal to zero in the area of loading position P17.2A and/or at least over a distance not equal to zero in the area of a passage through an intermediate platform 38; 39 that separates the two machine planes B1; B2 which are connected via conveying system 43, storage device 17.2 is conveyed to a position which is vertical as described above.

Conveying system 43 is preferably embodied such that vertically movable storage device 17.2 is in a vertical state L17A in loading position P17.2A, and is also conveyed over the conveying distance from loading position P17.2A at least up to a position downstream of the passage as described above in vertical state L17A. In a particularly space-saving embodiment, storage device 17.2 is in a substantially vertical state (e.g. with a maximum deviation of ±5° from vertical) in its loading position P17.2A and/or is conveyed over the conveying distance from loading position P17.2A at least up to a position downstream of the passage in a substantially vertical position (e.g. with a maximum deviation of ±5° from vertical). In this state L17A, facilitated loading is possible, and less installation space is required.

For the passage, an opening 48 in intermediate platform 38; 39 is provided, for example, which in an advantageous enhancement is alternatively embodied as closeable and openable, in that, for example, a hatch 56 can be opened and closed again, e.g. by means of a drive 57, for example by means of a cylinder that can be pressurized by compressed medium.

In an embodiment already mentioned above and described here, drive means 47, embodied as motor 47, will be or is carried along on or in carriage 46 or carriage part 46, and cooperates via a gear part 54 fixed to the carriage, e.g. a drive gear 54 or worm gear, in a frictional or positive manner, with a gear part 52 of a feeding mechanism, e.g. a friction gear, toothed gear or worm gear mechanism, said gear part being stationary relative to side frame 04 of printing tower 01 or printing units 01.1; 01.2. In a preferred embodiment, drive gear 54 driven by motor 47 is embodied as gear wheel 54 and bearing surface 52 which is fixed to the frame is embodied as a row of teeth 52 of an integral or multipart toothed rack 58, optionally reinforced by a supporting member. Toothed rack 58, which is optionally reinforced by an underpinned supporting member, formes, e.g. a vertically extending carrier 58, also called a drive carrier 58. In an advantageous embodiment, a braking device 88—particularly embodied as self-locking—which is optionally releasable for transport movement, but which, in a stationary position, particularly in the advanced position of transport and storage unit 51, is activated, particularly self-locking, engages in the row of teeth 52 or on the drive train from motor 47 to gear wheel 54. The supply of power and/or the conducting of control and/or measurement signals is housed, e.g. in a so-called energy chain 88.

In one advantageous embodiment, in addition to the spatially fixed gear part 52, a guide that forces carriage 46 along a movement path is provided, wherein the spatially fixed part thereof or the part thereof that is fixed to the frame can be formed by one or more guide surfaces of drive carrier 58 and/or an additional integral or multipart guide structure 53 which is fixed to the frame—e.g. extending predominantly vertically—e.g. of an integral or multipart guide carrier 53. The at least one spatially fixed guide surface interacts with at least one stop element 59; 66 which is connected in a spatially fixed manner to carriage 46 and/or storage device 17.2 and is moved along therewith. In the present embodiment, carriage 46 is guided e.g. by stop elements 59 which are fixed to the carriage and are embodied as rollers 59, and which interact with two guide surfaces—provided particularly as sides of guide carrier 53 that point in opposite directions—and hold the guide carrier 53 between them. As shown in the figures, a plurality of vertically spaced rollers 59 can be provided for each side. While the at least one drive gear 54 which is fixed to the carriage and is driven by drive motor 47 induces advancement by engagement in the row of teeth 52, carriage 46 is forced by the guide along the movement path and is secured to prevent inadvertent tilting of carriage 46.

Storage device 17.2 can then be moved to at least a second, e.g. horizontal state L17.2B, which is different from first vertical state L17A, e.g. also called loading state L17A. In this second state 17B, printing forme storage unit 17.1; 15.2 is in a working or unloading state L17B. In this state L17B, at least one of printing formes 06 stored on printing forme storage unit 17.1; 15.2 is located in the functional area of transfer unit 18. In horizontal state L17B, the longitudinal extension of the transported printing formes 06 and/or the storage length L of the loaded vertically movable storage device 17.2 extend predominantly vertically, i.e. forming e.g. an angle $\alpha$ with vertical of $\alpha>45°$, preferably of $\alpha$ 60°. The term the second "horizontal state" L17B, of storage device 17.2—in case it is not explicitly emphasized in a literal sense—is understood to mean all states as described above in which printing formes 06 and/or the storage length L extend predominantly horizontally, i.e. with a component that is greater than the horizontal component.

Conveying system 43 is preferably embodied such that storage device 17.2 can be or is moved at least at the height of advanced position P17.2B to a second state L17B, which is horizontal as described above, i.e. at the end of its conveying path can be moved into this state L17B by a further movement, or correspondingly occupies this second state L17B, which is horizontal in the manner described above, at the end of its conveying path. Conveying system 43 is preferably embodied such that the vertically movable storage device 17.2 can be or is moved to the horizontal second state L17B only on an advanced side part of the conveying path downstream of the passage through intermediate platform 38; 39, in particular only in the region or even at the site of advanced position P17.2B, in the manner described above. In a particularly space-saving embodiment, storage device 17.2 can be or is moved to the vertical second state L17B only at its advanced position P17.2B. Preferably, storage device 17.2 can be or is moved to its second state L17B in a substantially horizontal state (e.g. with a maximum deviation from horizontal of ±5°).

In a first embodiment, not shown, storage device 17.2 and/or carriage 46 are guided, for example, by a correspondingly extending guide structure in the end region of the guide that is close to the advanced area, such that storage device 17.2 can be or is moved from transport state L17A, which is defined by vertical states L17A, for example, to working or unloading state L17B by movement along the guide—e.g. formed in the end region with at least one guide section 53.2 that is at least segmentally curved or curving. Storage device 17.2 or storage component 17.2 of a transport and storage unit 51, which comprises storage device 17.2 and carriage 46, is or will be translationally moved thereby along a guide path, and is or can be moved, e.g. solely by the translational movement of storage component 17.2, along the path defined by the guide from the first state to the second state L17A; L17B. The guide structure 53 for this purpose comprises —for example in a continuation of a guide section 53.1 having a linear guide path—a guide section 53.2 having a curved and/or curving guide path which causes a tilting of storage device 17.2 or storage component 17.2 from the first state to, for example, the second state L17A; L17B.

This first embodiment can be implemented in a first variant in that carriage 46 and storage device 17.2 form a rigid unit 51, e.g. transport and storage unit 51, which can optionally be detached from one another when not in operation, wherein the carriage part 46 that formes carriage 46 and the storage component 17.2 that formes storage unit 17.2 execute a curved movement on an advanced-side end section along a guide section 53.2 that comprises a curved guide path. In an alternative thereto, storage component 17.2 is arranged on unit 51 spaced a distance from drive gear 54 of carriage part 46, for example via frame parts or frame rack parts 67 of a frame that supports storage component 17.2 and carriage part 46, such that carriage part 46 describes only a vertical linear movement up to the end of the conveying path, whereas the leading storage component 17.2 in terms of the direction of conveyance follows with a dedicated stop element 66 (e.g. roller 66), which is fixed to the storage component, of a guide section 53.2 which continues a linear guide section 53.1, for example, and comprises a curved guide path, wherein said storage component thereby can be or is moved to the second state L17B. This is intended to allow the elimination of the aforementioned protection against tilting by doubling the first rollers 59.

A second variant of the first embodiment can be implemented in that carriage 46 and storage device 17.2 are not operationally rigidly connected to one another, and instead, the leading storage device 17.2 in the direction of conveyance toward advanced position P17.2B can be pivoted in relation to carriage 46 around a pivot axis S46 that extends parallel to the forme cylinder axis (of a printing couple 02 to be supplied by storage device 17.2) and is e.g. fixed to the carriage—e.g. via frame parts or frame rack parts 67 embodied as lever arms 67. Storage device 17.2 or storage component 17.2, with a dedicated stop element 66 that is fixed to the storage component, follows a guide section 53.2 having a curved section and thereby can be or is moved to the second state L17B. Carriage 46 or carriage part 46 can then describe only a vertical linear movement up to the end of its conveying path, whereby the toothed rack or a drive of another embodiment, as mentioned above (e.g. a traction loop) can be embodied as rectilinear over the entire transport length.

In a second embodiment, shown here in the figures, conveying system 43 can be embodied to move storage device 17.2 from the first, vertical state L17A to the second, horizontal state L17B via two movements having degrees of freedom of movement that are different from one another, in particular are fundamentally independent of one another. For example, an aforementioned guide structure 53 is provided, along which storage element 17.2 can be or is moved in a translational manner, along with a pivot axis S17 that is parallel to the relevant forme cylinder axis.

In a first variant of the second embodiment, the guide structure 53 for the translational movement of storage element 17.2 can be configured over the entire path length up to advanced position P17.2B for guidance along a linear guide path, which again offers the aforementioned advantages with respect to the rectilinear drive. The change in state from the first, e.g. vertical transport state L17A to the second, horizontal state L17B is carried out when storage device 17.2 occupies or has reached its advanced position P17.2B with respect to its pivot axis S17. Pivoting around pivot axis S17 is carried out in this case by a drive means 32, preferably a pneumatic or hydraulic cylinder 32 or optionally an electric motor 32, which in this variant is fixed to the carriage, i.e. is articulated or arranged in a stationary manner with respect to carriage part 46, and which engages on the output side directly or preferably indirectly via a lever 31 on storage component 17.2, which lever is likewise articulated fixed to the carriage. For at least second state L17B, a defined state of storage device 17.1; 15.2 can preferably be produced by a corresponding positioning device. In the figures, drive means 32 is embodied as a pneumatic or hydraulic cylinder 32, which for the vertically movable storage device 17.2 in this variant is articulated on carriage part 46.

In a second variant of the second embodiment, shown here, guide structure 53 for the translational movement of storage element 17.2, as already in a variant of the first embodiment, can comprise a guide section 53.2—for example in a continuation of a guide section 53.1 with a linear guide path—having a curved guide profile which causes storage device 17.2 or storage component 17.2 to tilt from the first state to a third state L17C, which lies between the first and second states L17A; L17B. In this third state L17C, e.g. also referred to as intermediate state L17C, the longitudinal extension of the transported printing formes 06 and/or the storage length L of the loaded vertically movable storage device 17.2—while maintaining the above conditions in terms of its position in relation to the other two states L17A; L17B—formes e.g. an angle $\alpha$ with vertical of $60° > \alpha > 15°$, in particular of $45° > \alpha > 20°$ (see, e.g. FIG. 8*b*). The change in state from intermediate state L17C to working or horizontal state L17B is carried out when storage device 17.2 has occupied or reached its advanced position P17.2B with respect to its pivot axis S17. Pivoting around pivot axis S17 from intermediate state L17C to working state L17B is once again implemented by an aforementioned drive means 32.

Movement from first state L17A to intermediate state L17C can be implemented according to the movement from the first to the second state L17B in the first embodiment, according to the first and second alternatives of the first variant or the second variant, described therein, or vice versa, wherein the corresponding part of the description relating to the translational movement and the components described therein can be applied directly, replacing "second state L17B" with "third state L170". In the embodiment that corresponds to the first alternative of the first variant of the first embodiment with respect to the translational movement portion (in general with a change in direction of translationally guided transport and storage unit 60), drive means 32 for pivoting storage component 17.2 from intermediate state L170 to working state L17B around pivot axis S17 is articulated in a manner fixed to the carriage and engages on the output side on storage component 17.2, directly or preferably indirectly via a lever 31, which is likewise articulated in a manner fixed to the carriage. The same applies to the embodiment that corresponds with respect to the translational movement portion to the second alternative of the first variant of the first embodiment (in general tilted transport and storage unit 51 with stop element 66 spaced from drive gear 54).

In the embodiment that corresponds with respect to the translational movement portion to the second variant of the first embodiment and is shown in the figures, drive means 32 for pivoting storage component 17.2 around pivot axis S17 from intermediate state L170 to working state L17B is articulated in a manner fixed to the lever and engages at the output side on storage component 17.2, directly or preferably indirectly via a lever 31, which is likewise articulated in a manner fixed to the carriage.

For storage device 17.1, e.g. disposed operationally stationary in the access region of operating plane B1; B2 (B0), in particular main operating plane B1, the above-stated with respect to pivoting about a pivot axis S17 which extends parallel to the forme cylinder axis of a printing couple 02 to be supplied by storage device 17.2 can be transferred and/or applied, however in this case, pivot axis S17 is arranged e.g. operationally fixed to the frame, and the relevant drive means 32, which engages on storage device 17.1 indirectly via lever 31 or directly, is e.g. articulated or arranged fixed to the frame. Furthermore, in this case, in addition to the horizontal and/or working state L17B, e.g. only one state L17A; L170 which extends closer to vertical relative to this state L17B is necessary, in which the storage element is or can be loaded. In this state L17A; L170, the longitudinal extension of the transported printing formes 06 and/or the storage length L of the loaded vertically movable storage device 17.1 formes an angle $\alpha$ with vertical, e.g. of $\alpha < 60°$, preferably of $\alpha \leq 30°$, or extends substantially vertically (e.g. with a maximum deviation from vertical of $\pm 5°$). The operationally stationary storage device 17.1 can be loaded in the operating plane B1; B2 (B0) in question with printing formes 06 to be applied for the printing couple 02 operationally assigned to said machine plane or for the printing couples 02 operationally assigned to said machine plane, and then moved to the working state L17B, in which one or particularly a plurality of printing formes 06 can be removed simultaneously by transfer unit 18, embodied in one of the aforementioned configurations, and fed to the forme cylinder 03 in question or to a mounting device 19 situated upstream thereof on the transport path. The cycle outlined below for the application of new printing formes 06 after pivoting of the storage device to the working state L17B corresponds, e.g. to that of spatially fixed storage device 17.1.

FIG. 3 shows, by way of example, a view from the operating side of the stacked printing units of printing tower 01, i.e. from the longitudinal side of printing couple 02, from which operators can access printing couple 02 for maintenance purposes, in reference to lower printing unit 01.1 with the preferred embodiment of the configuration of the storage device 17; 17.2; 17.2 and/or the configuration of the transport system comprising transfer unit 18.

Storage device 17.1; 17.2, which is embodied, e.g. as a printing forme storage unit 17.1; 17.2, extends, as viewed in the axial direction of printing couple cylinder 03; 12, over at least the nominal width $W_N$ thereof, or the nominal width $W_N$ of printing unit 01, and is mounted at both ends on side frame 04 in the case of an operationally stationary storage device 17.1, and is mounted indirectly or directly fixed to the carriage as described above in the case of a vertically movable storage device 17.2. At least the vertically movable and preferably also the stationary storage device 17.1; 17.2 is pivotable around a pivot axis S17, which preferably extends parallel to the axial direction of a forme cylinder 03 assigned to the storage device.

Storage device 17.1; 17.2, in particular a carrier 36 for storage device 17.1; 17.2, or a carrier element 37 which optionally can be or is used in storage device 17.1; 17.2 and/or a carrier element 37 which is provided as transport element 37 has, on the surface of one of its longitudinal sides 49, a structure 34 having a plurality (e.g. a number j) of retaining elements 33 or groups of retaining elements 33 spaced from one another in the transverse direction $r_q$ of said longitudinal side 49, into which the bent leading ends 09 of a plurality of printing formes 06 can be hooked, one in front of the other, or spaced from one another in transverse direction $r_q$ of said longitudinal side 49. By means of the retaining elements 33 arranged one in front of the other or spaced from one another in transverse direction $r_q$ of this longitudinal side 49, a plurality of printing formes 06 can therefore be stored one in front of the other, i.e. intersecting the same plane which extends parallel to its longitudinal direction and stands perpendicular on the printing forme surface. In the loaded state, retaining elements 33 engage behind the ends 09 of printing formes 06, which are bent, e.g. at an acute interior angle of <90°, wherein retaining elements 33 prevent any relative movement of printing forme 06 in the direction of trailing end 11, and the bent ends 09 of a plurality of printing formes 06 can be hooked, spaced from one another in the longitudinal direction of the printing formes 06 or offset slightly from one another in the manner of scales, e.g. between two storage spaces, for example by 1 to 15 mm, in particular 1 to 8 mm in each case, on different retaining elements 33 that are spaced from one another (see, e.g. FIG. 8). Rather than storing printing formes 06 in a space-consuming chute arrangement, in this case printing forme ends 09; 11 of a plurality of printing formes 06 can be hooked into retaining elements 33 which are arranged one in front of the other, particularly rigidly, on the same side or surface of the same component, e.g. directly on one side and surface of a carrier 36 to be assigned to storage device 17.1; 15.2. In a preferred embodiment, therefore, a plurality of, e.g. all the printing formes 06 to be stored in storage device 17.1; 15.2 in the same alignment that extends radially in relation to forme cylinder 03 or to be received one in front of the other on carrier element 37 are not, e.g. held in reserve in respectively dedicated chutes or guides, and are instead placed one on top of the other, with the ends 09 thereof being held offset from one another by retaining elements 33 that are spaced from one another.

Storage device 17.1; 15.2, over a length that corresponds to at least nominal width $W_N$, preferably has a structure 34 of this type with a number j of carriers 33 or groups of carriers 33 spaced from one another in transverse direction $r_q$. In other words, in longitudinal direction $r_1$ of storage device 17.1; 15.2, a number m of printing formes 06 that corresponds to nominal width $W_N$ can be received and/or held in reserve side by side in the axial direction, and in transverse direction $r_q$ of storage device 17.1; 15.2, a number of printing formes 06 that corresponds to the number j of carriers 33 or groups of carriers 33 can be received and/or held in reserve one in front of the other. Of course, it is not always necessary for all printing forme storage spaces to be occupied at all times.

In the depicted example of double-width and double-circumference forme cylinder 03, the structure formed with carriers 33 is embodied such that storage device 17.1; 15.2 can carry and hold in reserve up to n=m=4 individual printing formes 06 side by side in longitudinal direction $r_l$ and at least j=l=2 individual printing formes one in front of the other as viewed in transverse direction $r_q$, and in the case of the allocation of storage device 17.1; 15.2 to two double-circumference printing couples 02, as described here, a number of j=21=4 individual printing formes 06. The capacity of storage device 17.1; 15.2 can logically be applied to other variants of forme cylinder dimensions in terms of the number k or l of printing pages or printing formes 06 that can be arranged in the circumferential direction and the number n or m of printing pages or printing formes 06 that can be arranged in the longitudinal direction, factoring in the number of printing couples 02 that will be used.

In one advantageous enhancement, carrier element 37 or a plurality of carrier elements 37 are or can be arranged on carrier 36 in an operationally detachable manner, e.g. as insert 37 or inserts 37. The longitudinal side 49 of storage device 17.1; 15.2 which has retaining elements 33 is then formed by the longitudinal side having the retaining elements 33 of one or more carrier elements 37 inserted into storage device 17.1; 15.2. For the operationally detachable arrangement of one or more carrier elements 37, a mechanism not specified in greater detail here is provided, which releases carrier element 37 for removal by the operators, by a manipulator, or by a drive when prompted by a controller which automates the process, so that said carrier element can be removed from the carrier 36.

A mechanism of this type for connecting or locking between carrier element 37 and carrier 36, which is embodied as operationally detachable—i.e. not merely for assembly and/or maintenance purposes—enables operators, a manipulator and/or a logistics system, which will be specified in greater detail below, to remove carrier element 37 from storage device 17.1; 17.2 or from printing unit 01 and if applicable to load it at a distance from the printing unit. For the vertically movable storage device 17.2, this means, for example, that carrier 36 of storage component 17.2 is loaded in its loading state P17.2 with a carrier element 37 which is loaded with new plates, once, for example, the empty carrier element 37 from the previous plate change has been removed.

Storage device 17.1; 17.2 preferably has, for each storage space, a device for supporting the laterally correct positioning of printing formes 06 on printing forme storage unit 17, also called a lateral register device 42.

In structure 34, retaining mechanisms—passive or active—may also be provided in the characterization or embodiment of retaining elements 33, which mechanisms interact in a positive or frictional manner with the suspended printing forme 06 in such a way that the latter is prevented or at least inhibited from becoming unintentionally unhooked.

The vertical conveying system 43 described above, with its advantageous embodiments, considered alone or in combination with a storage unit of any embodiment, substantiates advantageous solutions, however additional advantages also result in combination with the described embodiment of storage device 17.1; 17.2 and optionally of a carrier element 37 and/or the embodiment of transport system 18, 23, as will be roughly outlined in the following. Individual features or combinations of features of the embodiment described in the following for the transport system 18, 23—where reasonable or not contradictory—may be applied to the configuration variants specified above in the description of the system as a whole for the embodiment of printing tower 01 and the provision of printing tower 01 with system components 15; 17; 18; 19; 20; 21; 22; 23.

As has already been discussed, transfer unit 18 together with guiding system 23; 23*a*; 23*b* effects the transport of printing forme 06, to be newly applied, from a receiving position distant from the forme cylinder or close to the printing forme storage unit to a transfer position close to the forme cylinder. For this purpose, transfer unit 18, in the first position, receives printing forme 06 to be applied from a printing forme storage device 17.1; 17.2 which carries printing forme 06, and which can have any configuration, in principle. For example, it may be embodied as a multilevel storage or frame system, in which in working state L17B, a plurality of printing formes 06 are held in reserve in chutes or guides arranged one above the other. Regardless of the specific embodiment, transfer unit 18 is intended to be able to access printing forme 06, which is still in or on printing forme storage unit 17.1; 15.2 in working state L17B, and therefore it is not necessary to provide a dedicated advancement mechanism for printing formes 06. In a preferred embodiment, therefore, a printing forme storage unit 17.1; 15.2 is used, which is configured according to one of the embodiments of the above-described storage device 17.1; 15.2. In this embodiment, transfer unit 18 has unfettered access to the surface of printing forme 06 to be applied, which is still located in the storage position, and a plurality of printing formes 06 to be applied sequentially is held in reserve in the smallest space.

Figure 5:
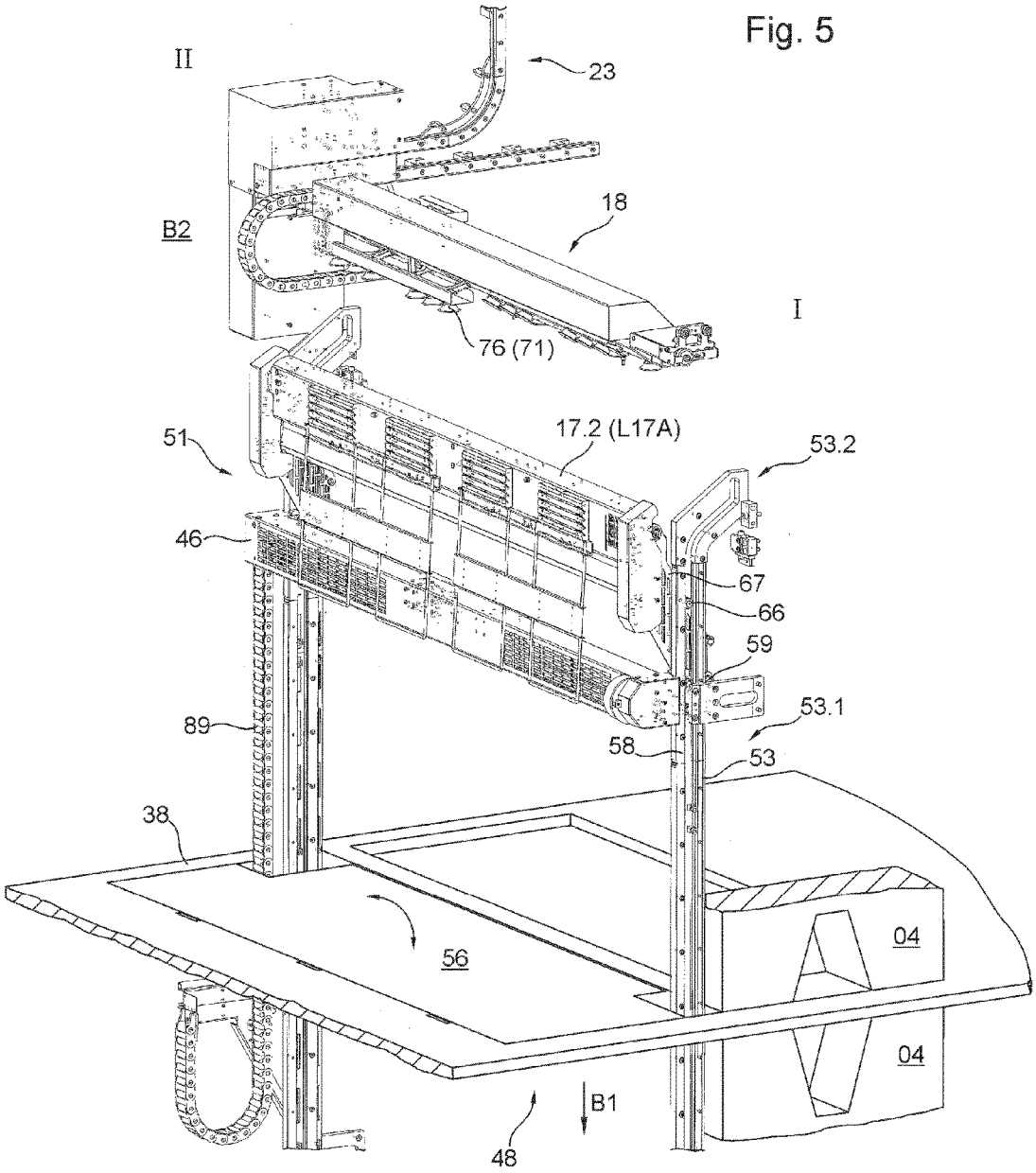
FIG. 5 a perspective representation of the vertically movable storage device, here in the area of the second operating plane and in the transport state.
Figure 6:
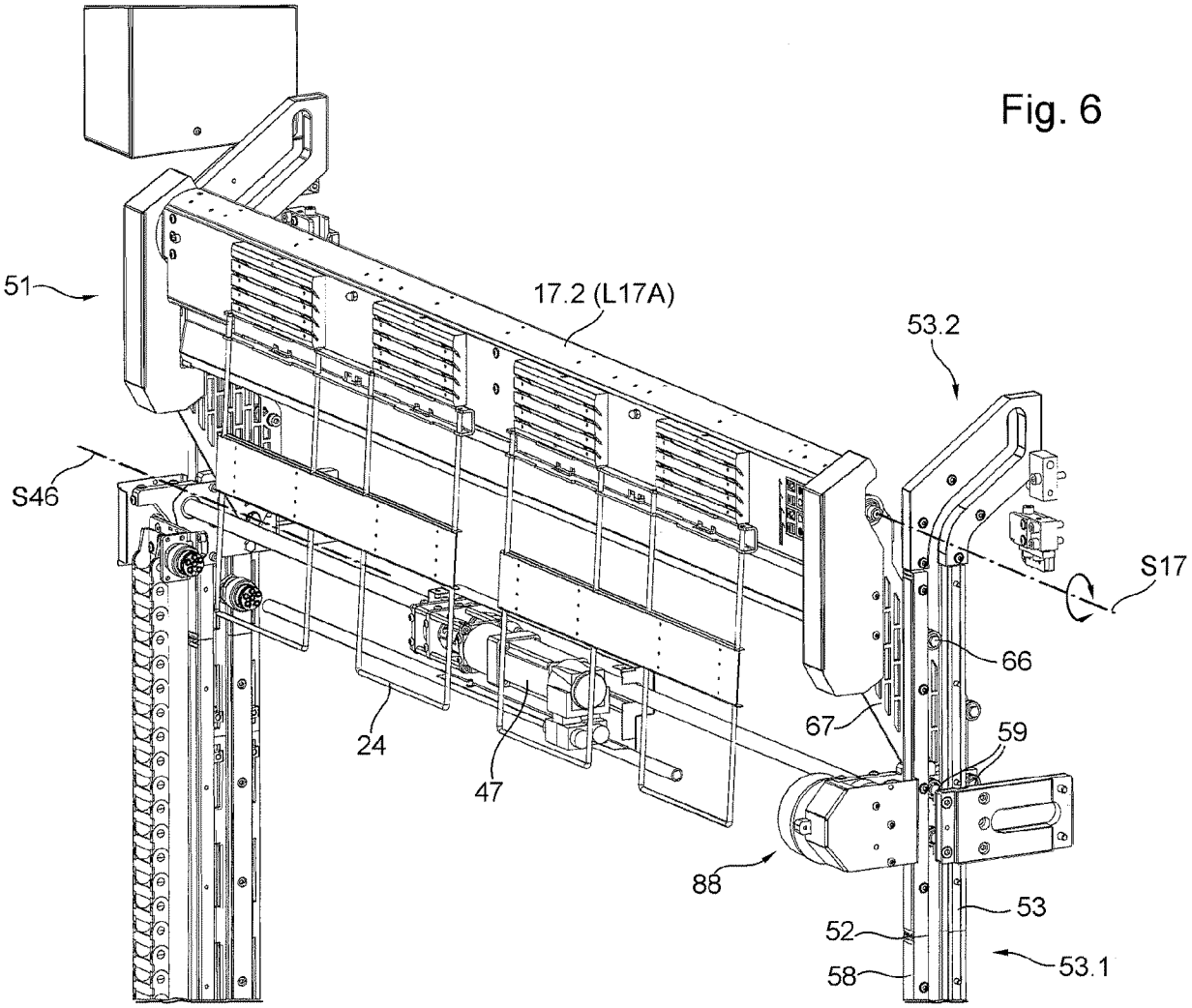
FIG. 6 a perspective enlarged representation according to FIG. 5.
Figure 7:
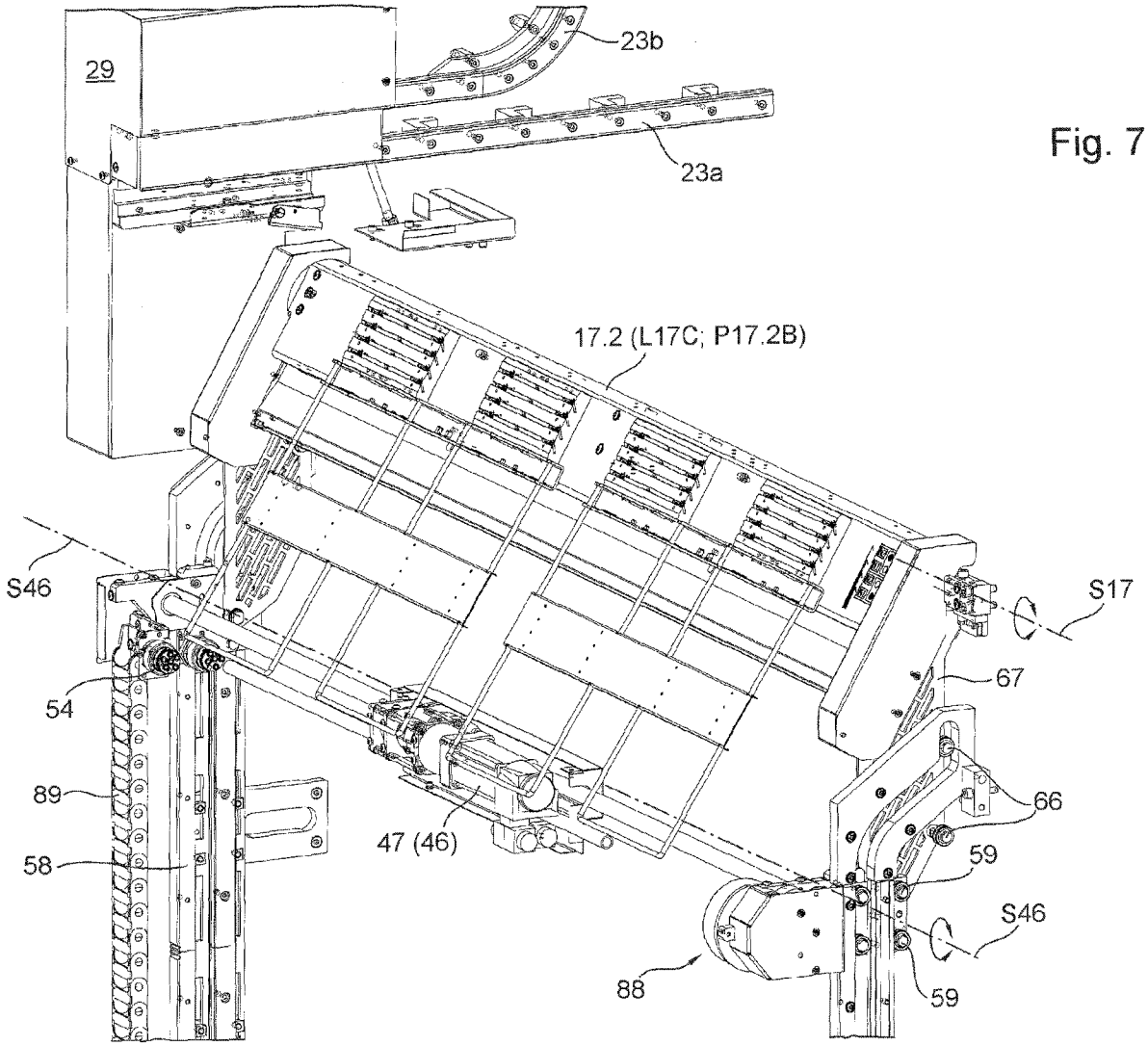
FIG. 7 a perspective representation of the vertically movable storage device, here in the area of the advanced position in an intermediate state.
Figure 10:
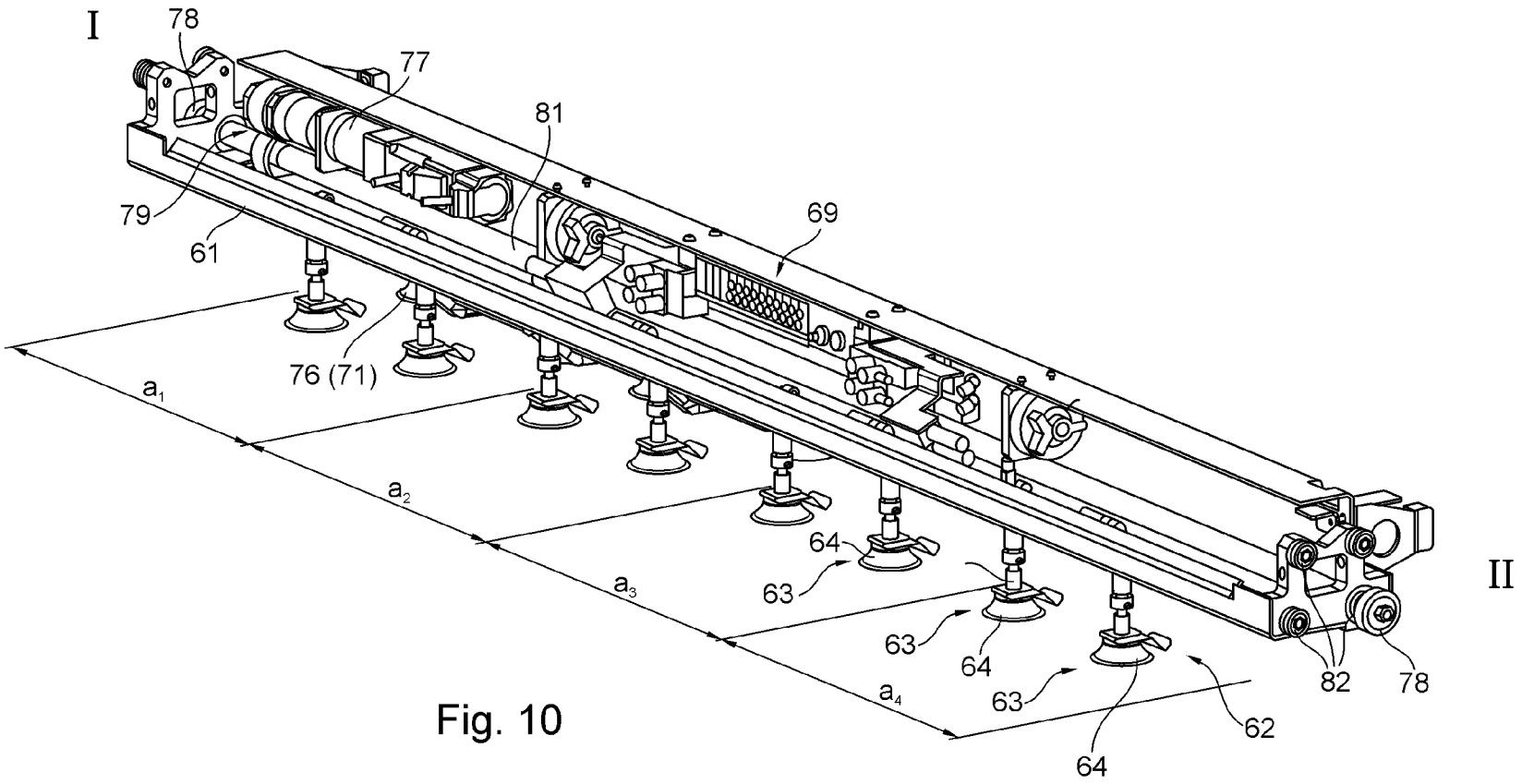
FIG. 10 a perspective representation of an embodiment of a transfer unit from the perspective of side II.

Transfer unit 18 extends in printing unit 01 parallel to the forme cylinder axis (see, e.g., FIG. 5 for example). As viewed in the axial direction of the forme cylinder 03, shown in FIG. 5, its length is at least such that it at least partially intersects with all of the storage spaces arranged side by side, and with corresponding sections for receiving the m printing formes 06 which can be arranged side by side on forme cylinder 03. Preferably, it extends over the entire nominal width $W_N$ of forme cylinder 03 to be loaded. It comprises cross-members 61, embodied as integral or in multiple parts and extending lengthwise, and at least one receiving device 62, e.g. retaining device 62, which comprises a number p of receiving elements 63, e.g. retaining elements 63, or groups of retaining elements, each comprising a plurality of, e.g. two, receiving and/or retaining elements 63, said number p corresponding at least to the number m of the maximum number of printing formes 06 to be received by forme cylinder 03 side by side (see, e.g. FIG. 10). Receiving elements 63—at least in the idle state (not engaged)—are preferably arranged in an alignment parallel to the longitudinal axis of transfer unit 18. Receiving elements 63 can be embodied, in principle, with receiving means of any configuration, as long as they allow a printing forme 06 to be received and carried. For instance, receiving could be based on a magnetic effect, for example, and receiving elements 63 could have receiving means embodied as permanent magnets or electromagnets. A mechanical grasping by corresponding grippers which interact with printing formes 06 could likewise be provided. Preferable, however, is an embodiment in which receiving and retaining are based on negative pressure, in which receiving device 62 is embodied as suction device 62 and the individual receiving elements 63 comprise suction pads 64 as retaining means. Preferably, two receiving elements 63 with suction pads 64 are provided for each of the printing formes 06 to be arranged axially side by side.

In principle, receiving elements 63 of receiving device 62 can all be arranged stationary on a side of cross-member 61 that faces printing forme storage unit 17.1; 15.2 or the printing forme 06 to be received, so that a positioning of suction pads 64 would be effected merely by moving cross-member 61 or transfer unit 18. In one advantageous embodiment, however, receiving elements 63 are mounted on cross-member 61 or suction pads 64 are mounted on the respective receiving element 63 such that suction pads 64 are movable relative to cross-member 61 individually, in groups, or all at the same time by one or more actuators, with at least one component extending in a direction perpendicular to the longitudinal axis of cross-member 61 or transfer unit 18. If the printing formes 06 of a number of sections will be received, then once all the receiving elements 63 or suction pads 64 have been positioned, only the suction pads 64 or groups of suction pads 64 that are required for the printing formes 06 to be received are activated.

For this purpose, at least those receiving elements 63 or suction pads 64 that are assigned to the same section or the same printing forme 06 to be received can each be acted on with pressurized medium independently of the other sections.

The suction pads 64 of one or more sections $a_1$; $a_2$; $a_3$; $a_4$, e.g. longitudinal sections of storage device 17.1; 17.2 or forme cylinder 03 corresponding to the individual plates, can then be activated as needed.

Figure 9:
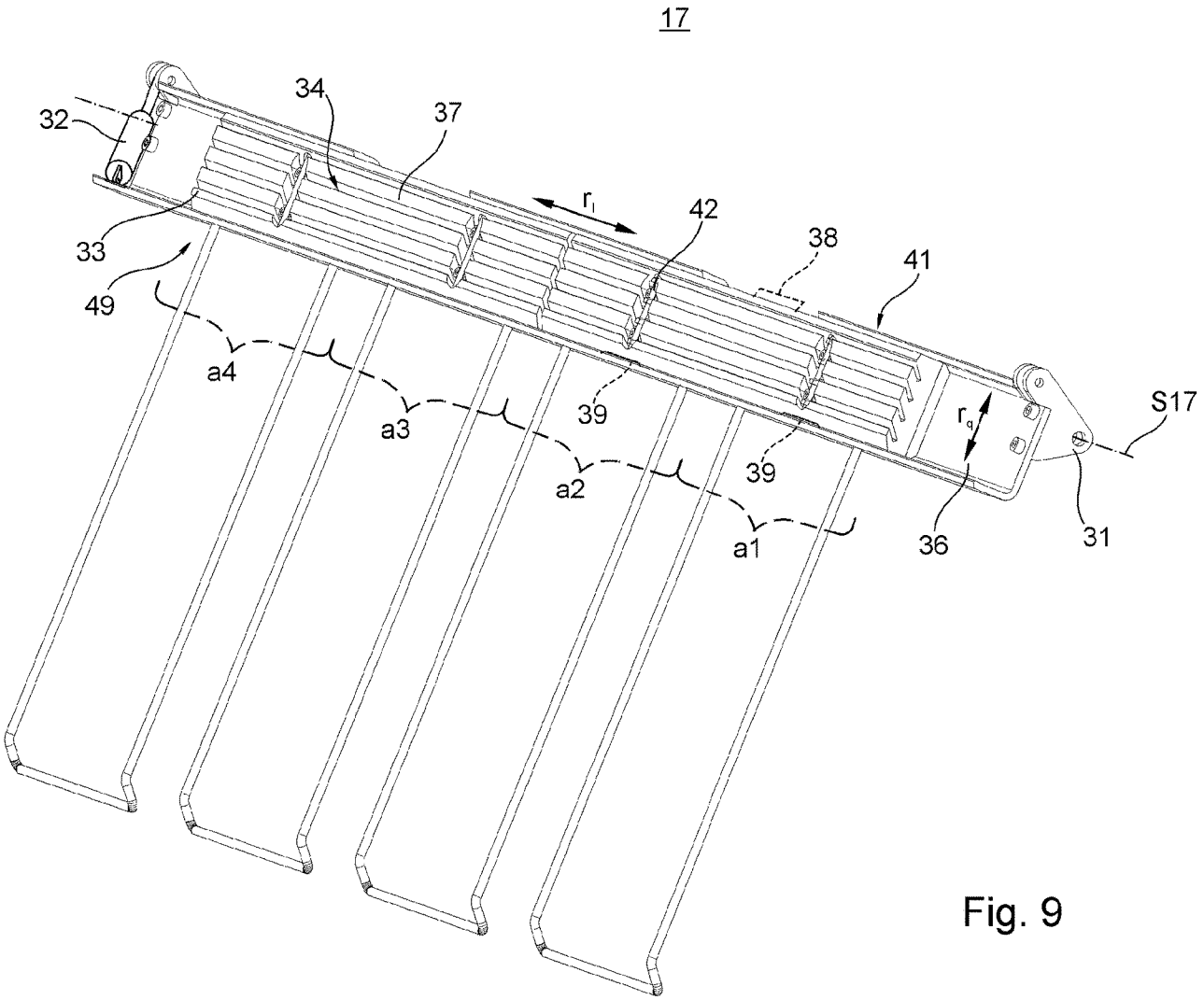
FIG. 9 a perspective representation of an example of the embodiment of the storage unit.

In a further development, transfer unit 18, e.g. in a second alignment, has a second receiving device (71), e.g. second retaining device (71), in particular a second suction device (71), having a number of receiving elements, e.g. retaining element, arranged side by side, e.g. likewise having suction pads 76. The above statements relating to the first receiving device 62 can be applied to the arrangement, embodiment, number and allocation to groups and/or sections, preferably with the difference that the receiving elements of the second receiving device (71) are mounted so as to pivot in relation to cross-member 61 around a pivot axis which is parallel to the longitudinal axis of cross-member 61 or transfer unit 18 (e.g. in FIG. 5; in FIG. 9, merely suggested on two suction pads 76, because concealed). In principle, pivoting in this connection can be carried out in groups that are comparable to the groups stated above (e.g. for every section $a_1$; $a_2$; $a_3$; $a_4$ or for every two adjacent sections $a_1$; $a_2$; $a_3$; $a_4$ together on a pivotable carrier), or also individually. As a drive, actuators based on compressed medium can be provided, in keeping with the embodiments of the first receiving device 62, and could then likewise be connected, for example, to valves of the valve station 69. During receiving of the printing forme(s) 06, first the second receiving element is set up, and suction pad 76 is activated and pivoted. The first suction pad or pads are then also activated. Pivoting serves to curve printing forme 06 for transport to forme cylinder 03.

The receiving device(s) 62 (71) can therefore receive one or more printing formes 06 from printing forme storage unit 17.1; 17.2 via transfer unit 18, depending on the negative pressurization of certain receiving elements 63 or groups thereof and/or depending on the positioning of receiving elements 63, in order to transport said printing formes along a transport path 23; 23*a*; 23*b* to the forme cylinder 03 for loading. Transfer unit 18 can be conveyed along transport path 23; 23*a*; 23*b* in principle by way of a drive means fixed to the frame, e.g. a drive motor fixed to the frame, which conveys transfer unit 18 along transport path 23; 23*a*; 23*b* via a gear mechanism and/or a traction means.

In a preferred embodiment, however, transfer unit 18 is driven by way of a drive means 77, e.g. a drive motor 77, which is assigned to transfer unit 18 and is carried along by transfer unit 18. The advancement along transport path 23; 23*a*; 23*b* is implemented by drive motor 77 via at least one drive gear 78, which interacts in a positive or frictional connection with a running track 83 which is fixed to the frame—in relation to printing unit 01. Transfer unit 18 comprises drive motor 77, which here drives a shaft 81, for example, with the interconnection of a gear mechanism 79. Drive gears 78 are arranged fixed on shaft 81 for co-rotation therewith—e.g. each at one end face of cross-member 61. In principle, two drive motors 77 could also be provided for the two end face drive gears 78, however in that case they would have to be electronically synchronized with one another. Drive gear 78, which is embodied, for example as gear wheel 78, interacts for advancement with a row of teeth of a toothed rack 87, which is disposed e.g. adjacent to or is assigned to the running track (see, e.g. FIG. 10).

The guiding and securing of transfer unit 18 against tilting can be embodied differently depending on the characterization of the pairing of drive gear/running track 78/83 and/or depending on additional interacting guide elements 82. For example, two drive gears 78 can be arranged at each end face of transfer unit 18, one in front of the other in the transport direction, for interacting with running track 83. A drive gear 78 and an additional guide element 82 e.g. a guide roller 82, can also be provided on the end face of transfer unit 18, and can interact in a supporting manner with a guide element 84, e.g. a guide rail 84, fixed to the frame, for guiding transfer unit 18 and supporting it against tilting.

If transfer unit 18 is assigned to only one forme cylinder 03, then guide element 84, which guides the rollers 82 of transfer unit 18, can be embodied from the receiving position up to the transfer position as, e.g. a rectilinear guide rail 84 having one or more linear guide or rail sections 84*a* or—according to potentially existing spatial requirements—having one or more linear and optionally one or more curved rail sections 84*b*. For instance, a first guide section 84*a* in the region of the receiving position can be embodied as rectilinear, and can extend in a straight line or including a curve to the transfer position, depending on the spatial circumstances. For the advantageous embodiment in which forme cylinders 03 of a plurality of printing couples 02, in particular two printing couples, can be supplied with new printing formes 06 from the same storage device 17.1; 17.2 and/or over a common transport path 23; 23*a*; 23*b*, a switch 27 is provided, e.g.—as already stated above, via which transfer unit 18 alternatively moves on one or the other transport path 23; 23*a*; 23*b* to the transfer position assigned to one or the other forme cylinder 03. In principle, switch 27 can have any configuration that will enable this alternative guidance.

In principle, regardless of whether transport system 18, 23 is embodied with a single transport path 23, with a plurality of transport paths 23*a*; 23*b* and/or with switch 27, a positioning device 28 as already mentioned above can be embodied, e.g. as a device for variable path limitation, for example as a stop device and/or sensor device to be assigned to transport system 18, 23 or guiding system 23, in the area of transport path 23; 23*a*; 23*b* which is distant from the cylinder. A positioning device 28 which optionally predetermines a plurality of defined positions for the receiving position, is particularly advantageous in connection with an embodiment of the printing forme changing system in which transport system 18, 23 interacts in a receiving area with a printing forme storage unit 17.1; 17.2 in which printing formes 06 are arranged in the manner of scales, with their ends 09; 11, in particular their leading ends 09, offset from one another as viewed in the transport direction of a transfer unit 18 located in the receiving position, as is the case, for example, with the embodiment of the aforementioned storage device 17.1; 15.2.

In an advantageous use of an aforementioned storage device 17.1; 17.2 in which printing forme ends 09 are offset in the transport direction of transfer unit 18, e.g. a printing forme storage unit 17.1; 15.2 in the aforementioned embodiment, positioning device 28, which defines a plurality of positions, ensures that receiving device 62 will grip each printing forme 06 at the same distance from leading end 09. The switching and/or programming of positioning device 28 should be adapted accordingly to the sequence of steps in the printing forme changeover.

Once printing forme 06 or a plurality of printing formes 06 have been received, this or these are moved by transfer unit 18 to the transfer position close to the cylinder via transport path 23; 23*a*; 23*b*. The subsequent transfer can take place directly on forme cylinder 03 or on a mounting device 19 close to the cylinder. The steps described below and the means optionally used (e.g. mounting device 19 and/or contact pressure device 21) are to be used in principle independently of the above-described characterization of the vertical conveying system 43 and/or the transport system 18, 23 and/or the storage device 17.2; 15.2, but advantageously in combination with one or more of the features of the described embodiments of storage device 17.1; 15.2 and/or transfer unit 18 and/or guiding system 23.

In an embodiment of the printing forme changing system which is simpler in terms of the installed system components 17; 18; 19; 21; 22; 23, the received printing forme 06 or received printing formes 06 is/are moved, by means of transfer unit 18, with the end 09 or ends 09 of said printing forme directly, substantially tangentially, to forme cylinder 03 that will be loaded.

In an embodiment which is more complex, but is still more robust in terms of potential malfunctions, particularly if printing formes 06 of particularly large dimensions and/or low strength and/or printing formes 06 of different strengths and/or dimensions will be used, printing forme(s) 06 is/are first laid out on or preferably transferred to a mounting device 19 close to the forme cylinder, before being wound onto the circumferential surface of forme cylinder 03. Printing forme 06 is laid out in this case on a front or preferably rear side of printing forme 06, which is embodied as flat, i.e. mounting device 19 interacts with printing forme 06 on a front or particularly on a rear side of the printing forme. Mounting device 19 ensures, i.a., that printing formes 06 occupy a defined state fixed to the frame and, in an advantageous variant comprising a retaining device 102, e.g. suction device 102, that a defined retaining force and/or a force for a desired deformation can be applied.

Mounting device 19 extends in printing unit 01 parallel to the forme cylinder axis (see, e.g. FIG. 3). It is at least long enough, as viewed in the axial direction of forme cylinder 03, that it at least partially overlaps with each of sections $a_1$; $a_2$; $a_3$; $a_4$ indicated in FIGS. 8 and 9 for receiving the maximum of m printing formes 06 to be arranged side by side on forme cylinder 03. Preferably, it extends over the entire nominal width $W_N$ of forme cylinder 03 to be loaded. It comprises a delivery surface 103 embodied as integral or in multiple parts and extending over at least the length of the m sections $a_1$; $a_2$; $a_3$; $a_4$, which either directly engages an upper side of a cross-member extending axially, mounted at the end face of side frame 04 and not visible here, or as illustrated, the upper side of a cover arranged on a cross-member mounted at the end face.

When a printing forme 06 will be placed or seated by transfer unit 18 on delivery surface 103 in the corresponding section $a_1$; $a_2$; $a_3$; $a_4$, (optionally using a slight contact pressure), then in an advantageous embodiment with retaining element 396, e.g. negative pressure, activated, printing forme 06 is held in a frictional manner on delivery surface 103, and when the edge is hooked at least partially in the channel, said printing forme can be conveyed in the direction thereof merely by rotating forme cylinder 03 against resistance. In an advantageous further development, seating elements 108 are provided on both sides in delivery surface 103, preferably at the same height, at least overlapping, as viewed in the longitudinal direction of printing forme 06, said seating elements protruding slightly, e.g. by a maximum of 2 mm, above the upper surface of delivery surface 103. During loading, in the embodiment having retaining element 102, the edge of leading end 09 of printing forme 06 is conveyed by means of transfer unit 18 or by means of retaining device 62 until it is above opening 07 of channel 08. Before forme cylinder 03 is rotated, printing forme 06 is placed on delivery surface 103, or is even seated thereon with a small amount of pressure, so that printing forme 06 comes into contact with retaining element 396 or with the suction pad thereof. Retaining element 396 or the suction pad is then activated, i.e. in the case of the suction pad, it is acted on with negative pressure. If the aforementioned seating elements 398 are provided, printing forme 06 will sag and at the same time will be restrained in a frictional manner against movement in the transport direction. The subsequent rotation of forme cylinder 03 causes the edge of leading end 09, which previously has been only partially engaged, to slide fully into channel 08, and to be drawn by the retaining force against the channel edge and thereby aligned.

As mentioned above, to support hooking and/or winding, a contact pressure device 21 can be provided (see, e.g. FIG. 1). In addition to or particularly in place of a contact pressure device 21 to be expressly provided in the printing forme changing system, in principle, a roller 26 of printing couple 02 close to the forme cylinder, e.g. a forme roller 26 closest to the end of transport path 23*a*; 23*b* which is close to the forme cylinder, said forme roller being part of an inking or dampening unit 13; 14, can act as contact pressure device 26.

In principle, system components 21; 26; 23; 18; 17.1; 17.2 or some of these, e.g. contact pressure device 21; 26 and/or transfer unit 18 which is moved on transport path 23, and/or a correspondingly embodied or additionally provided storage device 17.1; 17.2; 22.1; 22.2, can be used in a reverse sequence and functionality to that described in connection with the infeed and mounting of a new printing forme 06, remove and take away ("unplating") a used printing forme 06. For this purpose, for example, the trailing end 11 on forme cylinder 03, optionally a retention of trailing end 11 or of printing forme 06, is released during unwinding by a contact pressure device 21; 26, the wound printing forme 06 is picked up from forme cylinder 03 or from an optionally provided mounting device 19 that accepts the unwound printing forme 06 by means of transfer unit 18, and is transported along transport path 23; 23*a*; 23*b* back to a receiving chute of a storage device 17.1; 17.2 provided for both new and used printing formes 06, or along a, e.g. modified transport path 23; 23*a*; 23*b* to a storage device 22.1; 22.2 additionally provided for used printing formes 06.

In one advantageous embodiment, storage device 22.1; 22.2 for receiving used printing formes 06 is different from the above, and is preferably embodied as spatially separate from the respective storage device 17.1; 17.2 for receiving and holding in reserve printing formes 06 to be newly applied. This has advantages particularly in connection with a rapid and independent conveyance of new and old printing formes 06 and/or good accessibility to printing couple 02. For this purpose, the respective storage device 22.1; 22.2 has a storage unit 124.1; 124.2, e.g. storage chute 124.1, 124.2—preferably arranged structurally separately from storage device 17.1; 15.2—for receiving printing formes 06, which extends parallel to the forme cylinder axis and over the entire nominal width $W_N$ of the forme cylinder 03 that supports the printing formes (06) to be removed, as viewed in the axial direction of forme cylinder 03. Storage unit 124.1; 124.2 is embodied for receiving a number of printing formes 06 side by side which corresponds to the maximum number m of printing formes 06 that can be arranged side by side on forme cylinder 03. Said storage component can be continuous lengthwise, but can optionally also comprise individual sections separated by legs of lesser thickness. The width of storage unit 124.1; 124.2 offers space for at least a number of printing formes 06 arranged one in front of the other that corresponds to the product of the number of printing couples 02 assigned to storage unit 124.1; 124.2 and the respective number of printing formes 06 to be mounted one in front of the other in the circumferential direction on forme cylinders 03. In the present example, two printing couples 02, each embodied as double-circumference, are assigned to storage unit 124.1; 124.2, so that storage unit 124.1; 124.2 holds (at least) four printing formes 06 one in front of the other. Printing couples 02 of two adjacent printing towers 01 can also be assigned to storage unit 124.1; 124.2 or storage device 22.1; 22.2, which can be arranged between these two printing towers 01.

In the advantageous embodiment shown here, the respective storage device 22.1; 22.2 is arranged spatially separately from the printing unit 01 to which it is assigned with respect to plate return in such a way that an open space 118 for lateral access to printing couples 02, e.g. an intermediate space or particularly an operating space 118 for operators, remains between storage device 22.1; 22.2 and printing unit 01.1; 01.2 or printing tower 01—at least when storage device 22.1; 22.2 is in the idle state.

The vertical conveying system 44 for conveying the vertically movable storage unit 124.2 is embodied for conveying the vertically movable storage unit 124.2, which is at least partially loaded with used printing formes 06, in the manner described above between two machine planes B1; B2 and/or between a return location R2, which is vertically spaced from main operating plane B1 and/or which cannot be reached, and main operating plane B1. Conveying system 44 is preferably embodied such that storage unit 124.2 is conveyed over the entire conveying path or the majority thereof, but at least a portion thereof, in a first state L124, e.g. a transport state L124, in which the longitudinal extension of the transported printing formes 06 and/or the storage length L, as viewed in the longitudinal direction of printing formes 06, of the loaded, vertically movable storage unit 124.2 and/or a wall 98 of storage unit 124.2 on one side, which delimits storage unit 124.2 on the longitudinal side thereof toward the front side (front side) or back side of the printing formes 06 to be transported, extends predominantly vertically, i.e. formes an angle $\alpha$ with vertical of $\alpha<45°$, preferably $\alpha\leq30°$. The term "vertical state" of storage unit 124.2 or of the longitudinal side wall 98 thereof is understood—in case it is not explicitly emphasized in a literal sense—as all states as described above, in which printing formes 06 or the effective length extends predominantly vertically, i.e. with a component which is greater than the horizontal component.

Figure 15:
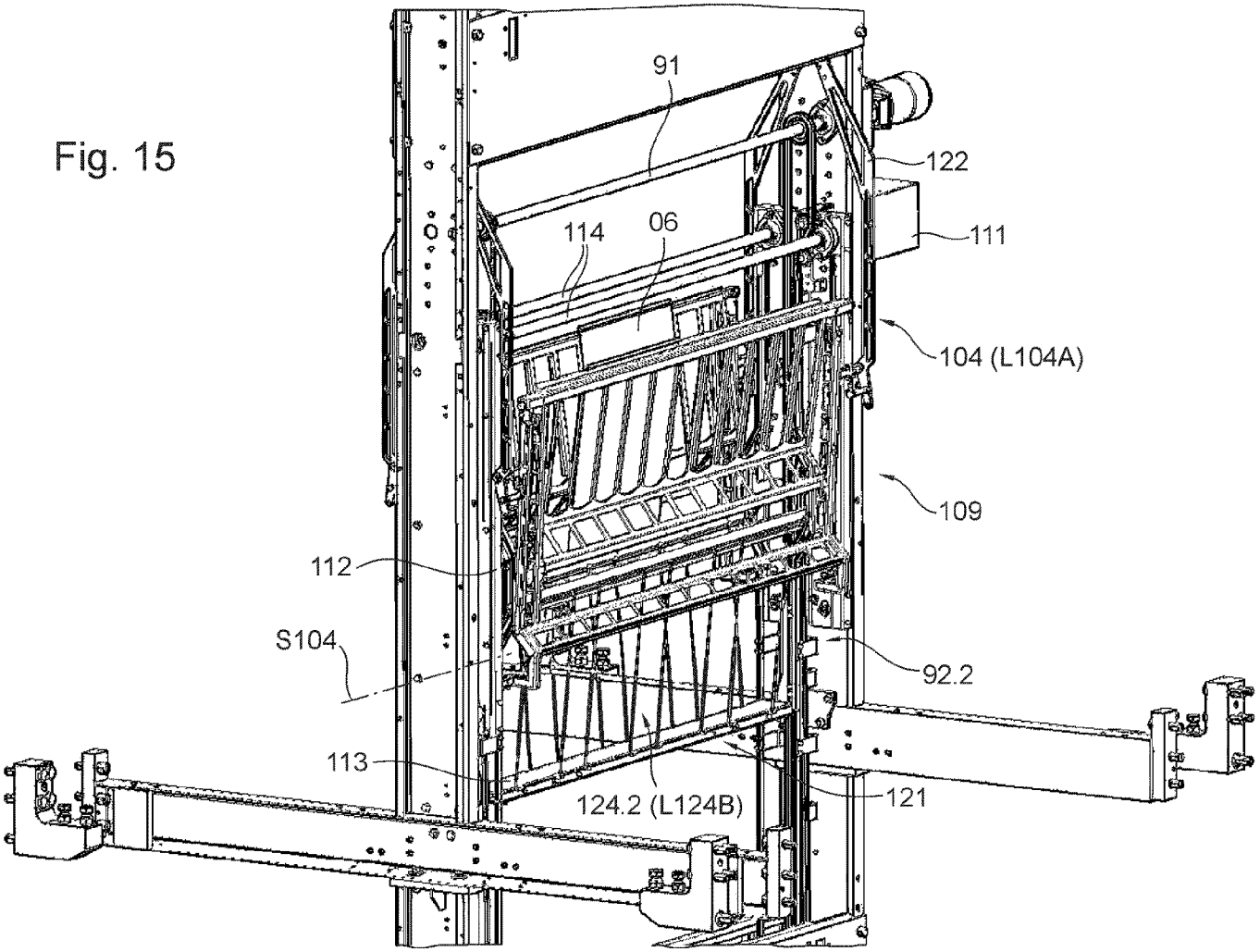
FIG. 15 a perspective view of the storage device for used printing formes in the area of a second operating plane, in which a feed table is shown in the receiving state and the storage unit is shown in the capturing and/or loading state, by way of example.

Conveying system 44 is preferably embodied such that, at least over a distance not equal to zero, in the area of a passage through an intermediate platform 38; 39 which separates the two machine planes B1; B2 that are connected via conveying system 43, storage unit 124.2 is conveyed in a first vertical state L124 as described above and/or with a corresponding first vertical state L124 of the longitudinal side wall 98. In this transport state L124, it can be conveyed vertically in a particularly space-saving manner. Conveying system 44, in particular a guide structure 92, is preferably embodied such that vertically movable storage unit 124.2 and/or the longitudinal side wall 98 that faces printing couple 02 to which it is assigned for removal can be moved at least along a path section between the passage and the loading position P124.2B to a second state L124B, e.g. capturing and/or loading state L124B, or is located in said state, in which the effective length of storage unit 124.2 or of wall 98 is located in a second state L124B, which is angled more severely in relation to vertical than first vertical state L124. In this state, storage unit 124.2 is tilted, or loading opening 119 is more open toward the printing component 02 in question. In the preferred operation, the synchronization of receiving state L104A of delivery table 104 and capturing and/or loading state L124B of storage unit 124.2, as shown in FIG. 15, does not occur, because storage unit 124.2 does not move to capturing and/or loading state 124B and engage behind printing formes 06 until delivery table 104 is located in its delivery state L104B, in which the received printing formes 06 can be delivered, e.g. to storage unit 124.2.

Storage unit 124.2 and/or wall 98 thereof can be movable or moved, in the area of removal position P124.2A, already in transport state L124, or in a further enhancement, in a state L124A which is tilted more severely in relation to vertical than transport state L124, e.g. removal state L124A. In a particularly space-saving embodiment, storage unit 124.2 or the front-side wall 98 thereof, is in a substantially vertical state (with a maximum deviation from vertical of ±5° in the direction of the effective length) as transport state L124, at least in the area of the opening passage.

For the opening passage of storage unit 124.2, e.g. an opening 94 in the intermediate platform 38; 39 or an open cross-section 94 of a chute-like intermediate space between vertically extending side frames 41, embodied, e.g. in the manner of supports 41, of the frame 73, which serves, e.g. as an intermediate frame, is provided. This can optionally be openable or closable by a hatch. Preferably, however, the entire conveying path for storage unit 124.2 extending in the chute-like intermediate space is secured against any inadvertent entry by operators. This securing is provided, for example, by a barrier not shown here, e.g. a fence, housing or at least by handrails.

In the embodiment already described above and shown here, the drive means 74 embodied as electric motor 74 will be or is disposed fixed to the frame, e.g. on one of the supports 41, and drives, preferably via a reduction gear unit not shown here in detail, a shaft 91, and drive gear 86, which is connected to shaft 91 for co-rotation and is embodied as sprocket 86, drives the traction means 68, which is embodied as chain 68, in particular as roller chain. The traction means loop, driven in this manner by electric motor 74 and preferably closed, travels over one or more guide rollers and/or deflecting rollers 96. Storage unit 124.2 is articulated or fastened to traction means 68 via a corresponding coupling, so that, when a coupling point assigned to traction means 68 moves forward or backward, the storage unit is correspondingly carried along with it. Advantageously, storage unit 124.2 is coupled to a frame part 113 other than a wall 98, the disposition of which can optionally be changed.

In a preferred embodiment, two traction means 68 which engage spaced from one another in the longitudinal direction of storage unit 124.2 are provided for the conveyance thereof, and in an advantageous embodiment are and/or can be driven together by electric motor 74 via shaft 91, which extends, for example, between supports 41.

In a preferred embodiment, in addition to drive 68, 74, 86 itself, a guide which forces storage unit 124.2 along a defined movement path over at least one conveying section, preferably over the entire conveying path, is provided, wherein the part of said guide which is spatially fixed or fixed to the frame is formed by one or more guide surfaces of an integral or multipart guide structure 92—e.g. extending predominantly vertically—e.g. of one or more integral or multipart guide supports 92. The at least one spatially fixed guide surface of guide structure 92 interacts with at least one stop element which is spatially fixedly connected to storage unit 124.2 and is carried along with it. In the present embodiment, storage unit 124.2 is guided, e.g. by first stop elements 97 fixed to the carriage, which are embodied as rollers 97 indicated only as dashed lines, and which interact, e.g. with two guide surfaces of guide structure 92—particularly pointing in opposite directions. In this case, in an advantageous embodiment, two first rollers 97, which can rotate on storage unit 124.2 around axes extending parallel to the longitudinal direction thereof but spaced horizontally from one another, can each roll on one of two mutually facing guide surfaces of two integral or multipart guide carriers 92, so that storage unit 124.2 is guided with rollers 97 by said guide supports 92 toward both sides.

Figure 16:
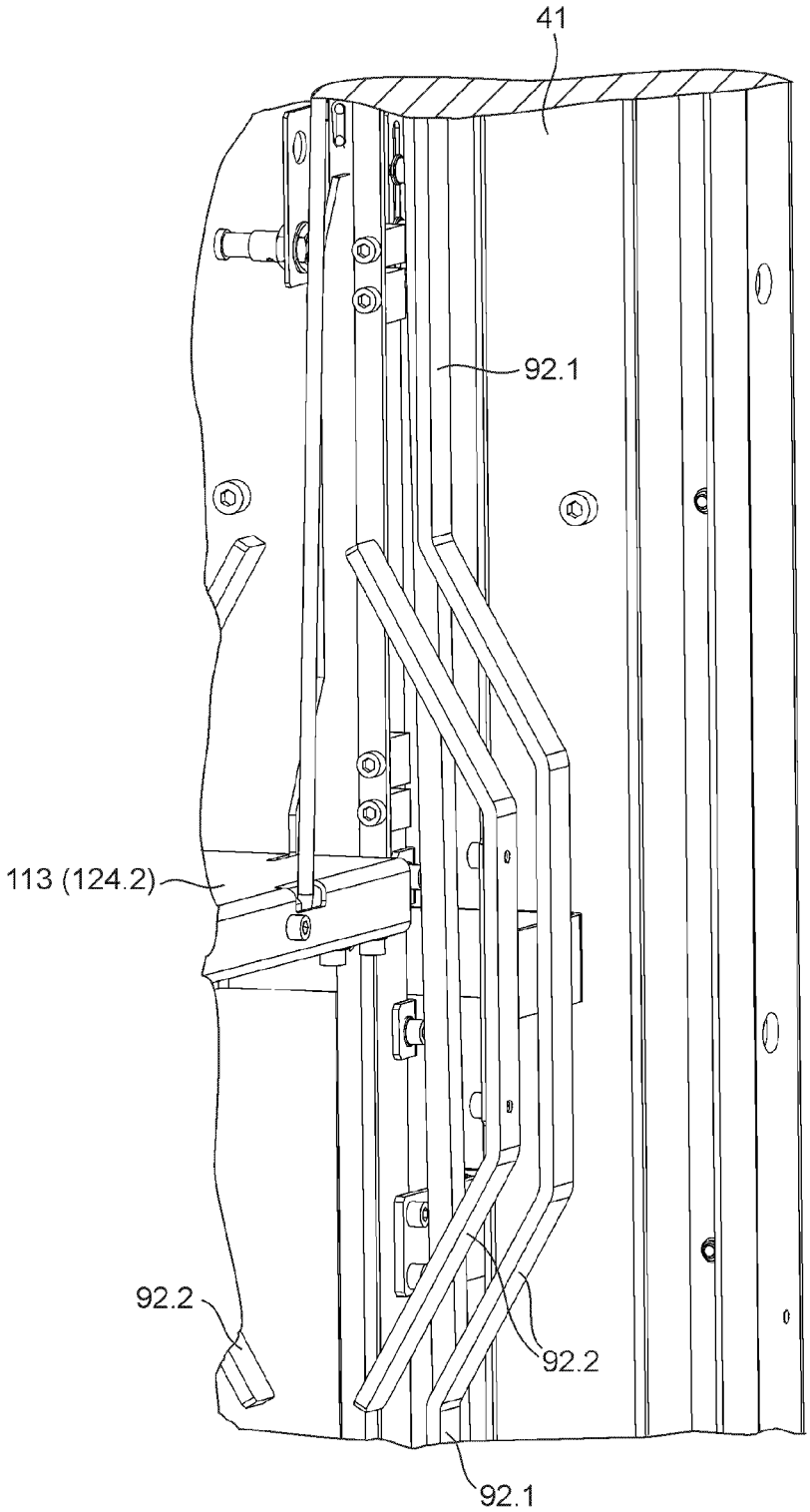
FIG. 16 a detailed view of a guide section which guides the storage unit or a wall from a transport state to a second state.
Figure 17:
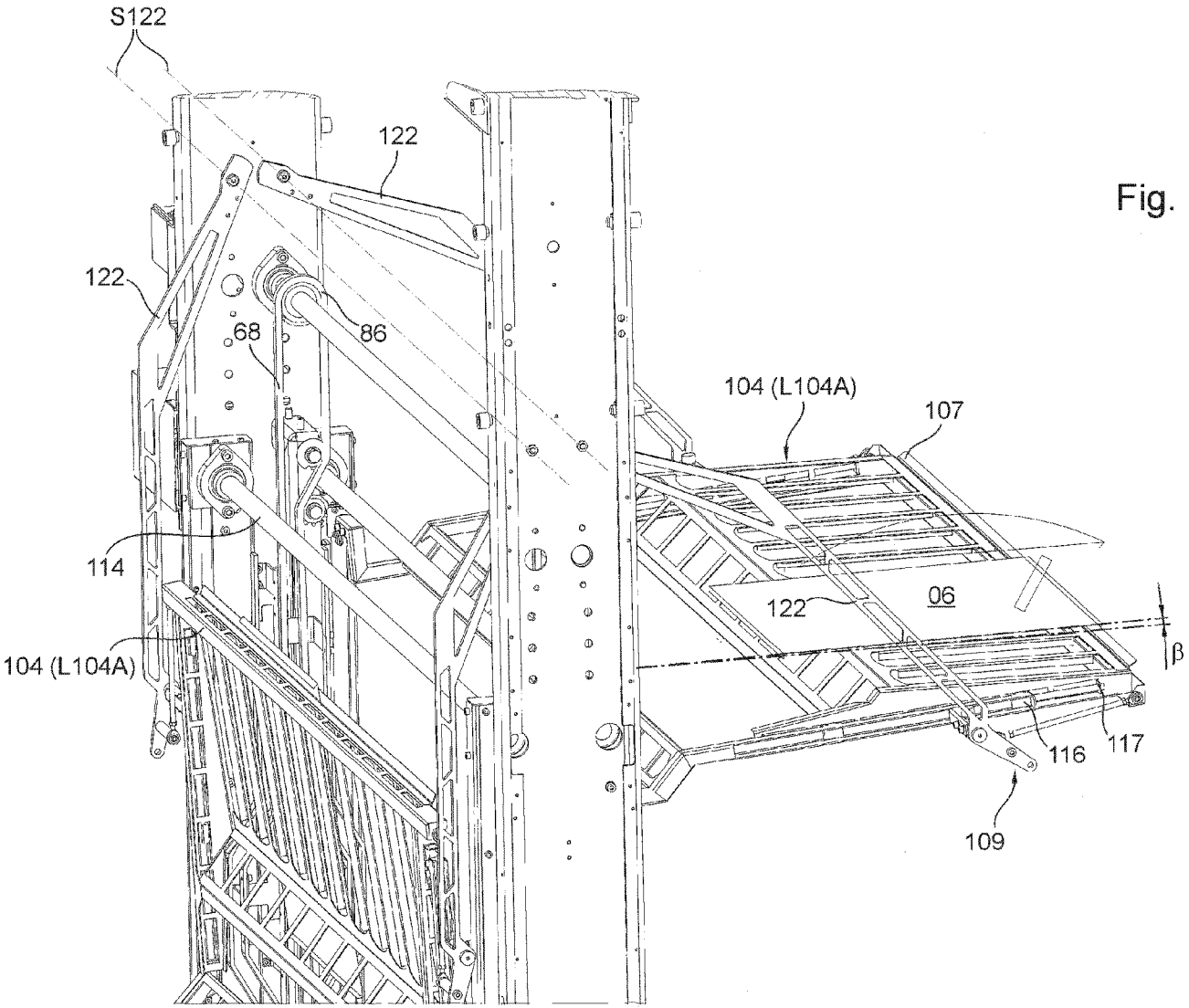
FIG. 17 a perspective view of the storage device for used printing formes in the area of a second operating plane, in which a feed table on a first side is shown in the idle state or delivery state and a feed table on a second side is shown in the receiving state.
Figure 18:
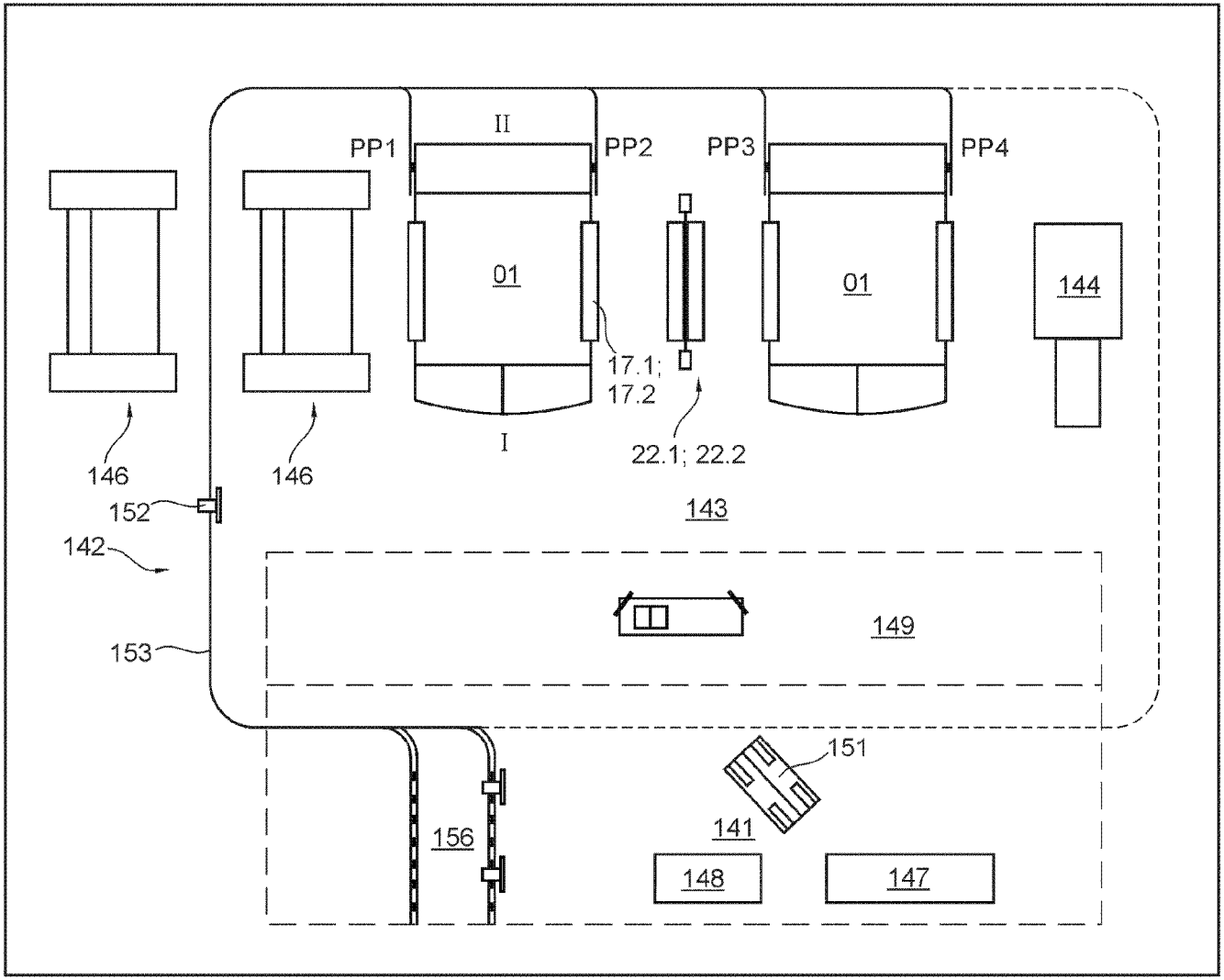
FIG. 18 a schematic representation of units and functional areas of a print shop.

In principle, in the first, simple embodiment, the guide with guide supports 92 can be embodied as a straight line, in particular a vertical straight line, over the entire conveying path between removal position P124.2A and loading position P124.2B. As indicated above, in a second embodiment, not shown, storage unit 124.2 or the upper side thereof, or in a preferred third embodiment only the aforementioned longitudinal or front-side wall 98, or optionally in a fourth embodiment, not shown, both the upper side of storage unit 124.2 and additionally a wall 98, can be moved at least over a path section between the passage and loading position P124.2B, in particular in at least one conveying section near the loading position, from transport state L124 to a second state L124B, e.g. a capturing and/or loading state L124B. For this purpose, at least one guide section 92.2 that corresponds to this conveying section is provided, by which, in a second embodiment of storage unit 124.2 or at least the upper side of storage unit 124.2, or in a third embodiment only the upper end of the wall 98 that faces the assigned printing couple 02 is or can be transferred from the vertical alignment occupied in transport state L124.2A to a vertical alignment closer to printing couple 02, while in the third embodiment, storage unit 124.2 remains in the area of its base 121 in its first vertical alignment and/or state, but in the fourth embodiment is likewise moved by a corresponding guide horizontally to a different vertical, and/or is pivoted to another state (see, e.g. FIG. 15 and FIG. 16).

To achieve the aforementioned capturing or loading state L124B, stop elements 97; 99 that are fixed to the storage unit can interact with guide surfaces of correspondingly extending guide sections 92.2 that guide stop elements 99, which are fixed to the storage unit, away from their vertical movement in the direction of printing couple 02 upon entering the relevant guide section 92.2, and guide them, depending on the further path of the guide, closer and closer to printing couple 02 up to the end position of storage unit 124.2 in its loading state P124B, running up to a displacing section, again vertically, and up to the end position, or after a displacement and optionally a vertical section, guiding said stop elements back from printing couple 02 in the direction of the first vertical alignment. The latter is used, for example, for "capturing" printing formes 06 by means of storage unit 124.2 which has been moved in the direction of loading position P124.2B or the wall 98 thereof, and for subsequently closing or decreasing the size of opening 119.

In a first variant of the second embodiment, storage unit 124.2 can have at least one stop element 97 which is closer to base 121 of storage unit 124.2 on each side, and at least one stop element 99 which is spaced in the longitudinal direction of the printing formes 06 to be conveyed, is closer to opening 119 of storage unit 124.2 or further from the base, and is fixed to the storage unit, wherein stop element 99 which is further from the base is already running in a guide section that deviates from vertical for movement into capturing and/or loading state L124B, whereas in the first variant, stop element 97 which is closer to the base is still running in vertical guide section 92.1, for example. In the second variant, the end of storage unit 124.2 that is close to the base is also moved to a conveying section which is close to loading state P124.2B, in that stop element 97 thereof also runs, at least in one movement phase, in a guide section 92.2 that deviates from vertical.

In the preferred second embodiment, storage unit 124.2 is embodied with a wall 98 which can be moved in relation to frame section 113 of storage unit 124.2, for example can pivot around a pivot axis S98 which is closer to base 121 and is parallel to forme cylinder 03 of printing couple 02, wherein the aforementioned second stop elements 99, e.g. rollers 99, which are closer to opening 119 or further from the base, are located on movable wall 98, and the first rollers 97, which are closer to base 121, are located on frame section 113 of storage unit 124.2. Rollers 97, which are fixed to the frame, run, for example, in a guide section 92.1, which is different from guide section 92.2. Since the rollers 97 that are fixed to the frame run in vertical guide section 92.2, and since the rollers 99 that are assigned to wall 98 are forced by guide section 92.2 on a movement path that deviates from vertical, opening 119 of storage unit 124.2 is widened in at least one phase of movement close to return position P124.2B, and closes again when this movement phase is reversed. This can also be provided in this same manner in a movement phase close to removal position P124.2A by a correspondingly configured guide section 92.3 that interacts with stop element 99, which is fixed to the wall.

In the embodiment described, guide section 92.2 which is close to the return position is configured such that wall 98, when moving in the direction of return position P124.2B—guided via stop elements 99 which are fixed to the wall—is guided with its end which is close to the opening first out of the previously vertical direction of movement of vertical guide section 92.1 in the direction of printing couple 02, then a distance vertically, and then back away from printing couple 02. Wall 98 can thereby engage below or behind an end of a printing forme 06 which is held in reserve, for example by transfer unit 18 or by a supplemental means 104, e.g. a rigid or preferably movable delivery table 104, and can receive said end by moving further to the end state of return position P124.2B. Once the used printing formes 06 have been received, they are moved to removal position P124.2A by the conveyance of storage unit 124.2 to their removal position P124.2A, where they can be removed by operators or by a manipulator. In the advantageous embodiment described, opening 119 of storage unit 124.2 widens in the area of removal position P124.2A by way of the correspondingly configured guide section 92.3, which guides wall 98.

In a preferred embodiment, an abovementioned supplemental means 104 is provided for supporting the transfer and/or for bridging the distance between printing unit 01.1; 01.2 and storage unit 124.2, to which supplemental means the printing formes 06 to be returned are delivered by transfer unit 18, in particular onto which they can be delivered. In principle, supplemental means 104 could be configured in the form of a flap, which can be arranged on storage unit 124.2, e.g. as a rigid or likewise movable extension on movable wall 98 or as a movable flap on storage unit 124.2.

In a preferred embodiment, however, supplemental means 104 is arranged not fixed to the storage unit, but on a frame 04; 73, e.g. side frame 04 or particularly frame 73. Supplemental means 104, which is embodied, e.g. as a homogeneous or inhomogeneous delivery table 104, is pivotable around a pivot axis S104 such that in a receiving state L104A, it comes to rest with one end in intermediate space 118 between printing couple 02 and storage unit 124.2, and in an idle position, this end comes to rest, depending on whether delivery table 104 is located on side frame 04 or on frame 73, closer to side frame 04 or closer to frame 73, and/or in that delivery table 104, as viewed in the longitudinal extension of printing formes 06 to be delivered, extends predominantly horizontally in receiving state L104A (i.e. at an angle $\beta<45°$ between the aforementioned longitudinal extension and horizontal), and in idle state L104B extends predominantly vertically (i.e. at an angle $\beta>45°$ between the aforementioned longitudinal extension and horizontal). Delivery table 104 is preferably pivotable around a pivot axis S104, which in idle state L104B extends in the region of the lower half, preferably the lower quarter, of the longitudinal extension on delivery table 104 and/or in the end region of an end opposite loading opening 119, e.g. near base 121. In an area of delivery table 104 that lies above pivot axis S104 in idle state L104B, a drive which pivots delivery table 104 engages, preferably on both sides. For a purely pivoting movement, this can be a motor-driven cable, belt or chain drive, by which the unattached end of delivery table 104 can be pivoted and/or is pivoted between idle position and receiving position L104A; L104B. Idle position L104B can also be delivery position L104B, in which storage unit 124.2 engages behind printing formes 06, for example, for receiving them and/or in which the received printing formes 06 can be delivered to storage unit 124.2.

In a preferred embodiment, supplemental means 104 is mounted so as to pivot around a pivot axis S104, which is in turn mounted on frame 04; 73 so as to move along a movement path having at least one vertical component. In this, a coupler 122, e.g. a lever 122 or lever arm 122, engages in the region of delivery table 104 which lies above pivot axis S104 in idle state L104B, preferably on both sides, so as to rotate around an axis S122.1, said coupler being pivotable on the frame side around a pivot axis S122.2 which is fixed to the frame. Lever arm 122 is pivotable, for example, by means of a drive motor 111, preferably via a gear mechanism, not shown, and a shaft 114. With the pivoting of lever 122, pivot axis S104 or the bearing thereof will be or is mounted so as to be moved or movable via corresponding guide means of a guide 112 in a vertical direction.

In an advantageous further development, an edge which faces printing couple 02 in receiving state L104A, e.g. acting as suspending edge 107, can be movable in and out in a telescoping manner on an extension piece 117 by way of corresponding tracks 116 on delivery table 104. The inward and outward movement can be embodied as coupled to the pivoting movement via a drive, preferably via a coupling 109, e.g. lever mechanism 109.

Storage device 22.2 for returning the art printing formes can be simple in embodiment, i.e. operating on only one side, i.e. interacting with a printing tower 01. In the case of two adjoining printing towers 01, however—as shown—storage device 22.2 can be embodied as operating on two sides. In this case, although only one vertically movable storage unit 124.2, for example, is provided, it is provided on both sides with a movable wall 98 and an assigned guide section 92.2 and/or a dedicated pivot drive for wall 98.

For a storage device 22.1 for used printing formes 06, arranged, e.g. operationally stationary in the access region of operating plane B1; B2 (B0), in particular main operating plane B1, with respect to the pivoting of storage unit 104 around a pivot axis S104 extending parallel to the forme cylinder axis of a printing couple 02 assigned to storage device 22.2, the above statements relating to vertically movable storage device 22.2 can be transferred or applied, however the pivot axis S122.1 of lever 122 assigned to frame 04; 73 can be arranged fixed to the frame, for example, and the other end of lever 122 can engage on a wall 98 of storage unit 124.1 or an extension which continues wall 98 as a delivery table. A drive mechanism, not further specified here, then raises storage unit 124.1, to produce a change between the idle position and the receiving position, wherein said storage unit pivots around the vertically moved pivot axis and moves with its upper end or the extension in the direction of printing couple 02. Once printing forme(s) 06 has been received, the storage unit is lowered again, and pivots into a predominantly vertical state.

In the example of the printing forme changing system for the printing forme 06 which is spaced from main operating plane B1 or a spaced printing couple group, said system having the vertical conveying system 43 for the new plates and/or the conveying system 44 for the old plates and the specifications of transfer unit 18 configured as preferred by way of example, the following sequences or only portions thereof are specified as sub-sequences for the printing forme changeover.

First, in a sub-sequence for unplating, one or more printing formes 06 of one or more printing couples 02 which are spaced vertically as described above from main operating plane B1 and/or removal position P124.2A are to be removed. To accomplish this—if transfer unit 18 is not already located in a position close to the forme cylinder—transfer unit 18 is moved by corresponding movements on guiding system 23 to its working position (in FIG. 1, e.g. on the lower of the two printing couples 02 of the upper printing couple group). Forme cylinder 03 is or has been moved to a rotational angle position specified for the start of the printing forme changeover process. In this position, on forme cylinder 03, the retaining means optionally provided in channel 08 is opened in such a way that particularly trailing end 11 can emerge. Printing forme 06 is then unwound by rotating forme cylinder 03, gripped by a retaining element 63; 72 of transfer unit 18, and moved by the latter along an optionally curved transport path 23 and optionally a switch 27 up to a transfer position distant from the printing couple. If transfer unit 18 is then in the transfer position, retaining elements 72 can be deactivated and printing forme 06 is delivered to storage unit 124.2 located in receiving position P124B or preferably to the supplemental means 104, e.g. embodied as delivery table 104 and located in receiving position L104A. In the former case, either storage unit 124.2 located in return position P 124.2B can be directly loaded by transfer unit 18, or storage unit 124.2, which previously was still positioned below return position P124B, can be moved by a corresponding activation of drive means 74 to its position P124B, in which it engages behind printing formes 06 transported by transfer unit 18 and receives them. In the preferred case of a supplemental means 104, printing formes 06 are first delivered by transfer unit 18 to said supplemental means. Storage unit 124.2, which previously was still positioned below return position P124B, is then moved by a corresponding actuation of drive means 74 to its position P124B, in which it engages behind and receives the printing formes 06 which are held by supplemental means 104.

In a sub-sequence for mounting one or more new printing formes 06 in the example of the one printing couple 02 spaced vertically from loading position P17.2A, carriage 46 is located with printing forme storage unit 17.2 and/or with a carrier 36 which can be loaded with a carrier element 37 in working position P17.2A or is moved thereto. There, this printing forme storage unit 17.2 is loaded with new printing formes 06 by the operator, or empty carrier element 37 of printing forme storage unit 17.2 is exchanged for a carrier element 37 loaded with new printing formes 06. In this case, printing forme storage device 17.2 to be newly loaded or already loaded is in its loading state L17A.

Carriage 46 is then conveyed with printing forme storage unit 17.2 to vertically offset advanced position P17.2B, which can be carried out, as described above, exclusively linearly or with guidance that effects a pivoting movement out of the preferably vertical transport state L17A to an intermediate state L17C or directly into a working state L17B. Alternatively, working state L17B can be reached by a pivoting out of transport state L17A or intermediate state (see above) following the translational movement. For the case described here in which first and second (pivotable) retaining elements 63; 72 are provided, once working state L17B has been reached, the second retaining elements 72 of transfer unit 18 are moved into engagement with the (uppermost) printing forme 06 to be mounted by pivoting said retaining elements, and are activated, in this case acted on with negative pressure. Retaining elements 72 are then pivoted back in the direction away from the printing couple, thereby pulling the leading printing forme edge into retaining elements 33 of printing forme storage unit 17.1; 17.2, in which printing forme 06 reaches a defined state and alignment and/or a subsequent suspension of the edge is enabled. Printing forme storage unit 17.1; 17.2 is then pivoted back to its idle state L17A or intermediate state L17C.

Forme cylinder 03 is either already located in a rotational angle position that is necessary for plating or is then moved into such a position. Transfer unit 18 which is carrying printing forme 06 is then moved to its transfer position close to the cylinder, where it is placed or even pressed on mounting device 19 by a lowering, in this case pivoting, of retaining elements 72 (63). Retaining elements 396 which are assigned to mounting device 19 are then activated, in this case acted on by negative pressure, and the retaining elements 72 (63) which are assigned to transfer unit 18 are deactivated and raised or pivoted away, so that printing forme 06 is transferred to mounting device 19. In an advantageous embodiment, as it is being transported by transfer unit 18, even before being transferred to mounting device 19, printing forme 06 is positioned by transfer unit 18 such that leading end 09 is positioned on or in opening 07 of channel 08 and/or is even hooked at least partially therein.

Finally, when retaining elements 106 of mounting device 19 are activated, forme cylinder 03 is rotated in the production direction, while contact pressure elements of an optionally provided contact pressure device 21 are adjusted. Printing forme 06, which is under tractive force, is wound onto the outer circumference of forme cylinder 03 until contact pressure elements of contact pressure device 21 finally press trailing end 11 into channel 08, where said contact elements are held in place, optionally by activation of corresponding means.

Each of the stated sequences of steps for unplating and plating can also be applied to the other printing couple 02 and/or to—if present—printing couples 02 of a vertically offset printing unit 01.1, wherein individual steps may be added or subtracted based on the configuration of the respective transport path 23; 23*a*; 23*b* (path shape, switch).

One or more of the described system components 15; 17.1; 17.2; 18; 19; 20; 21; 22.1; 22.2; 23 and/or sequences, for example at least one or more of the system components 15; 44, configured as conveying systems 15; 44, and/or the sequence for infeeding and/or returning used printing forme 06, can be incorporated, in an advantageous further development, into an entire system of printing forme logistics, which not only include the vertical conveyor assigned to printing tower 01 and/or the handling (storage, transport, plating/unplating) assigned to printing unit 01.1; 01.2, but also the handling within the printing machine or the print shop in a functional area 141 of the printing forme production and/or in a transport and/or logistics system for conveying at least the printing formes 06 that are required for a new production run using, e.g. transport means 151; 152 adapted for this purpose, e.g. by means of transport carriages 151; 152 suitable for this purpose in a manually handled transport system 142 or a transport system embodied as (partially) automated for an automatic delivery of printing formes to printing towers 01.

FIG. 26 schematically shows, by way of example, functional areas 141; 143; 149 and units 01; 144; 146; 147; 148 of a print shop, in which, in a functional area 143 characterized here by way of example as machine room 143, two printing units 01, a folding unit 144 and two roll changers 146 are shown, and in a functional area 141 characterized here as the printing forme production 141 area, for example, a printing forme exposure unit 147 (for exposing printing formes 06 with the corresponding printing images) and a printing forme punching device 148 (for bending printing forme ends 09; 11 and/or punching recesses which define the lateral register) are shown. FIG. 26 also shows a third functional area 149 having at least one control panel for controlling the printing machine. Functional areas 141; 143; 149 can also be arranged in a different spatial relationship to one another or spaced differently from one another and/or can be separated from one another by walls, e.g. having optionally closable passages.

Printing formes 06 that are produced in printing forme production area 141 for a new production run must be moved for loading on forme cylinder 03 to the location on the printing machine which is relevant in each case for the printing page and color segment of the product, i.e. to a defined location of a specific forme cylinder 03 of a certain printing unit 01, and then finally applied there.

In a simple embodiment which is advantageous e.g. particularly for smaller print shops, printing formes 06 can be transported to printing units 01 by transport carriages 151 which are moved manually or are merely motor-assisted (as shown by way of example in FIG. 27), by which a plurality of printing formes 06 of a printing couple 02 can be or are received directly in a defined spatial assignment, or a carrier element 37 that receives a plurality of printing formes 06 of a printing couple 02 in a defined spatial assignment can be or are received. In the first case, transport carriage 151 is preferably provided with retaining elements, particularly at predefined points on said carriage, or in the second case, said transport carriage is detachably loadable with one or preferably with a plurality of these carrier elements 37, each of which carries a plurality of printing formes 06, in particular at predefined points. Each carrier element 37 which is loaded with a plurality of printing formes 06 can preferably be removed as a whole on site at printing unit 01, as storage element 37 in the manner of a changeover magazine 37, i.e. removed along with printing formes 06 from transport carriage 151 and inserted, positioned together with printing formes 06, in or on a corresponding carrier 36 assigned to printing unit 01 in such a way that carrier 36, which is loaded with carrier element 37 which carries printing formes 06, formes a printing forme magazine which is assigned to printing unit 01.1; 01.2 and is loaded with new printing formes 06. In an advantageous embodiment, carrier element 37 is embodied as described above with a plurality of retaining elements 33 spaced from one another in the longitudinal direction of printing formes 06 to be received, one in front of the other, for receiving the bent ends 09; 11 of printing formes 06. Preferably, the above statements relating to the configuration of carrier element 37, of carrier 36 and of the disposition thereof in printing unit 01 can be applied.

To hold carrier elements 37 that are loaded with printing formes 06 in reserve close to the printing tower, brackets can be provided close to the printing tower at the level of main operating plane B1, for example on side frames 04 of printing units 01, which provide, e.g. parking positions PP1; PP2; PP3; PP4 for loaded carrier elements 37. From these parking positions PP1; PP2; PP3; PP4, carrier elements 37 can then be removed manually or by a manipulator, depending on the configuration of the system, and installed in printing unit 01 or a corresponding carrier 36.

Figure 20:
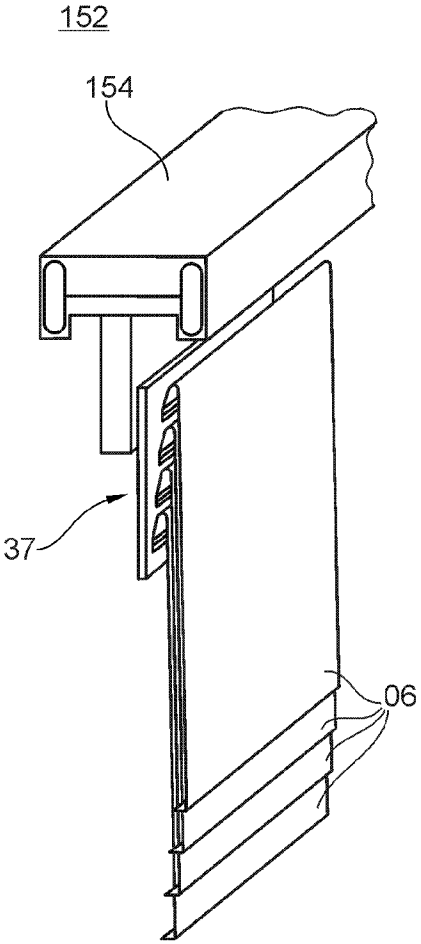
FIG. 20 an embodiment example of an automatically movable transport carriage.
Figure 19:
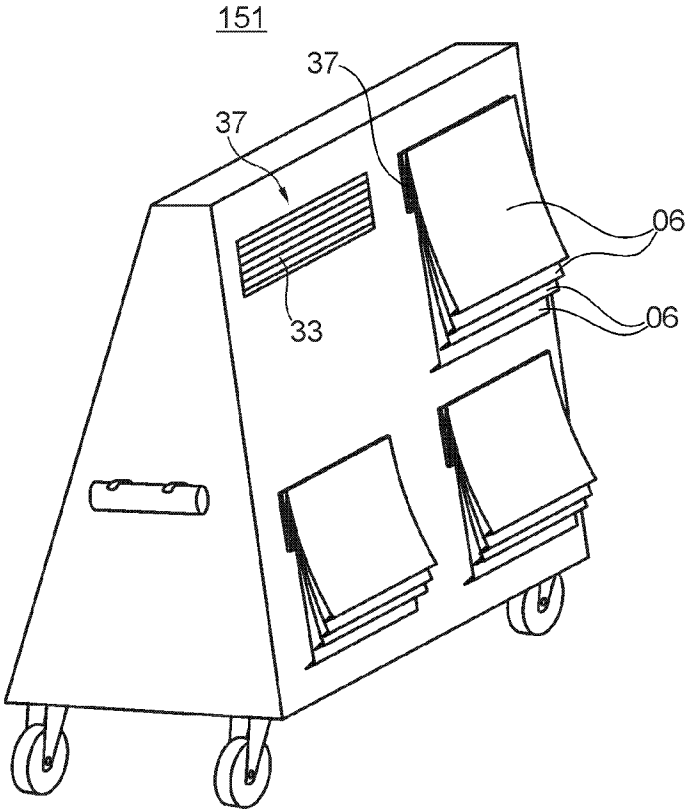
FIG. 19 an exemplary embodiment of a manually moved transport carriage.

In an embodiment of printing forme logistics which is advantageous particularly for large print shops, printing formes 06 can be transported to the printing towers 01, e.g. by transport carriages 152 (shown by way of example in FIG. 20), which move as part of a transport system 142, guided along a corresponding transport path 153, e.g. along a guiding system 153 embodied as a track system 153, for example to parking positions PP1; PP2; PP3; PP4 (see, e.g. FIG. 26). The movement on track system 153 is motorized and is preferably carried out, in terms of the control of transport carriage 152, in track system 153, e.g. in terms of optionally required branches and/or to stopping at a target position (e.g. parking position or transfer position PP1; PP2; PP3; PP4), at least on the path between the departure from printing forme production 141 or a buffer storage device 156 for, e.g. already loaded carrier elements 37 and/or transport carriages 151 and the target position, i.e. the printing tower 01 in question, automatically via a control device, not shown.

While preferred embodiments of a method for conveying printing formes during the changeover of the printing formes and a printing machine having a printing tower and a vertically movable storage device, in accordance with the present invention, have been set forth fully and completely hereinabove, it will be apparent to one of skill in the art that changes could be made without departing from the true spirit and scope of the present invention which is accordingly to be limited only by the appended claims.

What is claimed is:

1. A printing machine comprising:

a printing tower;

a plurality of printing couples arranged vertically one above the other in the printing tower, first ones of the plurality of printing couples defining a first machine plane, second ones of the plurality of printing couples being spaced vertically in the printing tower above the first ones of the plurality of printing couples and defining a vertically spaced advanced position;

a printing forme changing system including at least one vertically movable printing forme storage device and adapted for the infeed of printing formes;

an additional printing forme storage device for the first ones of the plurality of printing couples and adapted for the infeed of printing formes;

a conveying system to move the at least one vertically movable printing forme storage device along a conveying path from a printing forme loading position in the area of the first machine plane to the vertically spaced advanced position assigned to the second ones of the plurality of printing couples;

wherein the at least one vertically movable printing forme storage device and the additional printing forme storage device are arranged and configured such that the at least one vertically movable printing forme storage system, in its printing forme loading position, and the additional printing forme storage device, in its printing forme loading position are offset from one another, and can each be reached, for one of loading with printing formes and receipt of a carrier element which is preloaded with printing formes, from the first machine plane, the conveying system, the at least one vertically movable printing forme storage device and the additional printing forme storage device being arranged, in their printing forme loading positions, on a side of the printing tower, as viewed in a horizontal direction, of an operating space accessible to a printing machine operator; and wherein, when the at least one vertically movable printing forme storage device is in its vertically spaced advanced position at an end of its conveying path, the printing formes placed in the at least one vertically movable printing forme storage device are in proper lateral register and position for their printing locations on a forme cylinder in one of the second ones of the plurality of printing couples, with respect to an axial direction of the forme cylinder to be loaded with the conveyed printing formes.

2. The printing machine according to claim 1, wherein at least one of the conveying system and the vertically movable printing forme storage device is arranged and configured such that the vertically movable printing forme storage device is in a transport state over at least a part of its conveying path, which transport state differs in terms of one of a tilt, in relation to vertical, of a longitudinal extension of the print formes in the vertically movable printing forme storage device from a tilt in a working stage of the vertically movable printing forme storage device, which the vertically movable printing forme storage device occupies in the advanced position assigned to one of the second printing couple and couples.

3. The printing machine according to claim 1, wherein both the vertically movable printing forme storage device located in its loading position and the additional printing forme storage device assigned to the first machine plane on the same side of the printing tower can be reached from a common operating space of the first machine plane and can be loaded with ones of printing formes and with a carrier element that is preloaded with printing formes, and wherein the conveying system, the vertically movable printing forme storage device and the additional printing forme storage device are arranged and configured such that storage spaces for the printing formes to be transported one of on and in the vertically movable printing forme storage device lie within a printing couple alignment defined by the usable length of forme cylinders of the second ones of the plurality of printing couples at the respective loading position, and further wherein the conveying system and the two printing forme storage devices are arranged on an external side of the printing tower that faces the operating space.

4. The printing machine according to claim 1, wherein the advanced position of the vertically movable printing forme storage device lies one of outside of an access area of the first machine plane and within the access area of a second machine plane which is different from the first machine plane, wherein ones of the first ones of the plurality of printing couples and the second ones of the plurality of printing couples are arranged on the same side of a web to be one of guided through the printing tower and passing through the printing tower.

5. The printing machine according to claim 1, wherein each printing forme storage device extends, as viewed in the axial direction of the forme cylinder to be loaded with the conveyed printing formes, over at least a nominal width of the forme cylinder.

6. The printing machine according to claim 1, wherein each storage device is one of arranged and mounted, in its advanced position, in the printing machine such that in its working state it is located in an access area of a transfer unit, by which transfer unit at least one of a printing forme and a plurality of printing formes can be received simultaneously by the vertically movable printing forme storage device and can be moved to one of a position close to the forme cylinder that will be loaded with the one or more printing formes and to a position in which the at least one of the printing forme and the printing formes can contact one end of the forme cylinder to be loaded with the conveyed printing formes.

7. The printing machine according to claim 1, wherein the conveying system has a drive which translationally conveys one of the at least one vertically movable printing forme storage device and a carriage part which is connected to the at least one vertically movable printing forme storage device along a conveying distance between the loading position and the advanced position and has a guide for translational movement, a spatially fixed part of which is formed by a guide structure.

8. The printing machine according to claim 7, wherein the guide structure includes a rectilinear guide path over one of an entire conveying distance between loading the position and advanced position and at least over at least one linear guide section.

9. The printing machine according to claim 8, wherein the guide structure includes an adjoining second guide section which advances the at least one linear guide section in a direction of the advanced position and which has a guide path which is curved over at least a portion thereof, and wherein the guide path of the first and the adjoining second guide section and an arrangement of at least one stop element provided on one of the storage device and the carriage part, for guidance, are arranged relative to one another and are configured to cause a tilting of the at least one vertically movable printing forme storage device from its transport state to one of its working state and to an intermediate state which is different therefrom during conveyance of the at least one vertically movable printing forme storage device from the at least one linear guide section to an end position of the second guide section.

10. The printing machine according to claim 8, wherein the at least one vertically movable printing forme storage device is embodied as part of a transport and storage unit which can be moved translationally along a path defined by the guide structure, and is mounted on the transport and storage unit to pivot around at least one pivot axis which is parallel to the forme cylinder axes of the second ones of the plurality of printing couples.

11. The printing machine according to claim 1, wherein one of the at least one of the vertically movable printing forme storage device, the additional printing forme storage device and a detachable carrier element is configured such that a plurality of printing formes can be stored simultaneously one of on and in the one of the at least one vertically movable printing forme storage device and the additional printing forme storage device, with ends of the plurality of printing formes one of offset from one another in the form of scales, one in front of the other and one above the other.

12. The printing machine according to claim 1, further including a second vertically movable printing forme storage device, which is different from the at least one vertically movable printing forme storage device and the additional printing forme storage device provided for printing formes to be newly applied, which second movable printing forme storage device is intended for the return of printing formes removed from second ones of the plurality of printing couples, and wherein a second conveying system is provided, by the use of which second conveying system the second vertically movable printing forme storage device can be moved, independently of the at least one vertically movable printing forme storage device, between a second loading position which is spaced vertically from the first machine plane and which is assigned to second ones of the plurality of printing couples, and a removal position which is assigned to the first machine plane.

* * * * *